US012789034B2

(12) United States Patent
Perez et al.

(10) Patent No.: US 12,789,034 B2
(45) Date of Patent: Nov. 10, 2026

(54) WEIGHTED BAG AND WEIGHTLIFTING ASSEMBLY

(71) Applicant: Coulter Ventures, LLC., Columbus, OH (US)

(72) Inventors: Anelia Perez, Hilliard, OH (US); Laurie Ann Coughlan, Westerville, OH (US); Ahmik Jones, Upper Arlington, OH (US); William Henniger, Columbus, OH (US); Charlie Raymond, St. Clair, MI (US)

(73) Assignee: Coulter Ventures, LLC., Columbus, OH (US)

( * ) Notice: Subject to any disclaimer, the term of this patent is extended or adjusted under 35 U.S.C. 154(b) by 17 days.

(21) Appl. No.: 18/756,685

(22) Filed: Jun. 27, 2024

(65) Prior Publication Data

US 2025/0001233 A1 Jan. 2, 2025

Related U.S. Application Data

(60) Provisional application No. 63/529,949, filed on Jul. 31, 2023, provisional application No. 63/523,618, filed on Jun. 27, 2023.

(51) Int. Cl.
*A63B 21/06* (2006.01)
*A63B 21/00* (2006.01)

(52) U.S. Cl.
CPC ..... *A63B 21/0603* (2013.01); *A63B 21/0609* (2013.01); *A63B 21/4035* (2015.10)

(58) Field of Classification Search
CPC ..... A63B 21/0603; A63B 21/0609; A63B 21/4035; A63B 21/072
See application file for complete search history.

(56) References Cited

U.S. PATENT DOCUMENTS

| | | | |
|---|---|---|---|
| 291,015 | A | 12/1883 | Rumsey |
| 2,616,467 | A | 11/1952 | Cicero |
| 3,443,397 | A | 5/1969 | Donovan et al. |
| D235,384 | S | 6/1975 | Theilkas |
| 4,527,796 | A | 7/1985 | Critelli |

(Continued)

OTHER PUBLICATIONS

Product listing for Rogue Strongman Sandbags from https://web.archive.org/web/20160812070131/https://www.roguefitness.com/rogue-strongman-sandbags , dated Aug. 12, 2016.

(Continued)

*Primary Examiner* — Andrew M Kobylarz
(74) *Attorney, Agent, or Firm* — Banner & Witcoff, Ltd.

(57) ABSTRACT

A bag includes an outer shell formed of one or more flexible panels connected together to define an inner cavity configured to contain a particulate material, with the outer shell having a first or top end, a second or bottom end opposite the first end, and an opening providing access to the inner cavity. A tube structure extends through the outer shell from the first end to the second end of the outer shell. The tube structure includes a first opening in the first end of the outer shell, a second opening in the second end of the outer shell, and a tube extending through the inner cavity of the outer shell, from the first opening to the second opening. The tube is configured to receive an implement, such as a rope or a handle assembly, therethrough to connect the bag to the implement.

23 Claims, 47 Drawing Sheets

(56) References Cited

U.S. PATENT DOCUMENTS

| | | | | |
|---|---|---|---|---|
| 4,802,344 | A * | 2/1989 | Livingston | F25D 3/08 62/457.2 |
| 5,251,460 | A | 10/1993 | DeMarco et al. | |
| 5,413,199 | A | 5/1995 | Clement | |
| 5,433,637 | A * | 7/1995 | Graves | B63C 9/08 441/80 |
| 5,918,332 | A | 7/1999 | Dees | |
| 6,126,054 | A | 10/2000 | Riemer | |
| 6,186,662 | B1 | 2/2001 | Jackson | |
| 6,217,489 | B1 | 4/2001 | Nicholson | |
| 6,398,697 | B1 * | 6/2002 | Nichols, Jr. | A63B 69/224 473/441 |
| 8,413,776 | B1 | 4/2013 | Huff | |
| 8,622,877 | B2 | 1/2014 | Raines et al. | |
| 9,586,119 | B2 | 3/2017 | Fu | |
| 10,105,566 | B2 | 10/2018 | Buikema | |
| 10,149,997 | B1 * | 12/2018 | Henniger | A63B 21/0603 |
| 10,343,009 | B2 | 7/2019 | Peyton | |
| 10,350,474 | B1 * | 7/2019 | Magrino | A63B 69/224 |
| 10,981,030 | B2 | 4/2021 | Henniger et al. | |
| 11,318,345 | B2 | 5/2022 | Bassoo | |
| D955,751 | S * | 6/2022 | Coughlan | D3/254 |
| 11,931,639 | B2 | 3/2024 | Coughlan et al. | |
| 12,502,571 | B2 * | 12/2025 | Allen | A63B 21/06 |
| 2012/0184418 | A1 | 7/2012 | Wilson | |
| 2014/0226919 | A1 | 8/2014 | Fu et al. | |
| 2015/0051053 | A1 | 2/2015 | Conen | |
| 2015/0102028 | A1 * | 4/2015 | Carrasca | B65D 21/0228 220/288 |
| 2017/0036056 | A1 | 2/2017 | Tomellini et al. | |
| 2017/0265612 | A1 | 9/2017 | Wu | |
| 2018/0085619 | A1 | 3/2018 | Chen | |
| 2019/0269956 | A1 | 9/2019 | Henniger et al. | |
| 2019/0299046 | A1 | 10/2019 | Tomellini et al. | |
| 2021/0346777 | A1 * | 11/2021 | Coughlan | A63B 21/0603 |
| 2022/0032109 | A1 | 2/2022 | Henniger et al. | |
| 2022/0143451 | A1 | 5/2022 | Tomellini et al. | |
| 2023/0256287 | A1 * | 8/2023 | Allen | A63B 21/06 482/93 |
| 2024/0408472 | A1 | 12/2024 | Coughlan et al. | |

OTHER PUBLICATIONS

Product listing for Rogue Sandbags from http://web.archive.org/web/20160412084703/http://www.roguefitness.com:80/rogue-sandbags dated Apr. 12, 2016.

Product listing for Wreck Bag from https://www.roguefitness.com/wreck-bag, dated Sep. 21, 2018, product available at least as early as Aug. 13, 2016.

Product listing for Wreck Bag Mini from https://www.roguefitness.com/wreck-bag-mini, dated Sep. 21, 2018, product available at least as early as Dec. 13, 2016.

Product listing for StrongFit Classic Sandbags from https://www.roguefitness.com/strongfit-classic-sandbags, dated Sep. 21, 2018, product available at least as early as Aug. 13, 2016.

Product listing for Rogue Tactical Sandbags from https://web.archive.org/web/20150331060530/http://www.roguefitness.com:80/tactical-sandbags , dated Mar. 31, 2015.

"2017 Arnold Strongman Classic—Weight Over Bar/4K" (Rogue Fitness) Mar. 6, 2017 (Mar. 6, 2017) [online] retrieved from <URL: https://www.youtube.com/watch?v=tJUa5qIMOoA> entire document, especially demonstration 0:25-0:34, 4:50.

"Rogue Sandbags" (Rogue Fitness) Jun. 20, 2017 (Jun. 20, 2017) [online] retrieved from <URL: http://www.roguecanada.ca:80/rogue-sandbags>entire document.

Product listing for Rogue Strongman Throw Bag from <https://www.roguefitness.com/rogue-strongman-throwbag>, dated Mar. 29, 2020, product disclosed at least as early as May 30, 2018.

Product listing for Rogue Cyclone Strongman Sandbags from <https://www.roguefitness.com/rogue-cyclone-strongman-sandbags>, dated Mar. 29, 2020, product disclosed at least as early as Mar. 16, 2018.

Product listing for Rogue Feed Sack from <https://www.roguefitness.com/rogue-feed-sack>, dated Mar. 29, 2020, product disclosed at least as early as May 16, 2018.

Ludus Imperium Strongman sandbag, Heavy Duty Workout sandbags for Training, Fitness, cross-training & Exercise, Workouts, Sandbag Weights; (<https://www.amazon.co.uk/Ludus-Imperium-Strongman-Sandbags-Cross-training/dp/B07F1YP89Y/ref=sr_1_5?dchild=1&keywords=rogue%2Bcyclone%2Bsandbag&qid=1616886133&sr=8-5&th=1>), access date Apr. 30, 2021.

Rogue Cyclone Sandbags, (https://www.roguefitness.com/rogue-cyclone-strongman-sandbags), Available 2018.

Product listing for ROGUE Strongman Sandbags 100LBS-400LBS from http://web.archive.org/web/20210212005140/https://www.roguefitness.com/rogue-strongman-sandbags, dated Feb. 12, 2021.

Rogue Fitness, "Rogue Sandbag 2.0", First reviewed on Mar. 2021 (https://www.roguefitness.com/rogue-sandbag-2-0) 2021).

Two Rep Cave, "Brute Force Athlete Sandbag Review . . . ", published Jul. 5, 2018. (https://www.tworepcave.com/4944/brute-force-sandbags-review[) (Year: 2018).

Amazon.com, Lionheart Sand Fillable Weight Plates, First available Jun. 15, 2022, <https://www.amazon.com/Lionheart-Plate-Pair-Fillable-Barbell/dp/B09WHYYWDB?source=ps-sl-shoppingads-Ipcontext&ref_=fplfs&smid=A1EHPQSX94GBYQ&th=1>.

Rogue Cyclone Sandbags, posted at roguefitness.com, first available Apr. 2018, retrieved on Apr. 26, 2023, online, https:// www.roguefitness.com/rogue-cyclone-strongman-sandbags (Year: 2018).

Titan fitness sandbag, posted at amazon.com, first available Nov. 23, 2021, retrieved on Apr. 26, 2023, online, https://www.amazon.com/Titan-Fitness-Strongman-Sandbags-Training/dp/B09MMD6DRF (Year: 2021).

Roguefitness.com. "Rogue 3-in-1 Sandbag". First reviewed Dec. 2021. Retrieved Apr. 6, 2024. (https://www.roguefitness.com/rogue-3-in-1-sandbag) (Year: 2021).

Kickstarter, Lionheart Lifting: Reimagined Veteran Owned Weight Plates, last updated May 25, 2022, retrieved from: https://www.kickstarter.com/projects/bepartof137/lionheart-lifting-reimagined-veteran-owned-weight-plates.

* cited by examiner

WEIGHTED BAG AND WEIGHTLIFTING ASSEMBLY

CROSS-REFERENCE TO RELATED APPLICATIONS

This application is a non-provisional of, and claims priority to, U.S. Provisional Application No. 63/529,949, filed Jul. 31, 2023, and U.S. Provisional Application No. 63/523,618, filed Jun. 27, 2023, both of which prior applications are incorporated by reference herein in their entireties.

TECHNICAL FIELD

This disclosure relates in general to weighted bags for use in weightlifting exercises, and more particularly, to weighted bags that are connectable to various implements for use in weightlifting and weightlifting assemblies including such weighted bags.

BACKGROUND OF THE DISCLOSURE

The use of different devices in the lifting of weights and general exercising is well known in the art. Many such exercises and lifts generally utilize a rigid or solid weight that is coupled to a handle, a bar or a cable and pulley system, for example, weightlifting machines, barbells, kettlebells, dumbbells and the like. Such devices provide the advantage of loadable or otherwise variable weighting as desired by the user. However, the use of such rigid devices involves rigid articles impacting each other and/or various surfaces within the area, e.g., the floor surface. Impacts with these rigid articles can cause damage and significant noise and bounce erratically. Additionally, some of these rigid devices may lack versatility and are not suited for use without designated bars or handles.

Flexible or semi-rigid devices for weightlifting also exist, including weighted bags having various shapes (which may or may not have handles), medicine balls, and similar articles that can be lifted, carried, thrown, etc. Such devices may be fillable with a filler material such as sand, or be permanently filled. These flexible devices provide unique capabilities and reduced noise relative to rigid weights. However, these flexible devices tend to experience unpredictable forces and non-uniform loading depending on how they are manipulated and/or how they are grasped, dropped or otherwise impacted. Flexible devices of this type are therefore susceptible to damage, such as seams splitting, leakage of filler material, etc. Additionally, handles for such bags are often connected by stitching, and repeated handle use is often a source of damage to or failure of the device. For example, openings, tears, rips and the like are often formed proximate the stitching or other joining between the handle and the panels forming the article, as stress concentrations are experienced in such locations. Further, such bags may not be designed for use in certain exercises, where a rigid handle offers the best performance.

The present disclosure is provided to address these and other needs in existing weightlifting devices. A full discussion of the features and advantages of the present invention is deferred to the following detailed description, which proceeds with reference to the accompanying drawings.

BRIEF SUMMARY

Aspects of the disclosure relate to a bag that includes an outer shell formed of one or more flexible panels connected together to define an inner cavity configured to contain a particulate material, with the outer shell having a first or top end, a second or bottom end opposite the first end, and an opening providing access to the inner cavity. A tube structure extends through the outer shell from the first end to the second end of the outer shell. The tube structure includes a first opening in the first end of the outer shell, a second opening in the second end of the outer shell, and a tube extending through the inner cavity of the outer shell, from the first opening to the second opening. The tube is configured to receive an implement, such as a rope or a handle assembly, therethrough to connect the bag to the implement.

According to one aspect, the bag also includes an inner bag positioned within the inner cavity of the outer shell and having a filling cavity configured to contain the particulate material, where the inner bag is accessible through the opening in the outer shell for filling. The inner bag has a top opening and a bottom opening, and the tube extends through the inner bag from the top opening to the bottom opening. In one aspect, the tube has a top end that is fixed to the top opening of the inner bag and a bottom end that is fixed to the bottom opening of the inner bag, and the inner bag is fixed to the outer shell within the inner cavity. In another aspect, the outer shell further includes a cover releasably secured to the outer shell by a shell closure to open and close the opening, such that the cover is configured to be moved to provide access to the inner cavity when the shell closure is disconnected. In this configuration, the cover may be a flap connected to the outer shell along an edge connection, and the cover is configured to provide access to the inner cavity by pivoting about the edge connection when the shell closure is disconnected. In a further aspect, the bag also includes a plurality of mesh baffles connected to the tube and an inner surface of the inner bag and extending across the filling cavity from the tube to the inner surface of the inner bag.

According to another aspect, the tube is an outer tube formed of a fabric material, the bag further includes an inner tube positioned within the outer tube and extending along at least a portion of a length of the outer tube. The inner tube may have a greater rigidity than the outer tube.

According to a further aspect, the tube structure further includes a first flared portion at the first opening, connecting the first end of the outer shell to the tube, and a second flared portion at the second opening, connecting the second end of the outer shell to the tube. The tube extends between the first and second flared portions. In one aspect, the first flared portion, the second flared portion, and the tube are formed by a plurality of fabric panels connected together side by side. Each of the fabric panels has a first wide portion forming part of the first flared portion, a second wide portion forming part of the second flared portion, and a narrow portion extending from the first flared portion to the second flared portion and forming part of the tube.

According to yet another aspect, the bag further includes an inner bag positioned within the inner cavity of the outer shell and having a filling cavity configured to contain the particulate material. The inner bag is accessible through the opening in the outer shell for filling, and the inner bag surrounds at least a portion of the tube structure. In one aspect, the bag further includes a plurality of mesh baffles connected to the inner bag and extending across the filling cavity of the inner bag. In another aspect, the bag also includes a second inner bag positioned inside of the outer shell and having a second filling cavity configured to contain the particulate material, where the second inner bag is accessible through a second opening in the outer shell for filling. The second inner bag surrounds a second portion of the tube structure and is positioned alongside the inner bag within the inner cavity.

According to a still further aspect, the outer shell has a rectangular cubic shape, and the plurality of panels include four side panels forming four flat, rectangular sides of the rectangular cubic shape. In this configuration, the outer shell may include a rectangular cover panel at the first end of the outer shell, secured to one of the flat side panels at an edge connection and releasably secured to the other flat side panels by the shell closure, and a bottom panel at the second end of the outer shell, secured to the flat side panels opposite the rectangular cover panel.

According to an additional aspect, the outer shell may have a cylindrical shape, and the plurality of panels include a circumferential body panel forming a circumferential side wall of the cylindrical shape, a circular top panel at the first end of the outer shell, and a circular bottom panel at the second end of the outer shell. In one aspect, the top panel is a cover panel secured to the circumferential body panel at an edge connection and releasably secured around a remainder of the circumferential body panel by the shell closure.

According to an additional aspect, the outer shell has a cover positioned at the first end, and the shell closure releasably secures the cover to the outer shell around at least a portion of the cover to permit the cover to be opened and closed. In this configuration, the bag may also include a foldable flap moveable between a covered position, where the foldable flap covers the shell closure, and an uncovered position, where the foldable flap is positioned to permit the closure member to be manipulated to operate the shell closure to open the cover. In one aspect, the foldable flap is formed as a collar having a fixed end connected to the outer shell around a majority of a periphery of the outer shell and a free end configured to be moveable to fold the collar between the covered position and the uncovered position.

Additional aspects of the disclosure relate to an assembly that includes a bag defining an inner cavity configured to contain a particulate material and having a top and a bottom opposite the top, with a tube structure comprising a tube extending from the top to the bottom, through the inner cavity, and a handle assembly engaged with the bag. The handle assembly includes an enlarged base having a greater width than the tube, positioned at the bottom of the bag, a sleeve connected to the enlarged base and extending at least partially through the tube, and a pin received within the sleeve and secured to the sleeve, the pin having a handle located outside the sleeve and above the top of the bag.

According to one aspect, the pin and the sleeve are releasably securable to each other in a plurality of different positions to change a length of the handle assembly. In one aspect, the sleeve has an opening extending through a wall of the sleeve, and the pin has a plurality of passages along a length of the pin. In this configuration, the pin and the sleeve are releasably securable to each other by a fastener releasably received the opening in the sleeve and one of the passages of the pin.

Further aspects of the disclosure relate to an assembly including a first bag, a second bag, and a rope engaged with the first and second bags. The first bag defines a first inner cavity configured to contain a particulate material and has a first top and a first bottom opposite the first top, with a first tube structure defining a first passage extending from the first top to the first bottom, through the first inner cavity. The second bag defines a second inner cavity configured to contain a particulate material and has a second top and a second bottom opposite the second top, with a second tube structure defining a second passage extending from the second top to the second bottom, through the second inner cavity. The rope extends through the first passage and the second passage, such that the first bag and the second bag are positioned sequentially along a length of the rope.

According to one aspect, the rope further includes at least one knot positioned along the length of the rope to secure at least one of the first bag and the second bag in position.

Still other aspects of the disclosure relate to a method of assembling an assembly as described above. In one aspect, the method includes connecting the handle assembly to the bag and/or disconnecting the handle assembly from the bag, adjusting the handle assembly, and then reconnecting the handle assembly to the bag. In another aspect, the method includes inserting the rope through the first bag and the second bag. The rope may further be inserted through one or more additional bags that are similar or identical in structure to the first bag and/or the second bag. The method may include forming one or more knots in the rope.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION OF THE DISCLOSURE

Figure 1:
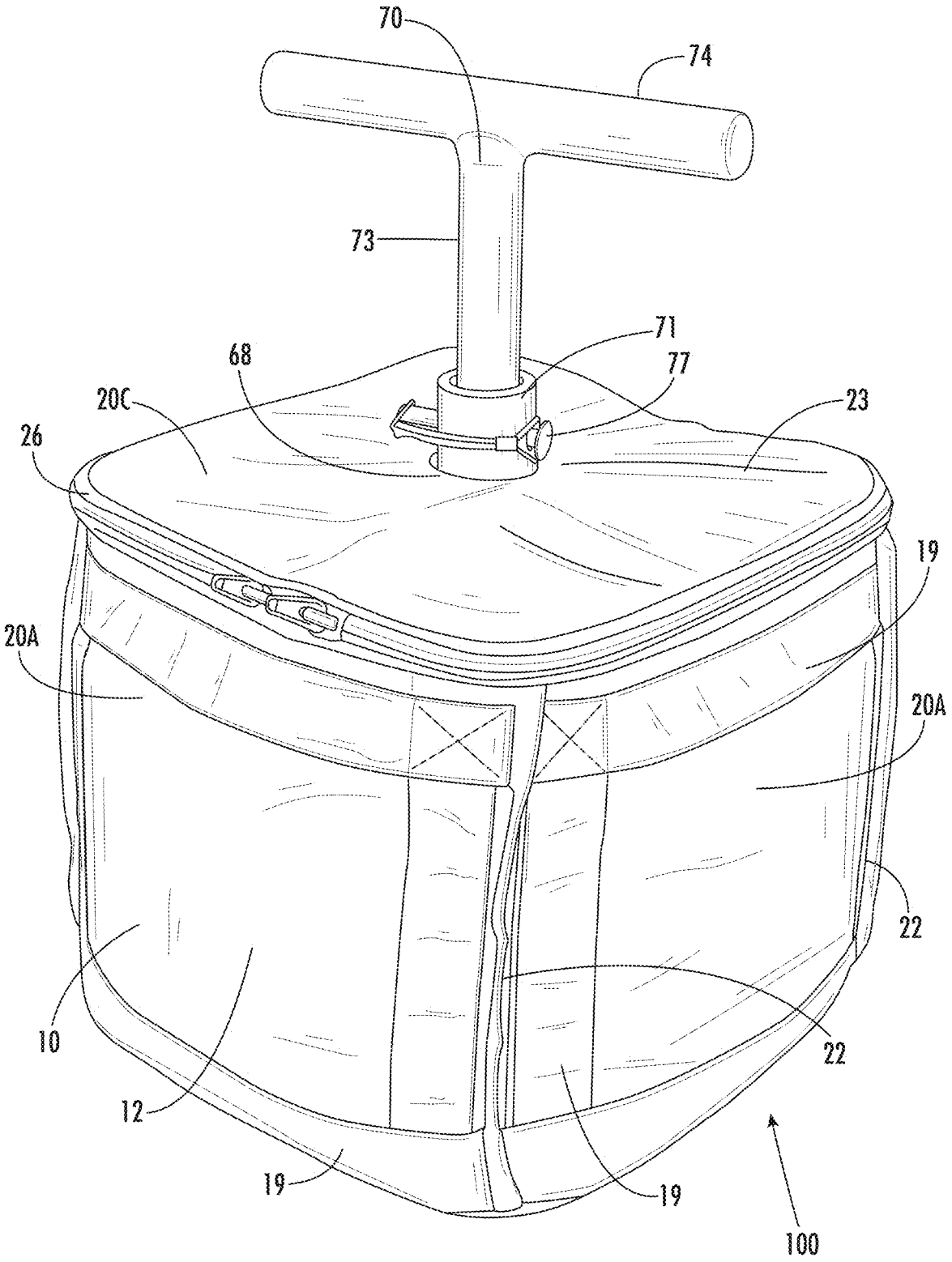
FIG. 1 is a front perspective view of one embodiment of a weightlifting assembly according to aspects disclosed herein.
Figure 2:
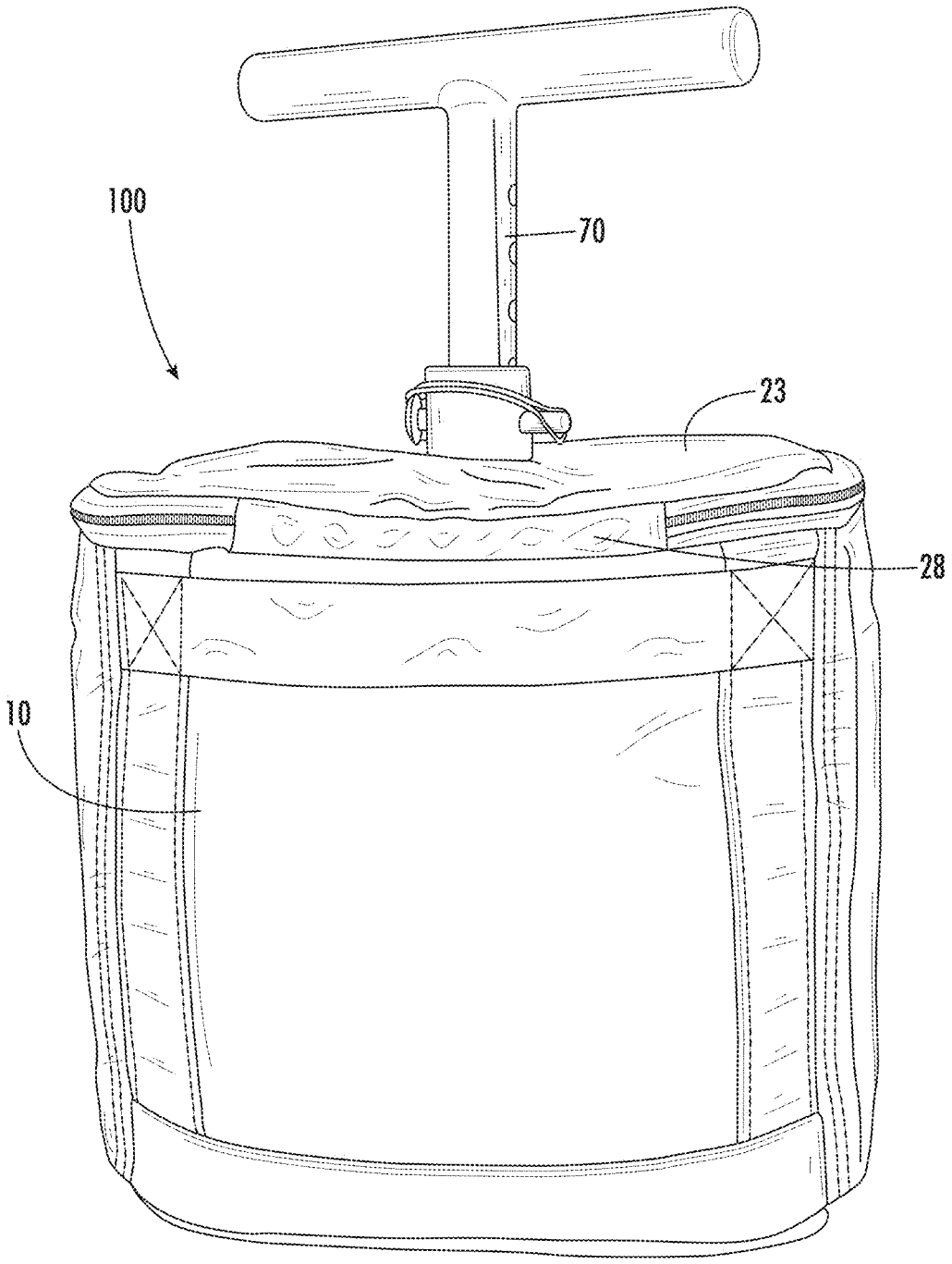
FIG. 2 is a rear view of the weightlifting assembly of FIG. 1.
Figure 3:
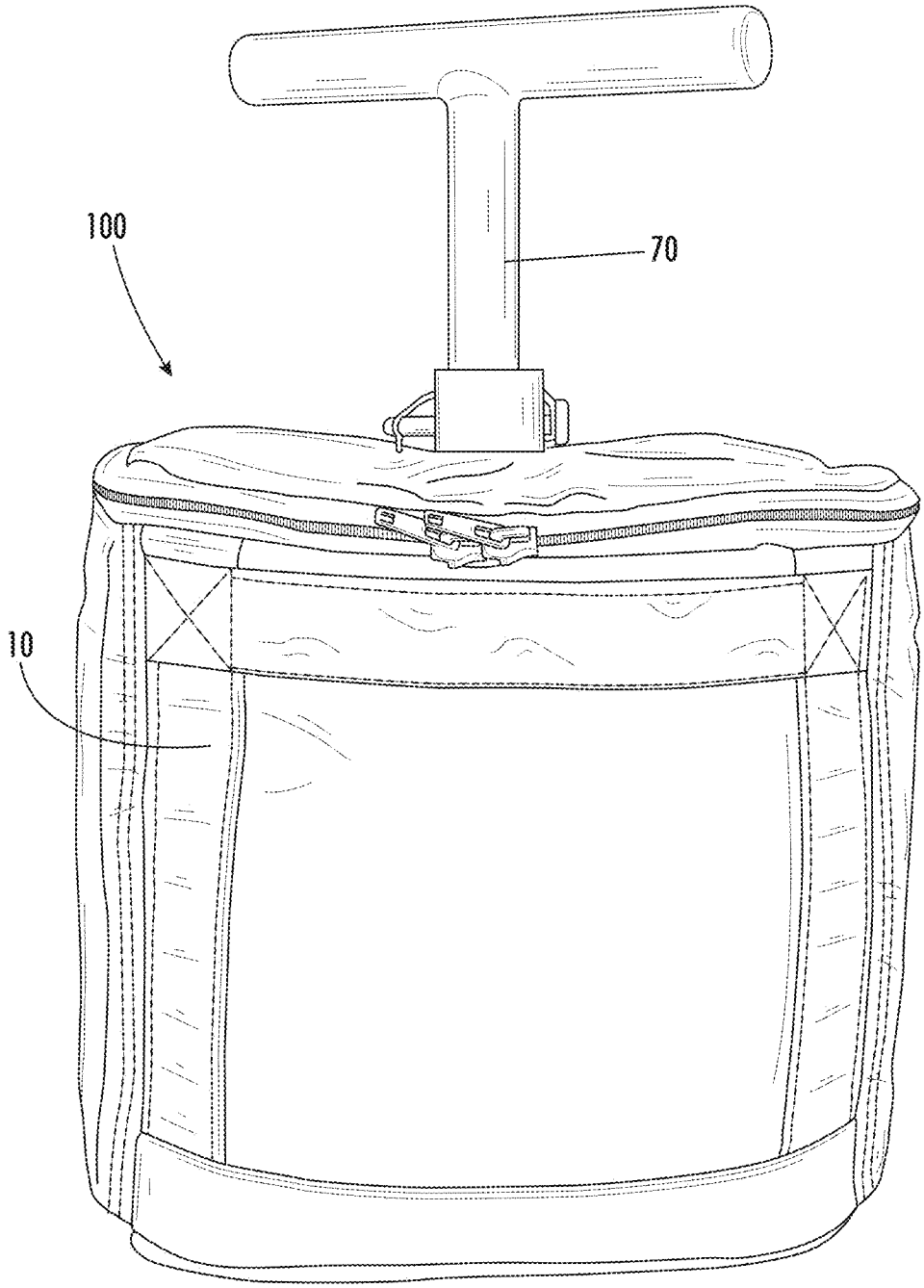
FIG. 3 is a front view of the weightlifting assembly of FIG. 1.
Figure 4:
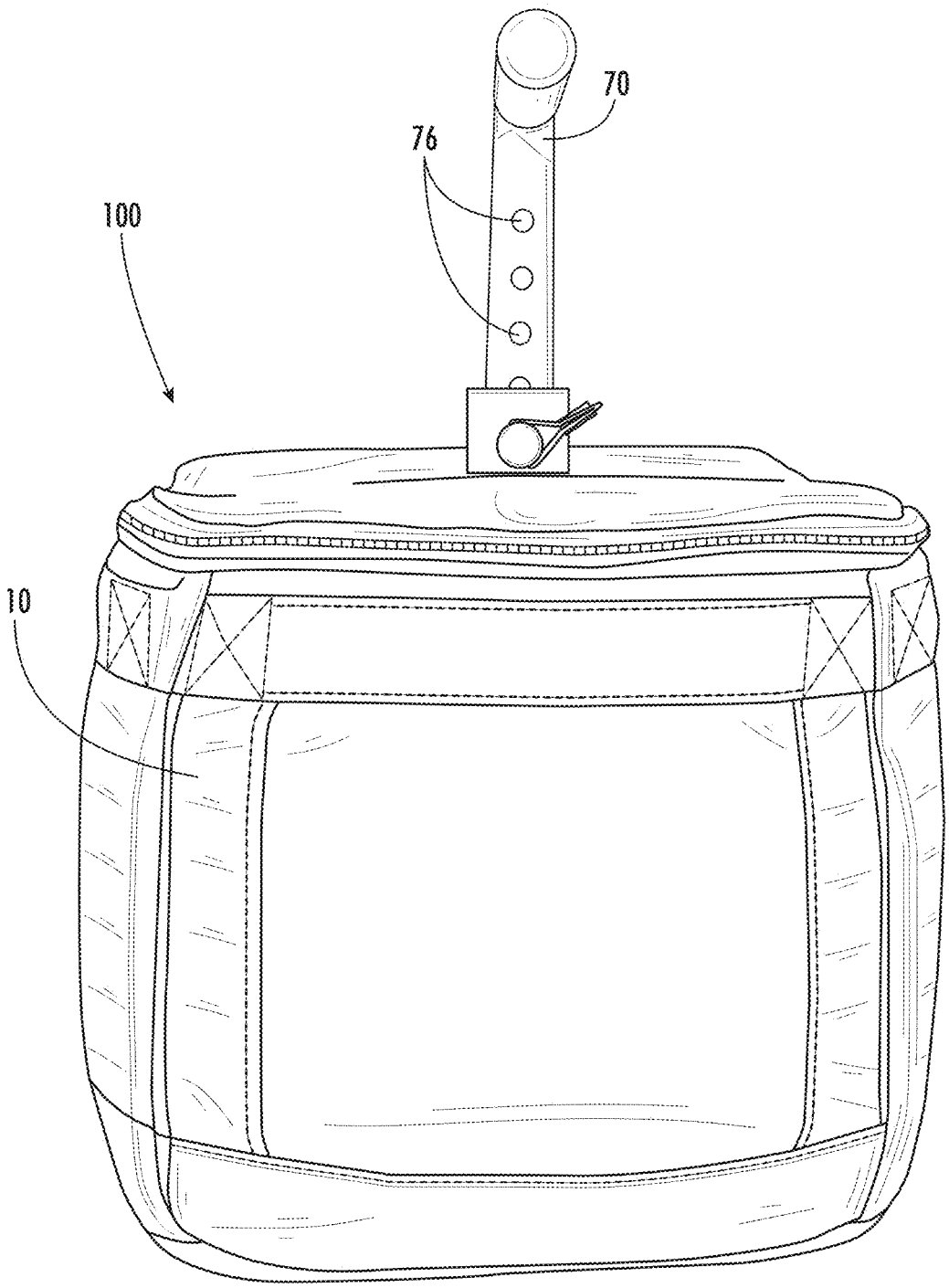
FIG. 4 is a side view of the weightlifting assembly of FIG. 1.
Figure 5:
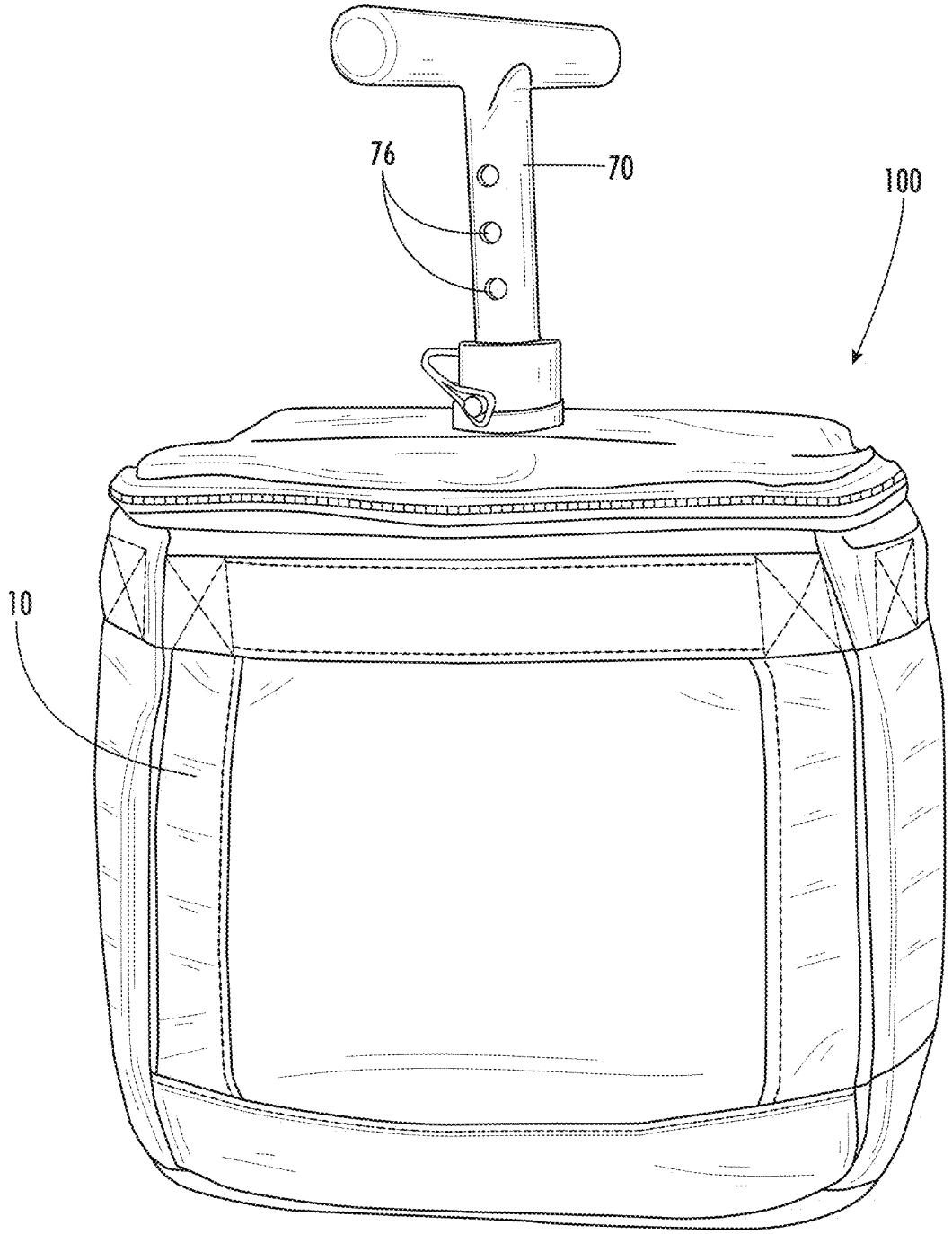
FIG. 5 is an opposite side view of the weightlifting assembly of FIG. 1.
Figure 6:
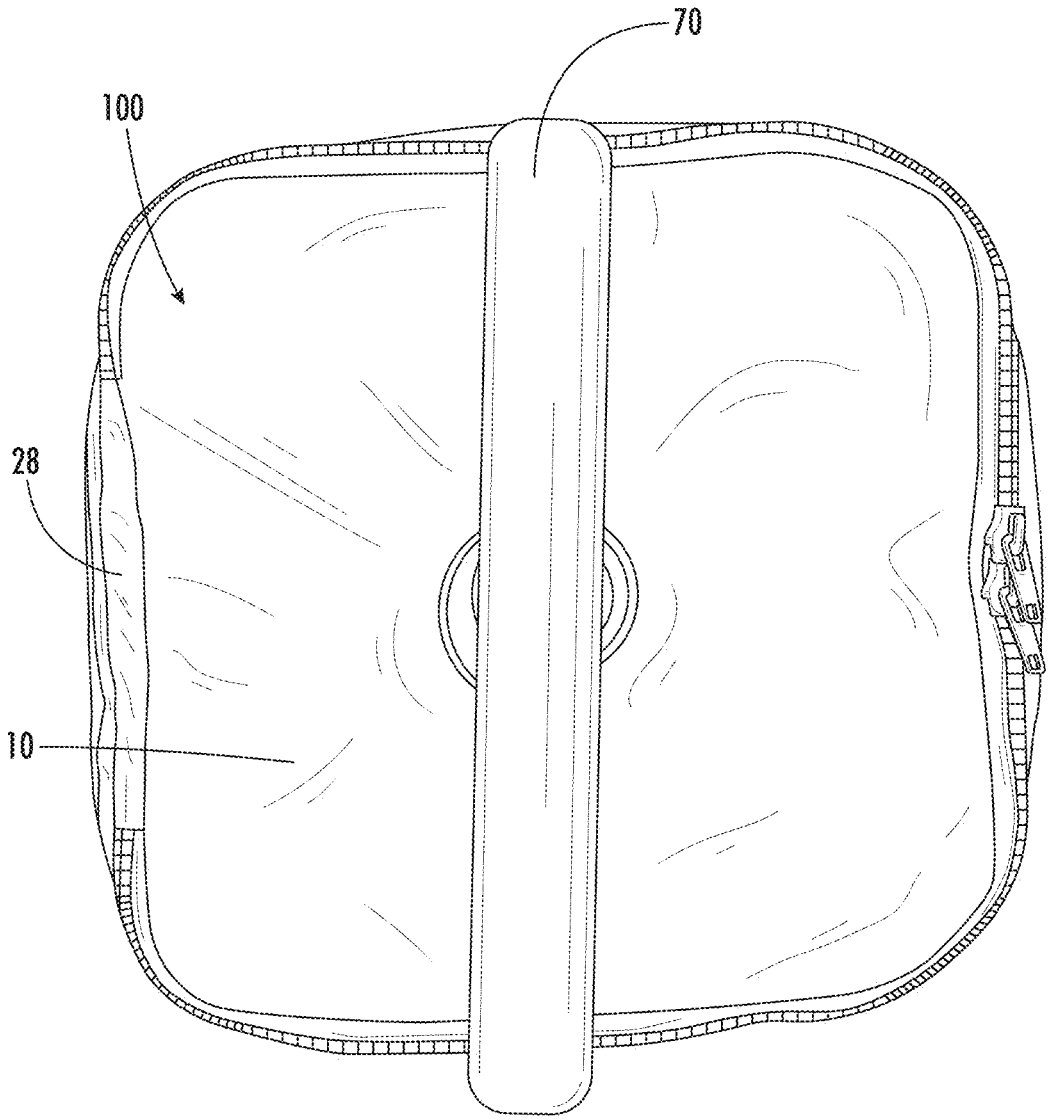
FIG. 6 is a top view of the weightlifting assembly of FIG. 1.
Figure 7:
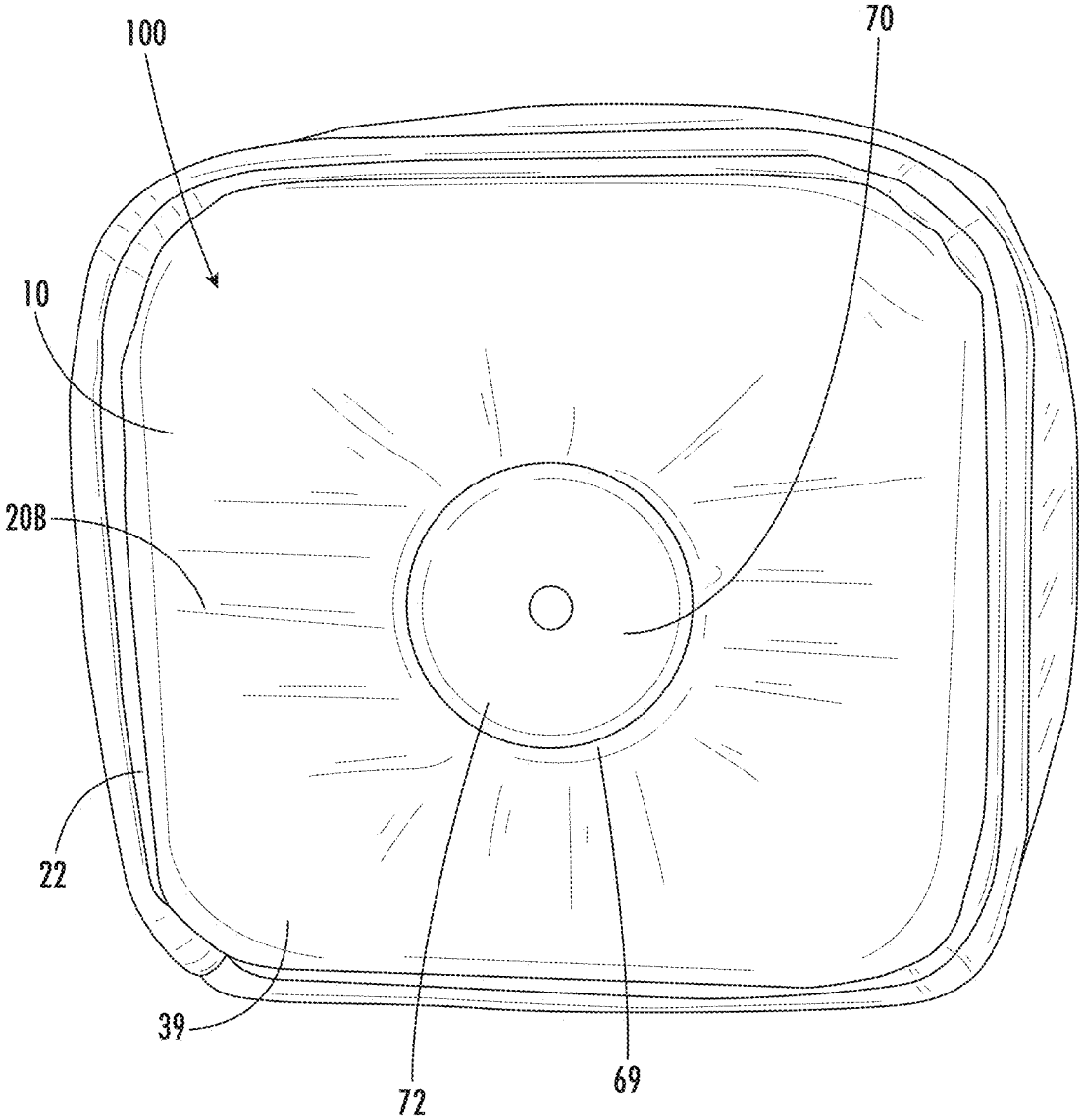
FIG. 7 is a bottom view of the weightlifting assembly of FIG. 1.
Figure 8:
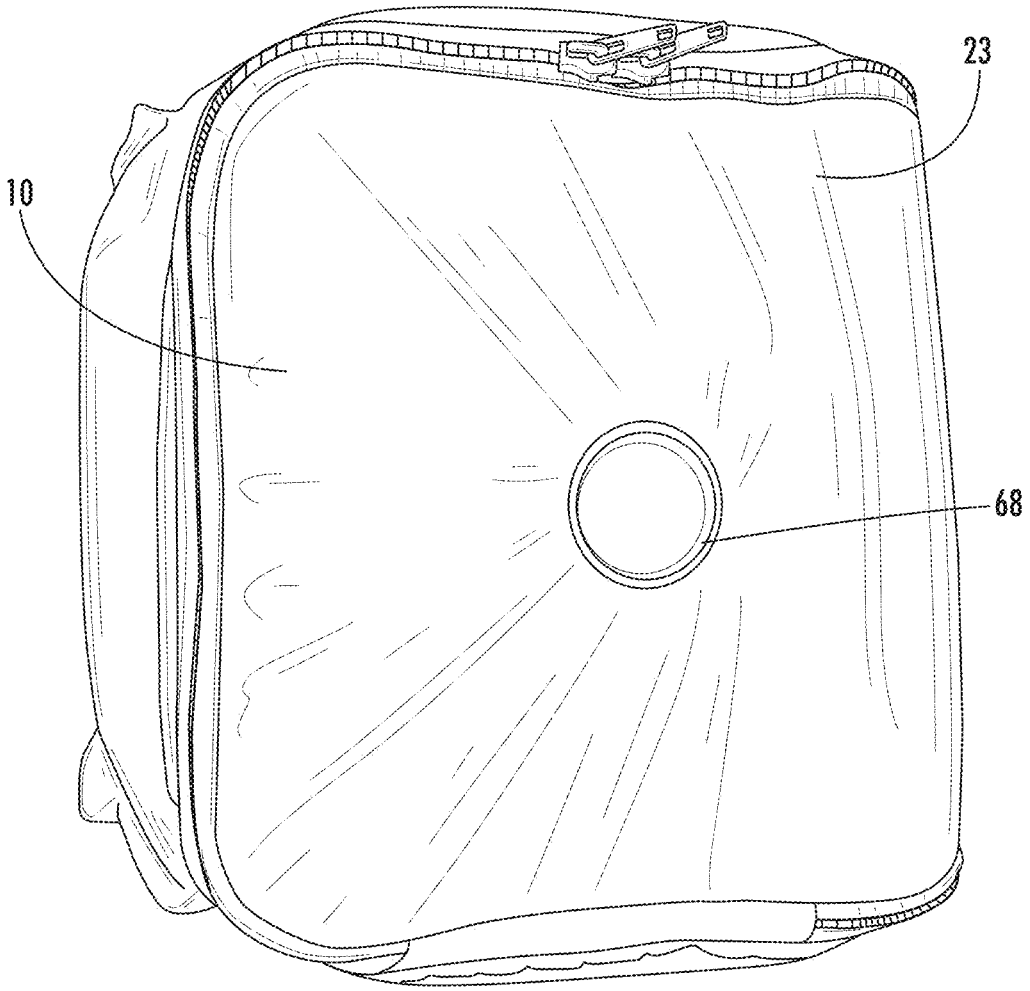
FIG. 8 is a top view of a weighted bag of the weightlifting assembly of FIG. 1.
Figure 9:
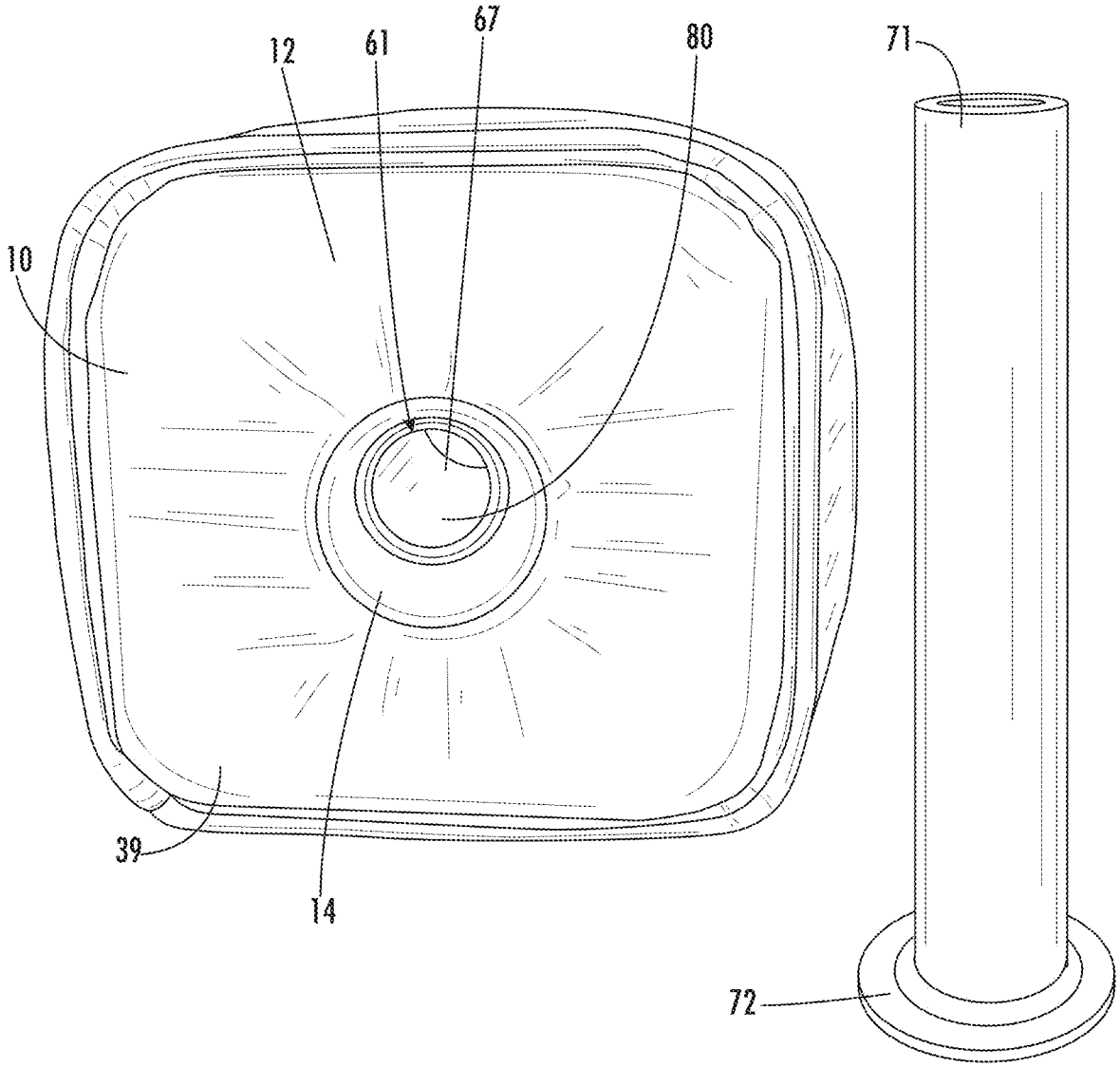
FIG. 9 is a bottom view of the weighted bag and a portion of a handle assembly of the weightlifting assembly of FIG. 1.
Figure 10:
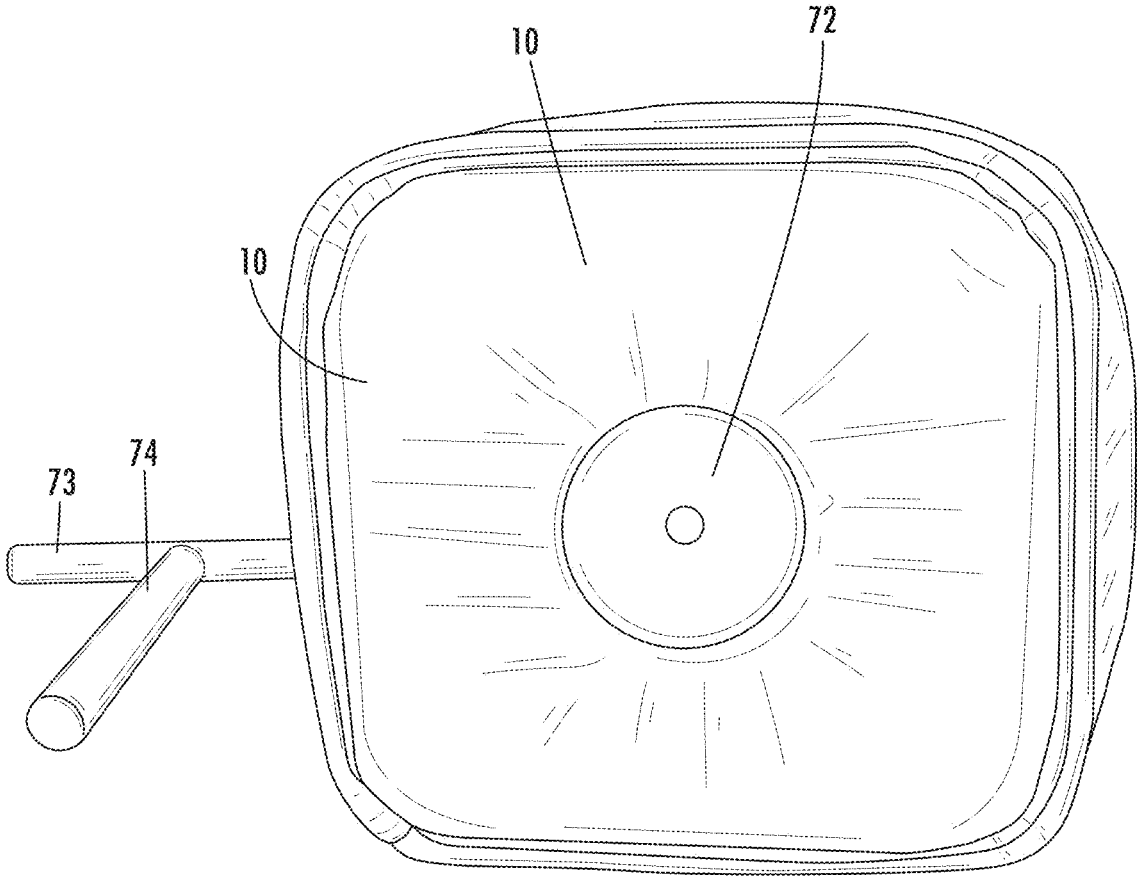
FIG. 10 is a bottom view of the weightlifting assembly of FIG. 1, with the handle assembly partially disassembled.
Figure 11:
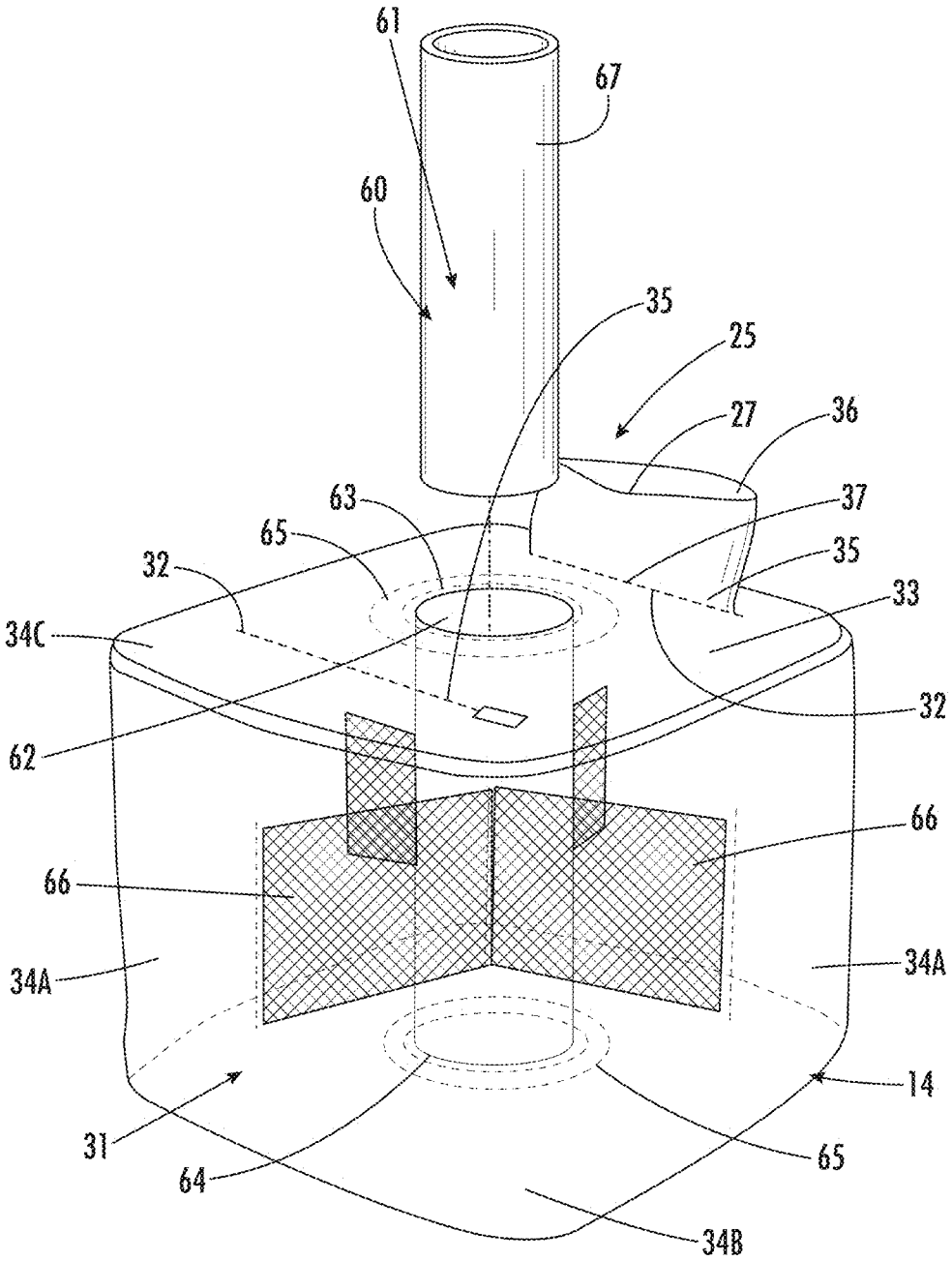
FIG. 11 is a perspective view of an inner bag and a connection structure of the weightlifting assembly of FIG. 1, with portions shown transparently to illustrate internal detail.
Figure 12:
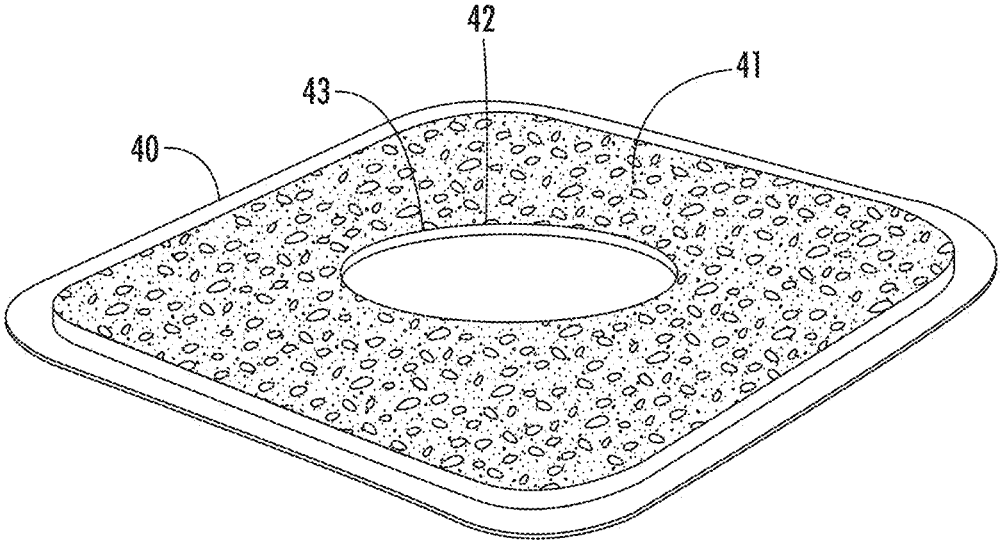
FIG. 12 is a perspective view of a liner of the weightlifting assembly of FIG. 1.
Figure 13:
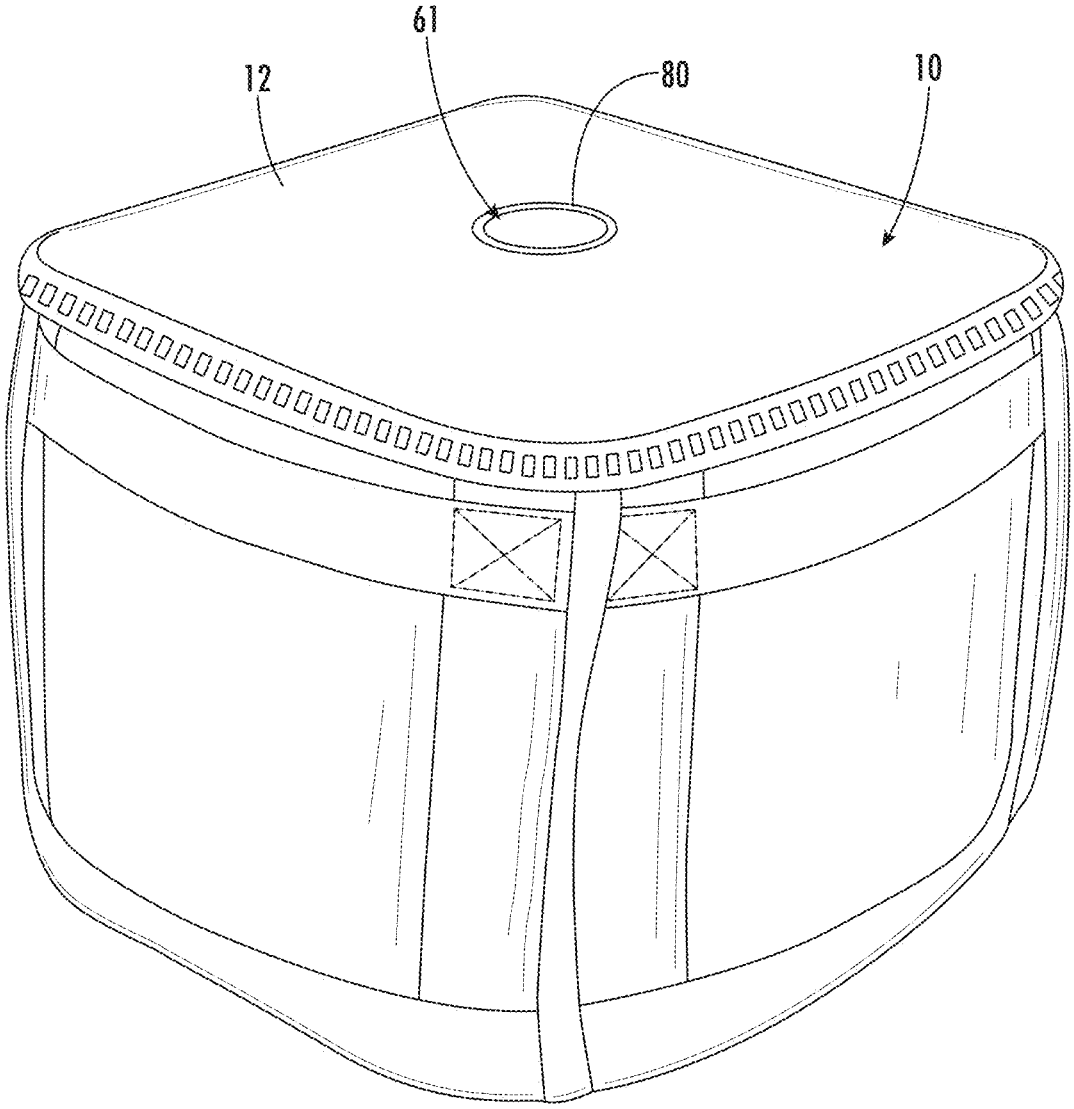
FIG. 13 is a perspective view of the weighted bag of the weightlifting assembly of FIG. 1.
Figure 14:
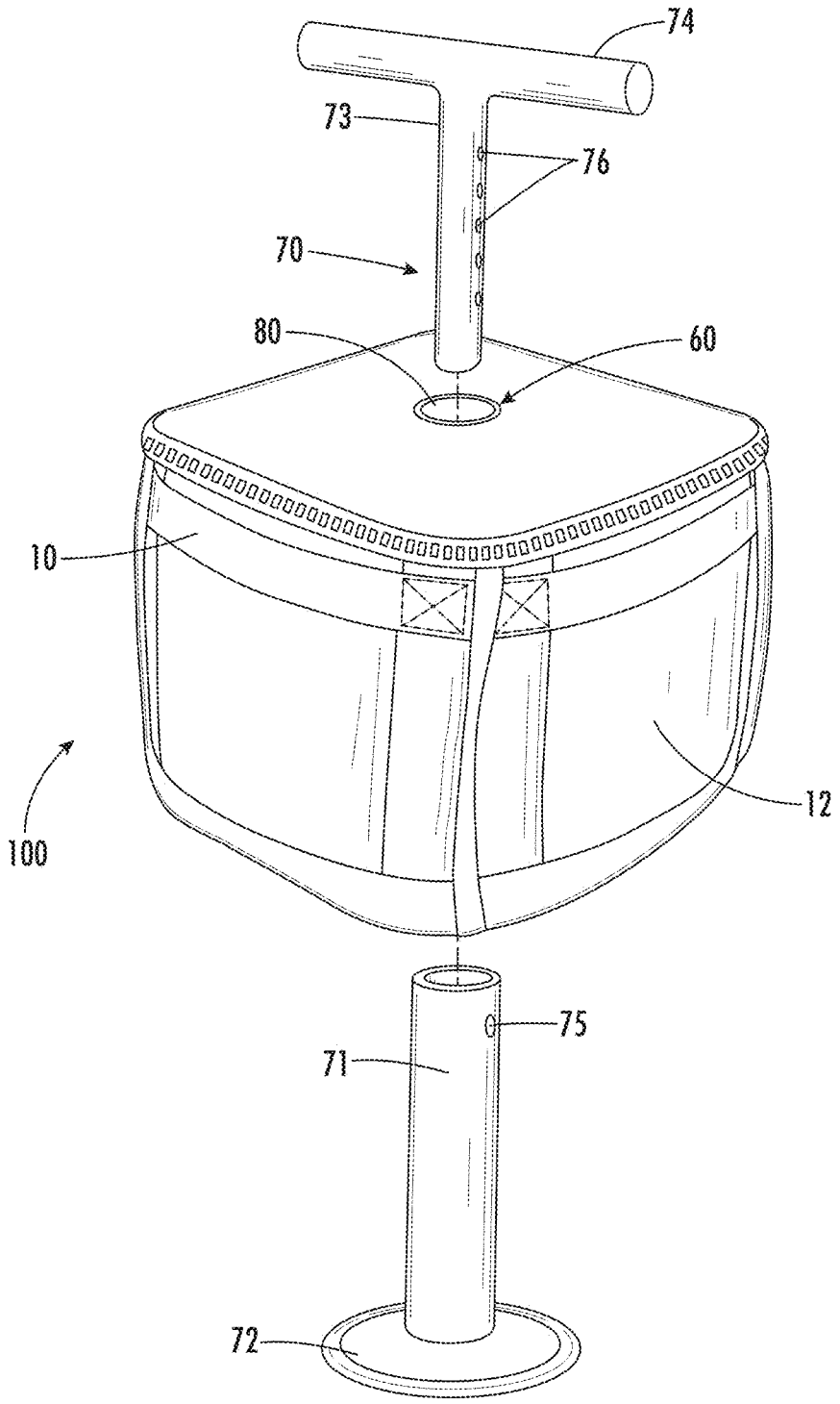
FIG. 14 is a perspective view illustrating connection of the handle assembly to the weighted bag of the weightlifting assembly of FIG. 1.
Figure 15:
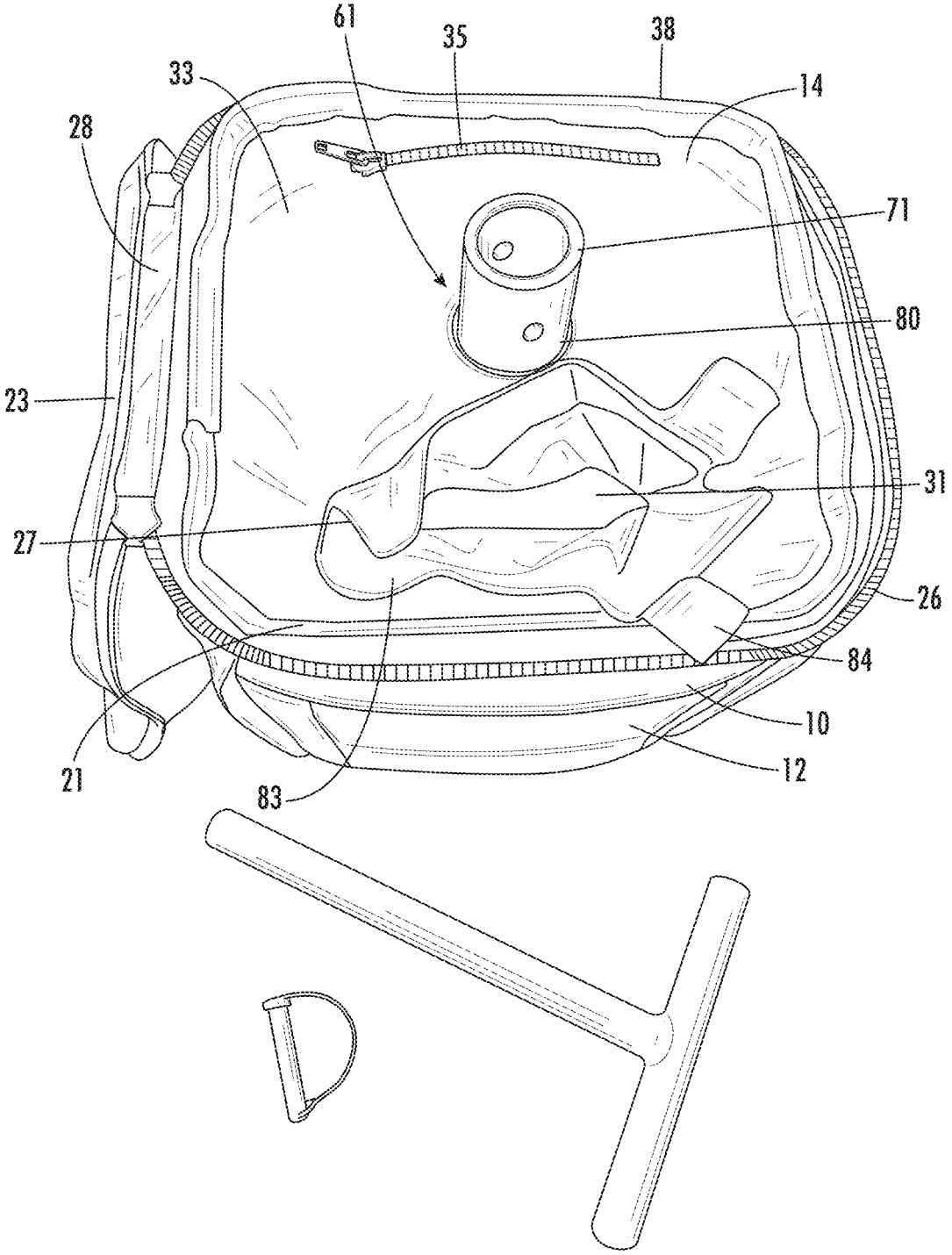
FIG. 15 is a partially disassembled perspective view of the weightlifting assembly of FIG. 1, with a lid of the weighted bag shown in the open position.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Referring now to the drawings and in particular to FIGS. 1-15, a weightlifting assembly 100 is shown, which includes a weighted bag 10 connected to an implement in the form of a handle assembly 70 for weightlifting. The weighted bag 10 includes an outer shell 12 and an inner bag 14 disposed within the outer shell 12, with a connection structure 60 for removable connection to the handle assembly 70. The connection structure 60 includes a tube structure 61 extending through the outer shell 12 and the inner bag 14 and configured for receiving a portion of the handle assembly 70 or another implement therethrough. The weighted bag 10 as shown in FIGS. 1-15 is configured for weightlifting and similar exercises, and can be lifted, carried, thrown, dropped, and otherwise used in such exercises, either by gripping the outer shell 12 or by gripping the handle assembly 70.

The outer shell 12, shown in FIGS. 1-10 and 13-15, includes one or more panels 20 that are connected by one or more seams 22, an opening 24, and a cover 23 configured for releasable closure by a shell closure member 26. The panels 20 may be flexible and/or made from a fabric material in one embodiment. The inner surfaces of the panels 20 define an inner cavity 21 configured to hold a filler material (not shown). The cover 23 is connected to one of the panels 20 at an edge connection 28 along one edge, permitting the cover 23 to be opened and closed by pivoting about the edge connection 28. These components may be connected using various techniques, such as stitching in one embodiment. Other connection techniques, such as adhesives, may additionally or alternately be used. The outer shell 12 has a top 38 and a bottom 39, such that the opening 24 is positioned on the top 38, and the bag 10 is configured to rest on the bottom 39. It is understood that the top 38 and the bottom 39 are relative terms that depend on the orientation of the bag 10.

It is to be understood the inner and outer surfaces of the panels 20 may be defined by one or more surfacing layers that may be of substantially equal or variable materials. The panels 20 may have a two or greater ply configuration coupled together. In the configuration shown, the panels are shown as singular pieces with the understanding that they may represent multiple plies of material. In one embodiment, the panels 20 are formed from a two-ply construction, with the outer and inner plies comprising different grades of ballistic nylon fabric (e.g., the outside being of 1000 denier and the inside being of 500 denier). Of course, other configurations are contemplated, including other fabrics.

With reference to the example embodiment of the outer shell 12 in FIGS. 1-15, the panels 20 include four side panels 20A and a bottom panel 20B, with an additional cover panel 20C forming the cover 23. In the embodiment of FIGS. 1-15, the side panels 20A are arranged in opposed pairs, where each pair is substantially parallel with each other, and all four side panels 20A are connected around the edges of the bottom panel 20B. The outer shell 12 in the embodiment of FIGS. 1-15 is entirely or substantially defined by the side panels 20A, the bottom panel 20B, and the cover panel 20C, where the side panels 20A and the bottom panel 20B form a main body 18 with the cover 23 connected to the main body 18. In this embodiment, the shell 12 defines a cubic configuration. In other embodiments, the shell 12 may have a different shape, such as a rectangular polyhedron, a circular cylinder, an oval cylinder, a rectangular cylinder, a triangular cylinder, or various other symmetrical or non-symmetrical shapes. It is understood that the outer shell 12 may be formed of a greater of smaller number of panels in such other embodiments. The outer shell 12 also includes reinforcing strips 19 extending peripherally and vertically near the edges of each of the side panels 20A, which are stitched to the side panels 20A.

In the embodiment of FIGS. 1-15, the bag 10 has an opening 24 and a filling mechanism 25 that is accessible through the opening 24 for filling the bag 10. The opening may be oriented, shaped, and/or located differently in other embodiments. The opening 24 includes a closure member 26 (also called a shell closure member) configured for releasably closing the opening 24. When engaged, the shell closure member 26 resists the movement of filler material 16 into or out of the opening 24. The shell closure member 26 extends around the majority of the opening 24 and the majority of the cover 23, from one end of the edge connection 28 to the other, and coupled in such a way to edges of opening 24 that closure of the shell closure member 26 substantially closes the opening 24 and secures the cover 23 to the main body 18 around the opening 24. The shell closure member 26 in the embodiment of FIGS. 1-15 includes a zipper. In other embodiments, the shell closure member 26 may have other configurations, such as a hook and loop fastener, snaps, buttons, flaps, straps, and other fastening and/or closing structures or combinations of such structures may be utilized. It is understood that the configuration of the shell closure member 26 may depend at least partially on the configuration of the opening 24. For example, a shell closure member 26 in the form of a zipper may not be usable or optimal with some opening 24 configurations, and another type of closure member 26 may be used.

The inner cavity 21 of the outer shell 12 has filler material within it when the device is prepared for use. Filler material is designed to be a heavy but loose and flowable material including, but not limited to, sand, polymer beads, or other such particulate materials. In the embodiment of FIGS. 1-15, the bag 10 has an inner bag 14 positioned within the cavity 21 of the outer shell 12 and connected at least around the opening 24 to contain the filler material 16. In another embodiment, the outer shell 12 may contain the filler material without the use of an inner bag. The inner bag 14 has a top end 33 that is connected to the shell 12 around the opening 24 such that the top end 33 is exposed within the opening 24 when the cover 23 is open. The inner bag 14 is also formed of a plurality of panels 34, which may include one or more side panels 34A, a bottom panel 34B, and a top panel 34C forming the top end 33, where the side panel(s) 34A are connected to the bottom panel 34B and the top panel 34C around the peripheries thereof, such as by stitching. The panels 34 may be flexible and/or made of a fabric material in one embodiment. The panels 34 of the inner bag 14 define a filling cavity 31 configured to hold the filler material. The panels 34 of the inner bag 14 may be formed of materials similar to the outer shell 12, and the shape of the inner bag 14 may be generally the same as the shape of the outer shell 12. Alternately the inner bag 14 and the outer shell 12 may be designed differently in materials, connections (e.g., seams), and structure. For example, the materials, connections, and structure of the outer shell 12 may be configured for strength, durability, abrasion resistance, and comfort in handling, while the materials, connections, and structure of the inner bag 14 may be configured primarily for strength and resisting leakage.

The inner bag 14 is placed inside the cavity 21 of the outer shell 12 in the embodiment of FIGS. 1-15 and secured to the outer shell 12 at least around the inside of the opening 24, e.g., by stitching. In one embodiment, a durable plastic layer 40 and a foam layer 41 are placed inside the cavity 21 confronting or in contact with the inner surface of the bottom panel 20B, prior to inserting the inner bag 14 into the cavity 21. The plastic layer 40 and/or the foam layer 41 may be fixed to one or both of the outer shell 12 and the inner bag 14. In this configuration, the plastic layer 40 and the foam layer 41 are positioned between the bottom panel 34B of the inner bag 14 and the bottom panel 20B of the outer shell 12. These layers 40, 41 protect and cushion the inner bag 14 from impacts during exercise, and may also assist in retaining shape definition of the bag 10.

In the embodiment of FIGS. 1-15, the filling mechanism 25 includes a funnel structure 27 having a proximal end 37 fixed to the inner bag 14 around an opening 35 in the top end 33 of the inner bag 14. The funnel 27 may be connected to the top panel 34C of the inner bag 14 by stitching, adhesive, or heat sealing, among other techniques, or a combination of such techniques. The funnel structure 27 also has a distal end 36 that can be extended out of the inner bag 14 through the opening 35 or retracted into the inner bag 14. The funnel structure 27 may also include a closure structure 83 for closing the open end of the funnel 27 and/or a securing structure for securing the funnel 27 in a collapsed position, e.g., a hook-and-loop structure, snaps, clasps, straps, or any other closure or securing structure disclosed herein, or combinations thereof. The inner bag 14 has two filling mechanisms 25 in the embodiment of FIGS. 1-15, with two separate openings 35 on the top end 33 for accessing the filling mechanisms 25. Each of the openings 35 is closed by a closure member 32, which may be or include a zipper and/or any other closure member disclosed herein. Each funnel 27 may also have one or more grasping handles 84 at or near the distal end 36 to assist in pulling the funnel 27 through the opening 24 and/or opening the funnel closure as described herein.

The bag 10 can be filled by opening the shell closure member 26 and the cover 23 to open the opening 24 and the bag closure member 32 and extending the filling mechanism 25 through the opening 35. The funnel 27 in FIGS. 1-15 can be fully extended by pulling the funnel 27 through the opening 35, disconnecting any securing structure for the funnel 27, and then fully extending the funnel 27. When fully extended, the funnel 27 can be opened, which may include releasing any closure that the funnel 27 may include. Once open, the filler material can be filled into the cavity 21, including the filling cavity 31 of the inner bag 14. The funnel 27 may be collapsed by rolling or folding the top of the funnel 27, which may cause the securing members (if any) to engage with each other and secure the funnel 27 in a collapsed position. The funnel 27 can then be returned into the opening 35 and secured by closing the bag closure member 32, and the shell closure member 26 can be used to close the cover 23. It is understood that if an inner bag 14 is not used, the opening 24 of the outer shell 12 may be configured similarly to the openings 35 of the inner bag 14 disclosed herein, with a funnel 27 connected at the opening 24.

The bag 10 in FIGS. 1-15 includes a connection structure 60 for connection to an implement for use in a weightlifting exercise. The implement shown in FIGS. 1-15 is a handle assembly 70, which may be of a type configured for loading with weight plates for a weightlifting exercise. The handle assembly 70 includes a sleeve 71 having an enlarged base 72 and a pin 73 received in the sleeve 71 and having a handle 74 at an end thereof. The sleeve 71 and the pin 73 are releasably securable to each other in a plurality of different positions to change a length of the handle assembly 70 (i.e., defined between the handle 74 and the base 72. The sleeve 71 has a pair of openings 75, and the pin 73 has a plurality of different passages 76 along the length thereof. The pin 73 can be secured to the sleeve 71 by a fastener 77 (e.g., a pin) inserted through one of the passages 76 and the openings 75, and the length of the handle assembly 70 is defined by which passage 76 the pin is received in. It is understood that the sleeve 71 may additionally or alternately include a plurality of pairs of openings 75 for length adjustment. The base 72 includes a plate that is enlarged with respect to the diameter of the sleeve 71 and may have a rounded bottom.

The connection assembly 60 includes a tube structure 61 extending through the outer shell 12 and the inner bag 14 to receive a portion of the handle assembly 70 or other implement therethrough. The tube structure 61 includes an outer tube 62 extending through the inner bag 14, secured to the top panel 34C of the inner bag 14 at a top opening 63 and to the bottom panel 34B of the inner bag 14 at a bottom opening 64 and extending through the filling cavity 31. The outer tube 62 may be made from fabric, such as the same material as the inner bag 14, and may be connected via stitching or other connection technique. Reinforcing rings 65 are secured to the top and bottom panels 34C, 34B around the top and bottom openings 63, 64, e.g., by stitching or other connection technique. The reinforcing rings 65 may be made from plastic or other rigid material. The connection assembly 60 also includes a plurality of stabilizing members in the form of baffles 66 secured to the inner surfaces of the side panels 34A of the inner bag 14 and to the outer tube 62, e.g., by stitching or other connection technique. In this configuration, the baffles 66 help retain the shape of the outer tube 62 and the sidewalls of the inner bag 14, regardless of the fill level of the inner bag 14. The baffles 66 may be made from a mesh material in one embodiment to permit passage of the filler material therethrough.

The connection assembly 60 also includes an inner tube 67 at least partially received within the outer tube 62 and extending through both the inner bag 14 and the outer shell 12. The outer shell 12 has openings 68, 69 in the bottom 39 and in the cover 23, and in one embodiment, a portion of the inner tube 67 may extend through one or both of the openings 68, 69 in the outer shell 12. The plastic layer 40 and the foam layer 41 both have openings 42, 43 therethrough, and a portion of the inner tube 67 may extend through one or both of these openings 42, 43 as well. The inner tube 67 and the outer tube 62 define a passage 80 through the bag 10 configured to receive a portion of the handle assembly 70 or other implement therethrough. The inner tube 67 may be more structurally rigid than the outer tube 62 to assist in holding the shape of the passage 80, such as by being made from polyvinyl chloride (PVC) or other rigid polymer material, including fiber reinforced polymers or other composites. The material of the inner tube 67 may also be configured to reduce friction.

The handle assembly 70 may be connected to the bag 10 by inserting the sleeve 71 through the passage 80, then inserting the pin 73 into the sleeve 71 and securing the pin 73 to the sleeve 71 using the fastener 77, thereby forming the weightlifting assembly 100. A portion of the top of the sleeve 71 may protrude from the top opening 63 of the inner bag 14 and potentially through the top opening 68 of the outer shell 12 in one embodiment, to assist with assembly of the handle assembly 70. The base 72 of the sleeve 71 is larger than the passage 80, such that when the handle 74 is used to lift the weightlifting assembly 100, the base 72 prevents the handle assembly 70 from being pulled through the passage 80. In other embodiments, a different type of implement may be connected to the bag 10 as shown in FIGS. 1-15, and it is understood that such additional implement may also include an enlarged portion that cannot pass through the passage 80 and a smaller portion that is able to pass through the passage 80. For example, the embodiments of FIGS. 20 and 21 (described in greater detail herein) utilize an implement in the form of a rope 81 that passes through the passage 80, and the rope 81 may include a knot 82 that is larger than the passage 80 and cannot pass therethrough. In another embodiment, the implement may be in the form of a barbell or dumbbell having a portion (e.g., a barbell sleeve) that extends through the passage 80, with an enlarged portion in the form of a collar and/or a removable barbell collar to resist movement of the bag 10 with respect to the implement. As a further embodiment, the implement may be a pin or other structure connected to a moveable weight rack part, such as an articulating arm, landmine, etc. Still further configurations and implements are possible, and it is understood that the configuration of the bag 10 and the connecting structure 60 may be modified for use with the desired implement(s).

FIGS. 16-20 illustrate another embodiment of a bag 10 that is usable in connection with a weightlifting assembly 100 as disclosed herein. The bag 10 and the weightlifting assembly 100 in FIGS. 16-20 includes many of the components and features disclosed herein with respect to the embodiment of FIGS. 1-15, and such shared components and features are referred to using similar reference numbers. Such shared components and features may not be described again in detail with respect to the bag 10 and the weightlifting assembly 100 in FIGS. 16-20, for the sake of brevity.

Figure 19:
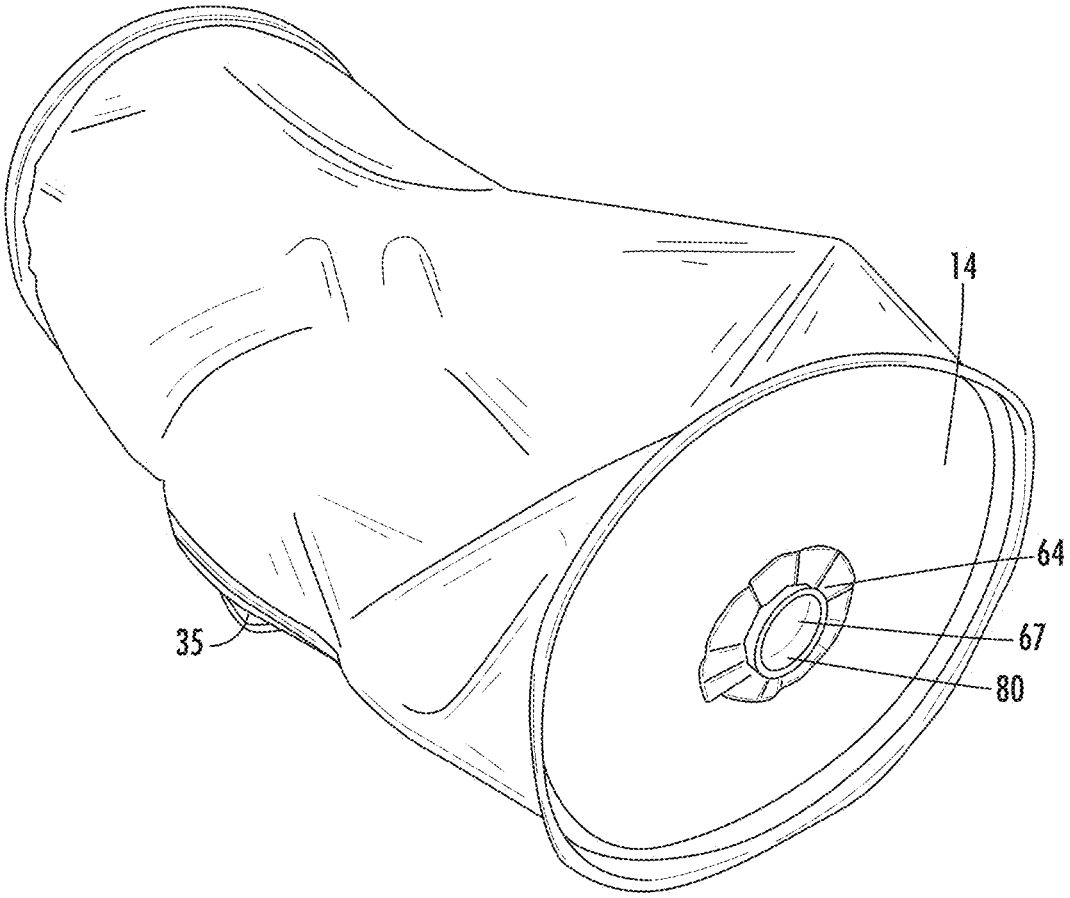
FIG. 19 is a perspective view of an embodiment of an inner bag usable with the weighted bag of FIG. 16.

The bag 10 of FIGS. 16-20 is configured as a cylinder and includes an outer shell 12 formed of a plurality of panels 20 defining a cylindrical shape, including a circumferential body panel 20D and two end panels 20E. The bag 10 of FIGS. 16-20 may also include an inner bag 14 also formed of a plurality of panels 34 defining a similar shape. The outer shell 12 includes an opening 24 with a cover 23 at one of the ends, which is secured to the main body 18 by a closure mechanism 26 as disclosed herein (e.g., a zipper), to access the inner bag 14. The inner bag 14 in FIGS. 16-17 has a single opening 35 at one end that includes a filling mechanism 25 in the form of a funnel 27. An alternative embodiment of the inner bag 14 is shown in FIG. 19, which has the opening 35 extending lengthwise along the side of the inner bag 14. The inner bag 14 in FIG. 19 would need to be removed from the outer shell 12 of FIGS. 16-20 for access to the opening 35, and may instead be used with an outer shell 12 having an opening 24 in the side. A plastic layer and/or a foam layer (not shown) may also be positioned between the inner bag 14 and the outer shell 12 in this configuration. The connection assembly 60 includes an outer tube 62 extending through the cavity (not shown) of the inner bag 14 and an inner tube 67 extending through the outer tube 62 to define a passage 80 through the bag 10, as disclosed elsewhere herein. These structures may be connected to the inner bag 14 in a similar configuration to the embodiment of FIGS. 1-15, including the use of stabilizing baffles (not shown) as disclosed herein.

Figure 20:
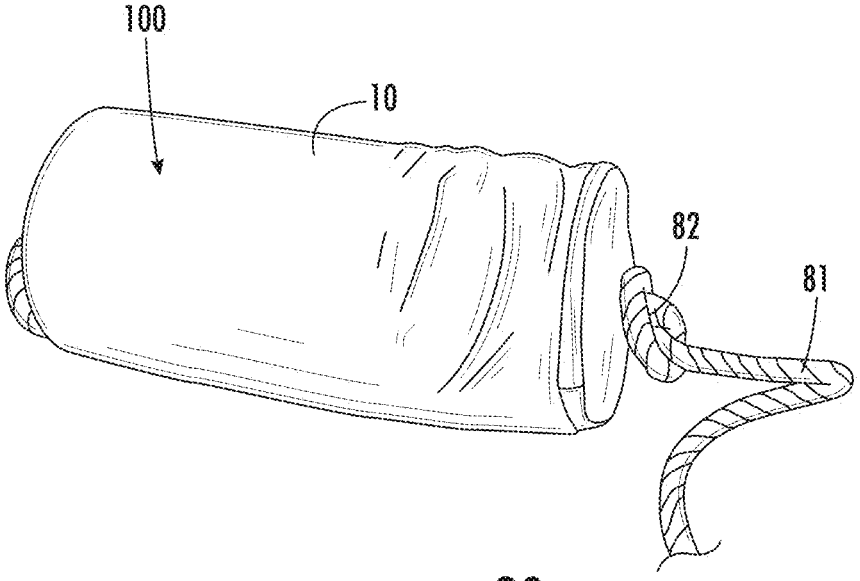
FIG. 20 is a perspective view of another embodiment of a weightlifting assembly including the weighted bag of FIG. 16, according to aspects of the disclosure.

FIG. 20 illustrates a weightlifting assembly 100 that includes the bag 10 of FIGS. 16-19 connected to an implement in the form of a rope 81 that extends through the passage 80. The rope 81 may include a knot 82 or other enlarged structure to form a stop with respect to passage of the rope 81 through the passage 80. It is understood that the bag 10 of FIGS. 16-20 may be used in connection with a handle assembly 70 configured similarly to the embodiment of FIGS. 1-15, or another implement.

Figure 21:
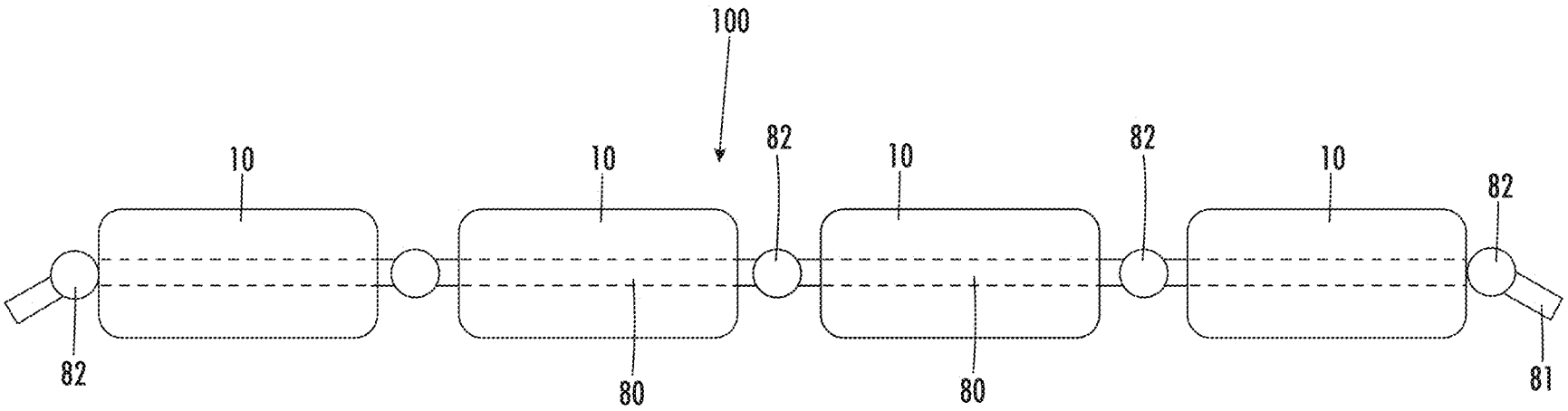
FIG. 21 is a schematic view of another embodiment of a weightlifting assembly including a plurality of weighted bags of FIG. 16, according to aspects of the disclosure.
Figure 22:
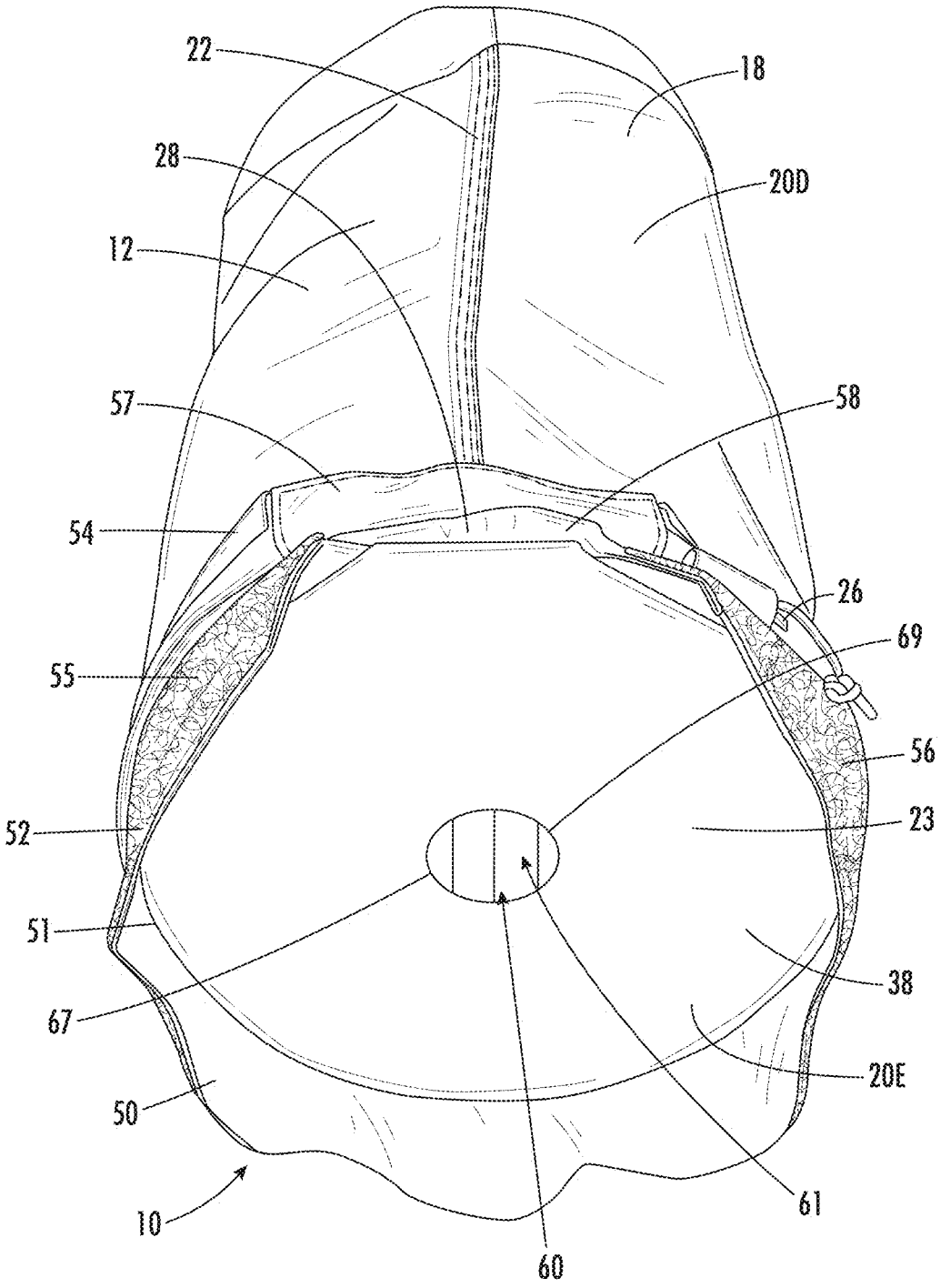
FIG. 22 is a perspective view of another embodiment of a weighted bag of a weightlifting assembly according to aspects of the disclosure, with a lid of the weighted bag shown in the closed position and a flap shown in the uncovered position.
Figure 23:
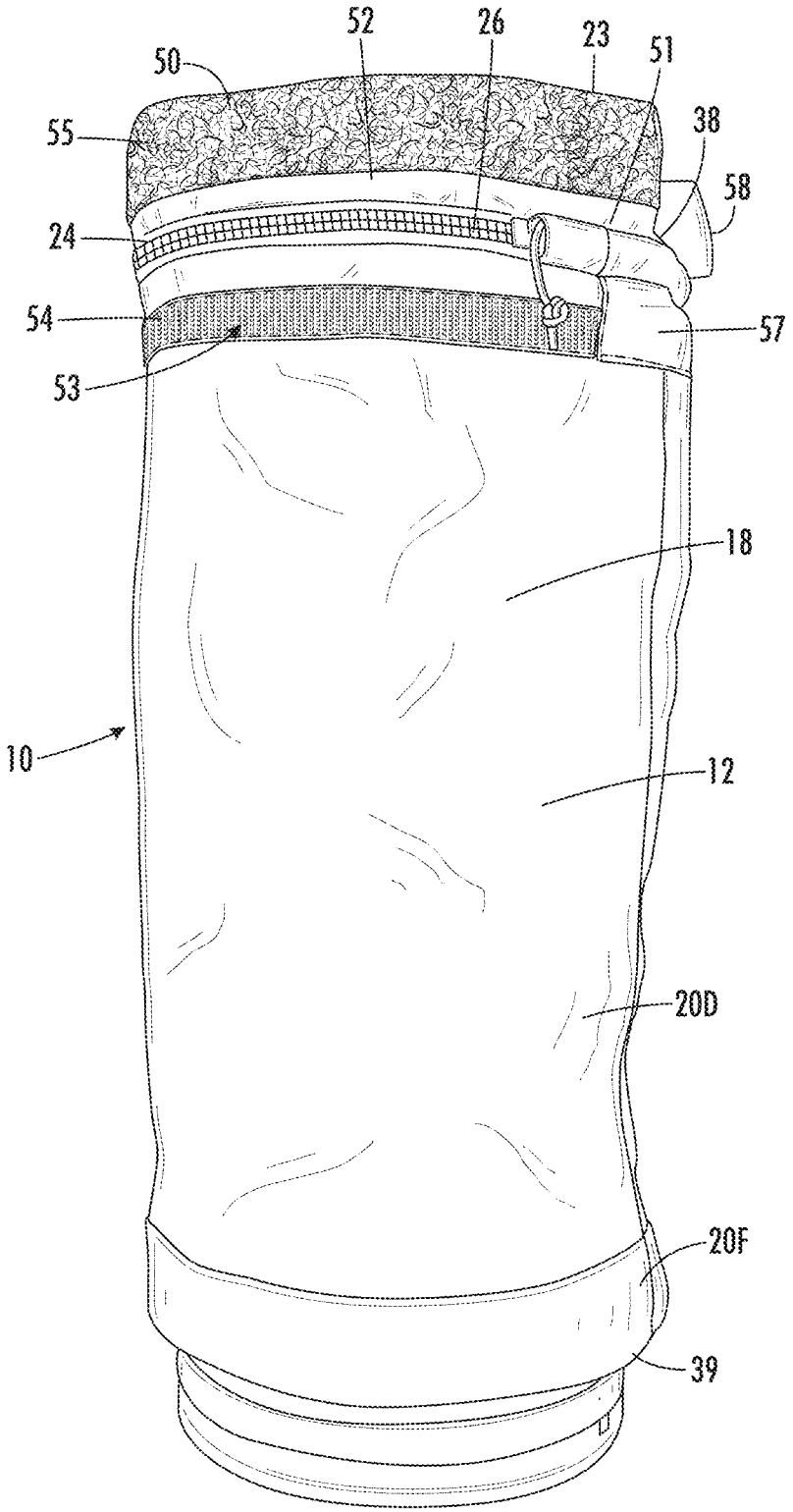
FIG. 23 is a side view of the weighted bag of FIG. 22.
Figure 24:
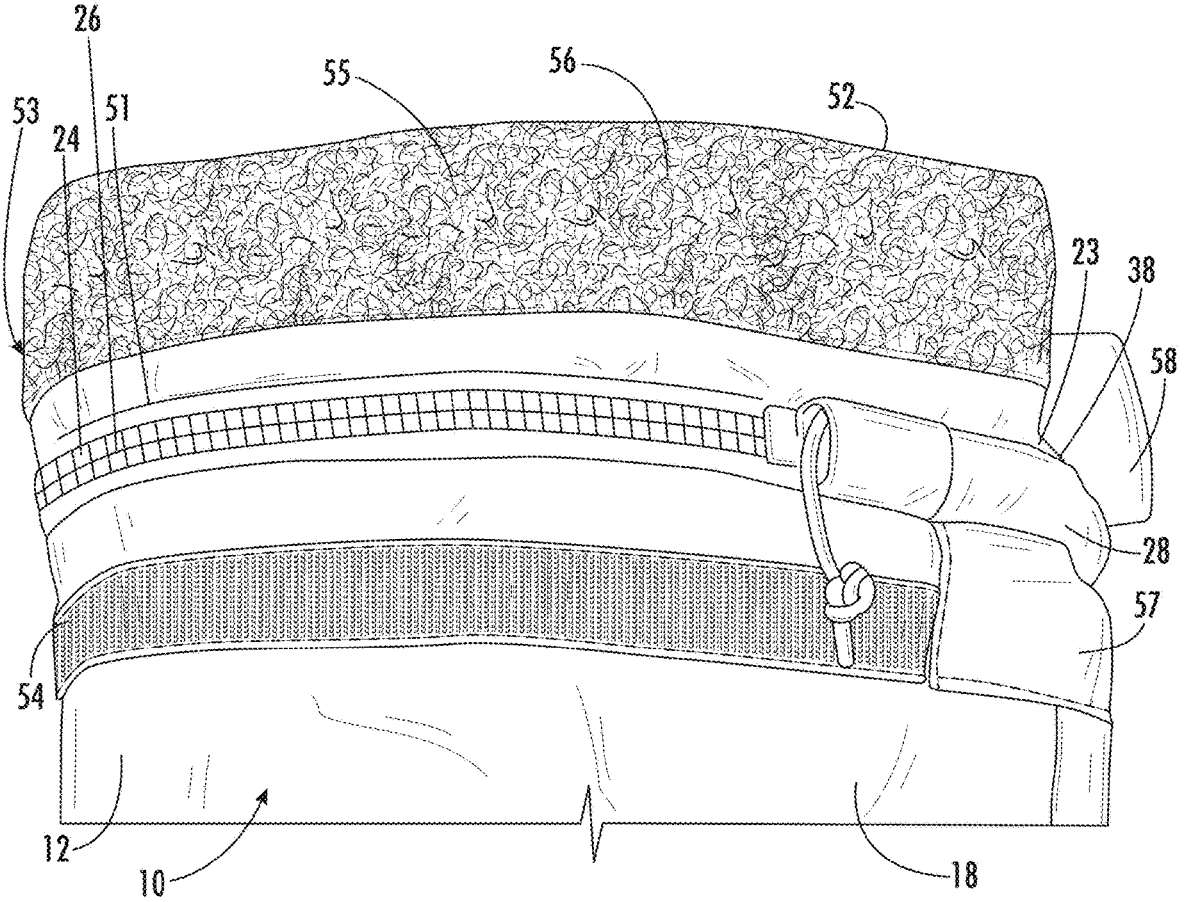
FIG. 24 is a magnified view of a portion of FIG. 23.
Figure 25:
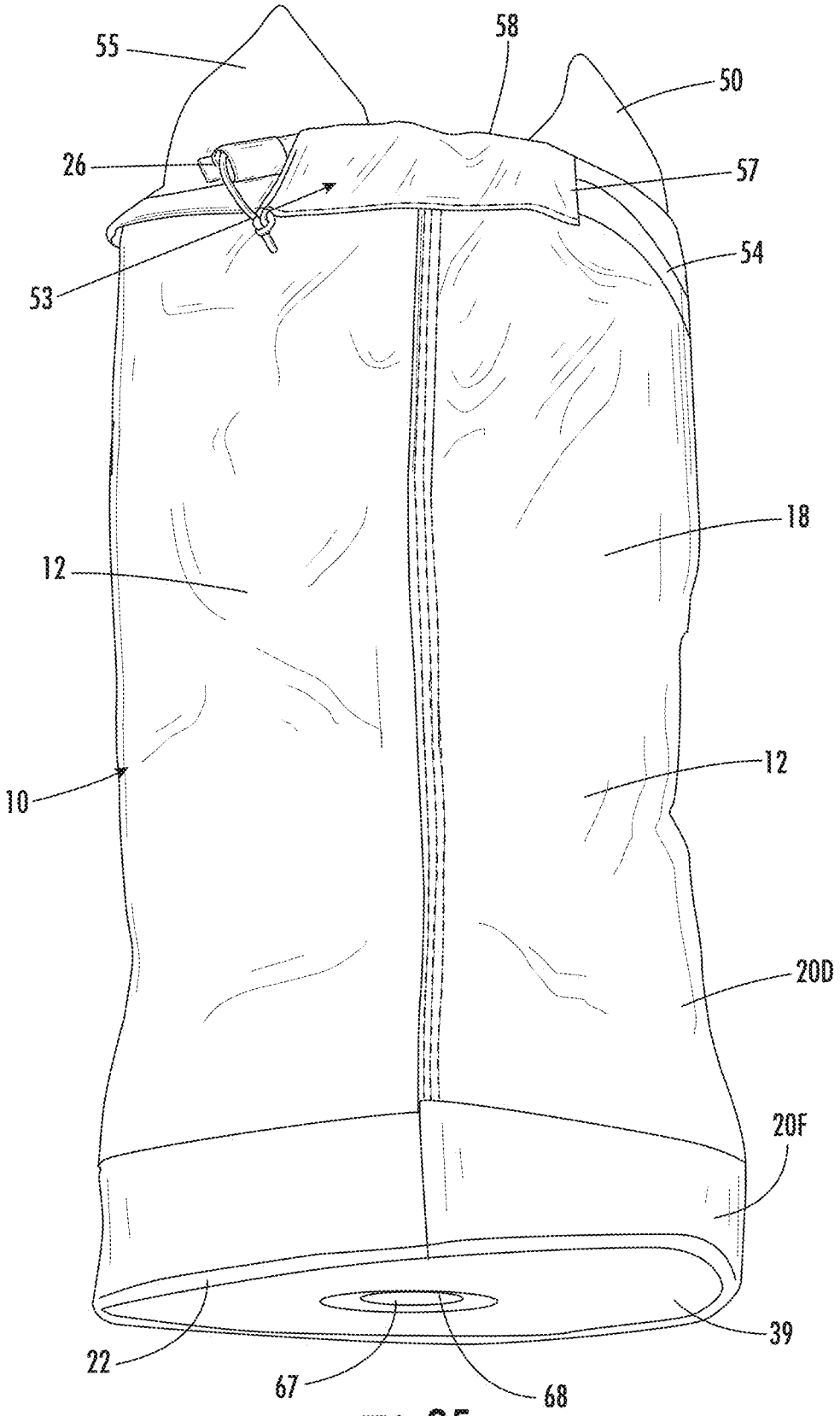
FIG. 25 is a bottom perspective view of the weighted bag of FIG. 22.
Figure 26:
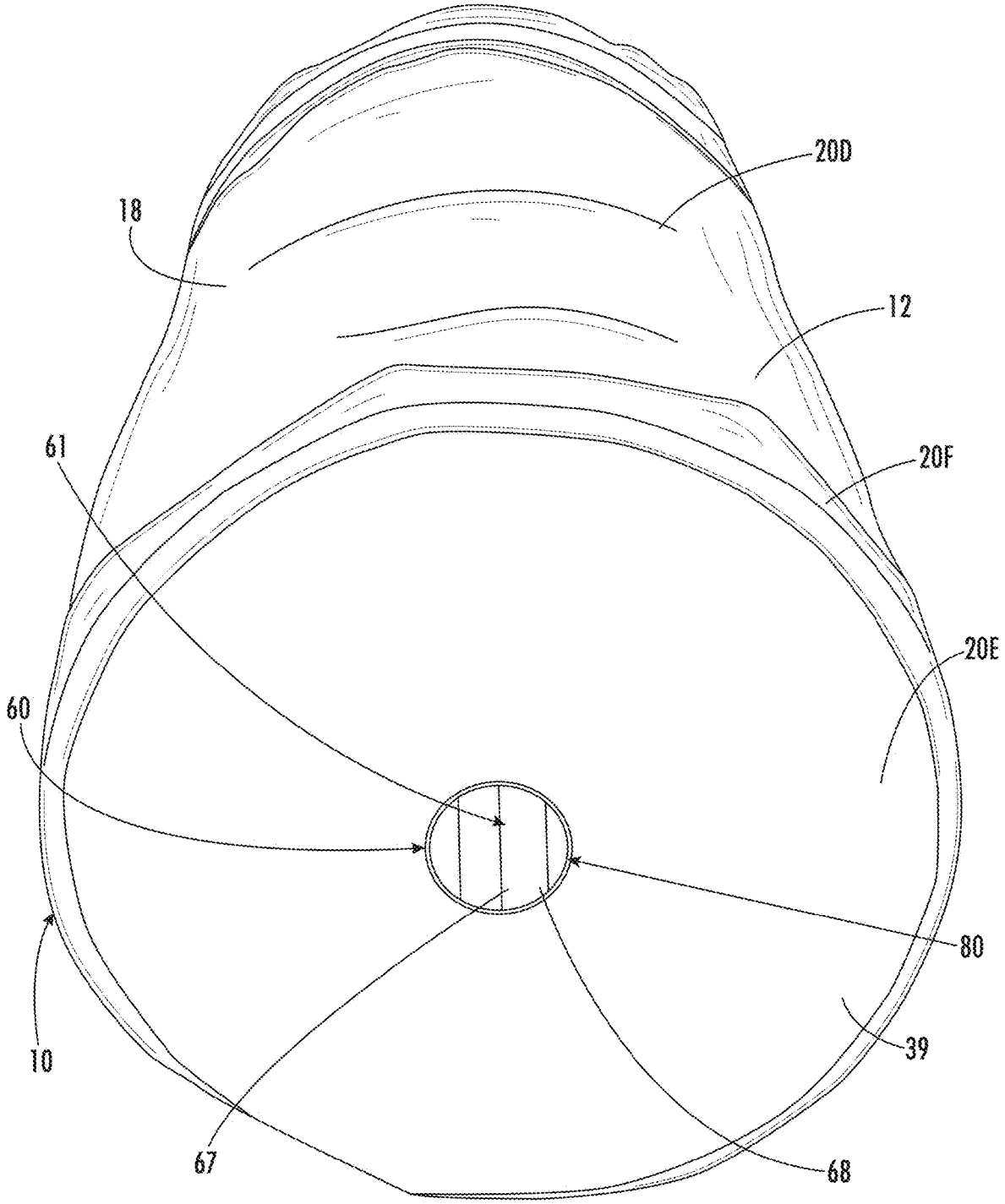
FIG. 26 is a bottom view of the weighted bag of FIG. 22.
Figure 27:
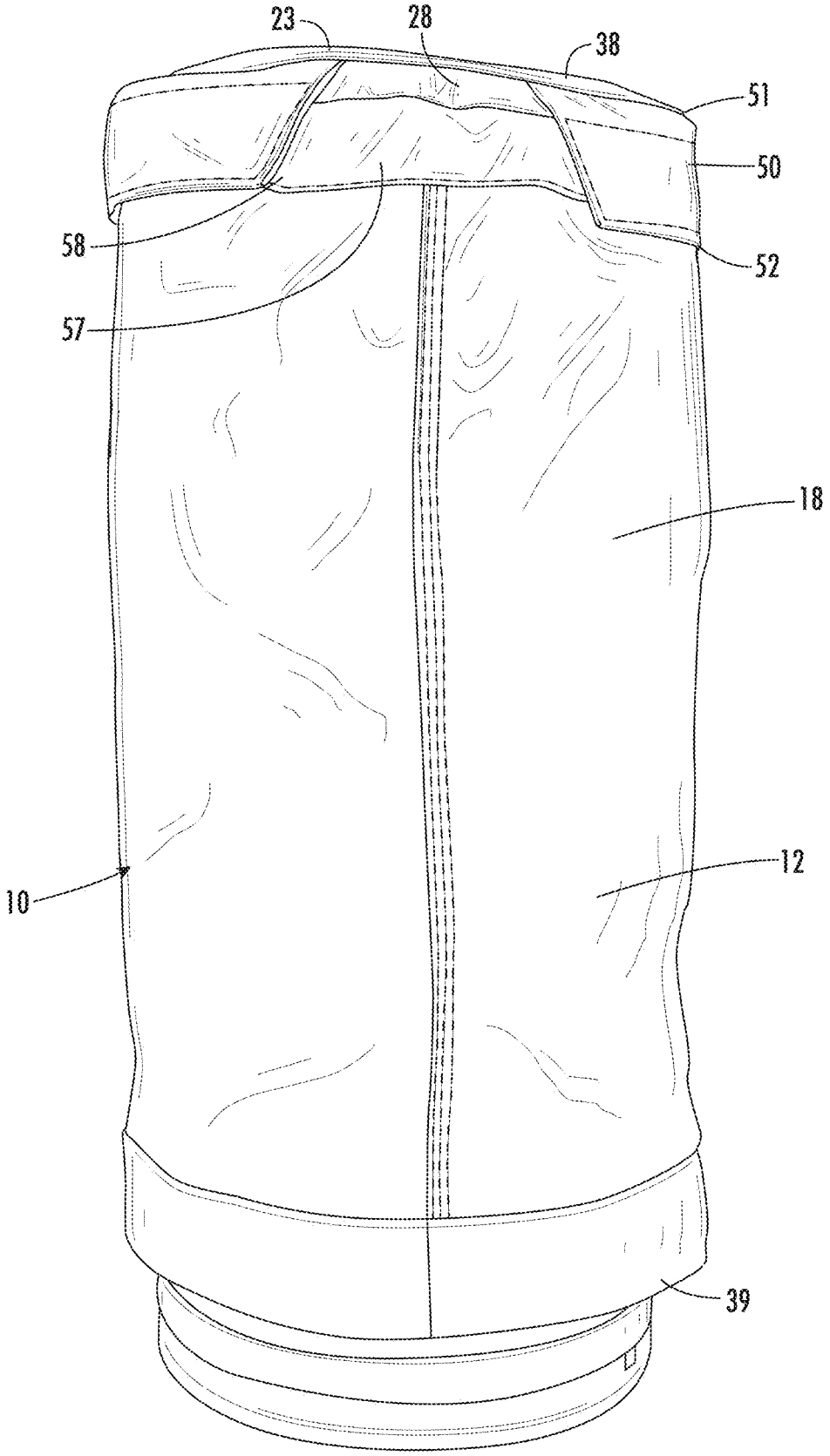
FIG. 27 is a side view of the weighted bag of FIG. 22, with the flap shown in the covered position.
Figure 28:
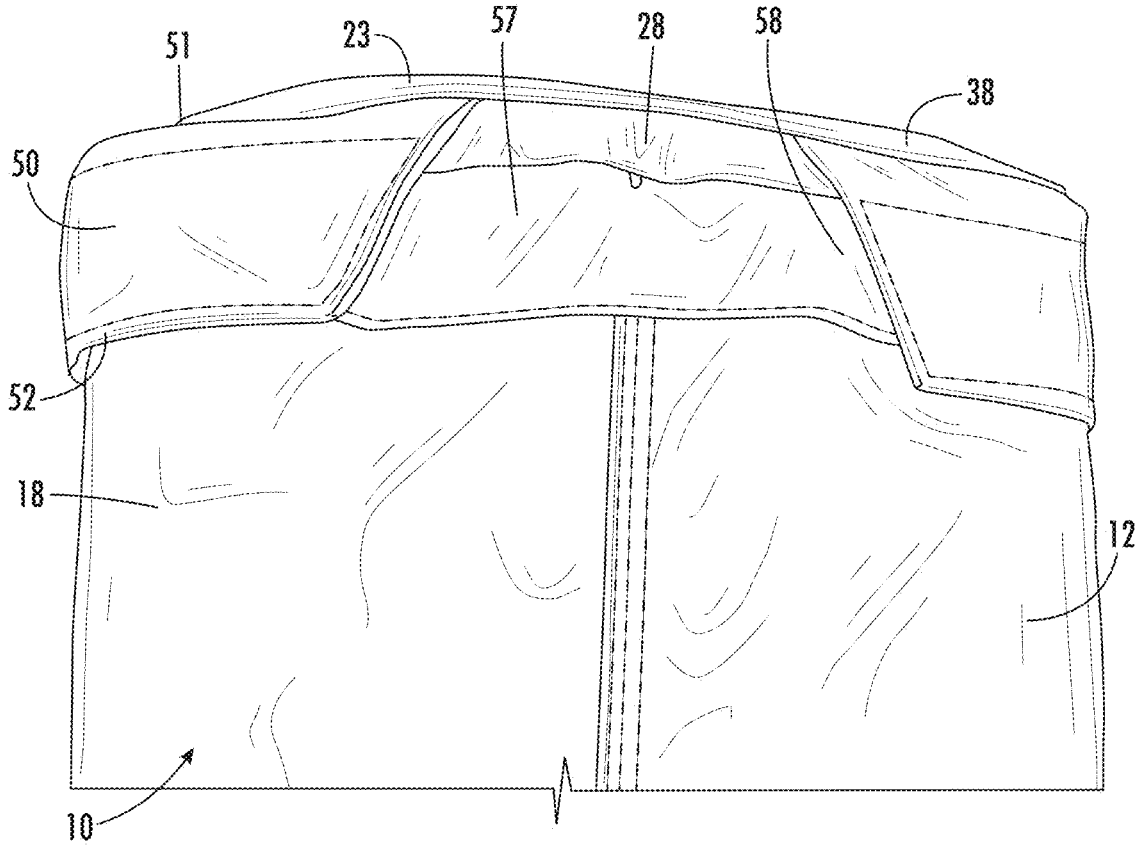
FIG. 28 is a magnified view of a portion of FIG. 27.
Figure 29:
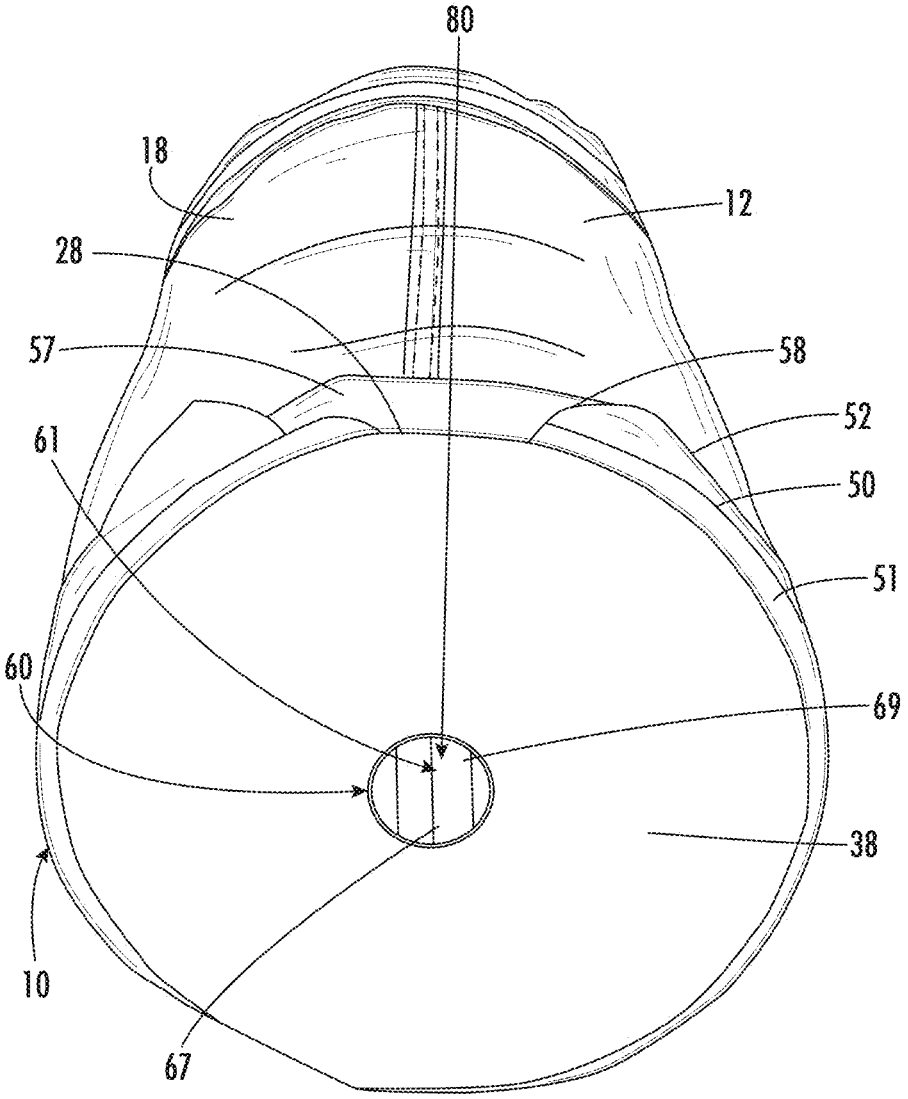
FIG. 29 is a top perspective view of the weighted bag of FIG. 27.

FIG. 21 illustrates a weightlifting assembly 100 that includes a plurality of bags 10 as shown in FIGS. 16-20 connected to a long rope 81, such that the rope 81 extends through the passages 80 of all the bags 10. In this embodiment, knots 82 are located at each end of the rope 81 and between the bags 10 to hold the bags 10 in place with respect to the rope 81. This assembly 100 may be configured for lifting by a plurality of people, such as a weightlifting team, where one person lifts each bag 10.

FIGS. 22-32 illustrate another embodiment of a bag 10 that is usable in connection with a weightlifting assembly 100 as disclosed herein. In particular, the bag 10 of FIGS. 22-32 is configured for use with the weightlifting assemblies 100 shown in FIGS. 20 and 21. The bag 10 and the weightlifting assembly 100 in FIGS. 22-32 includes many of the components and features disclosed herein with respect to the embodiments of FIGS. 1-15 and FIGS. 16-20, and such shared components and features are referred to using similar reference numbers. Such shared components and features may not be described again in detail with respect to the bag 10 and the weightlifting assembly 100 in FIGS. 22-32, for the sake of brevity.

Figure 16:
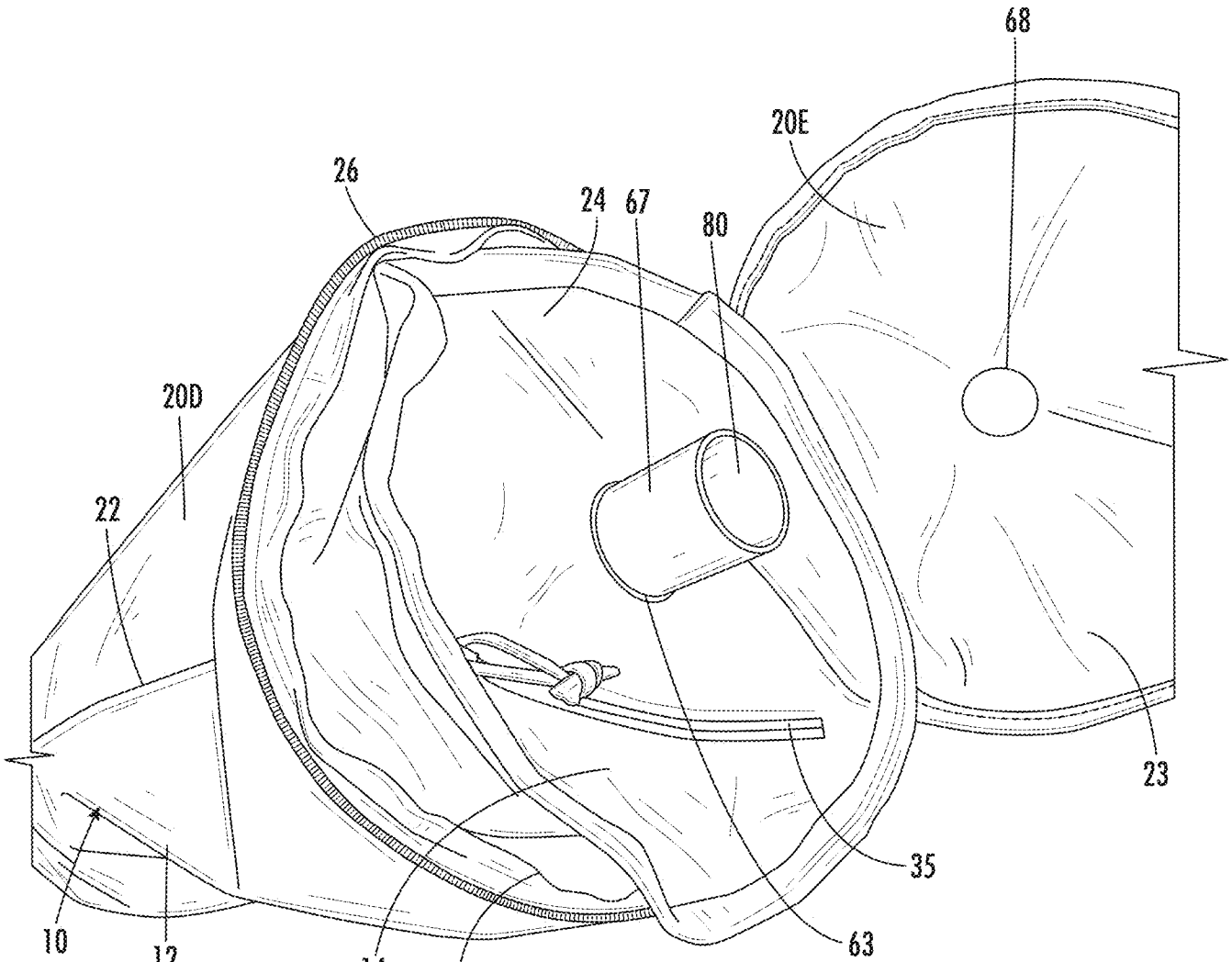
FIG. 16 is a perspective view of another embodiment of a weighted bag of a weightlifting assembly according to aspects of the disclosure, with a lid of the weighted bag shown in the open position.
Figure 17:
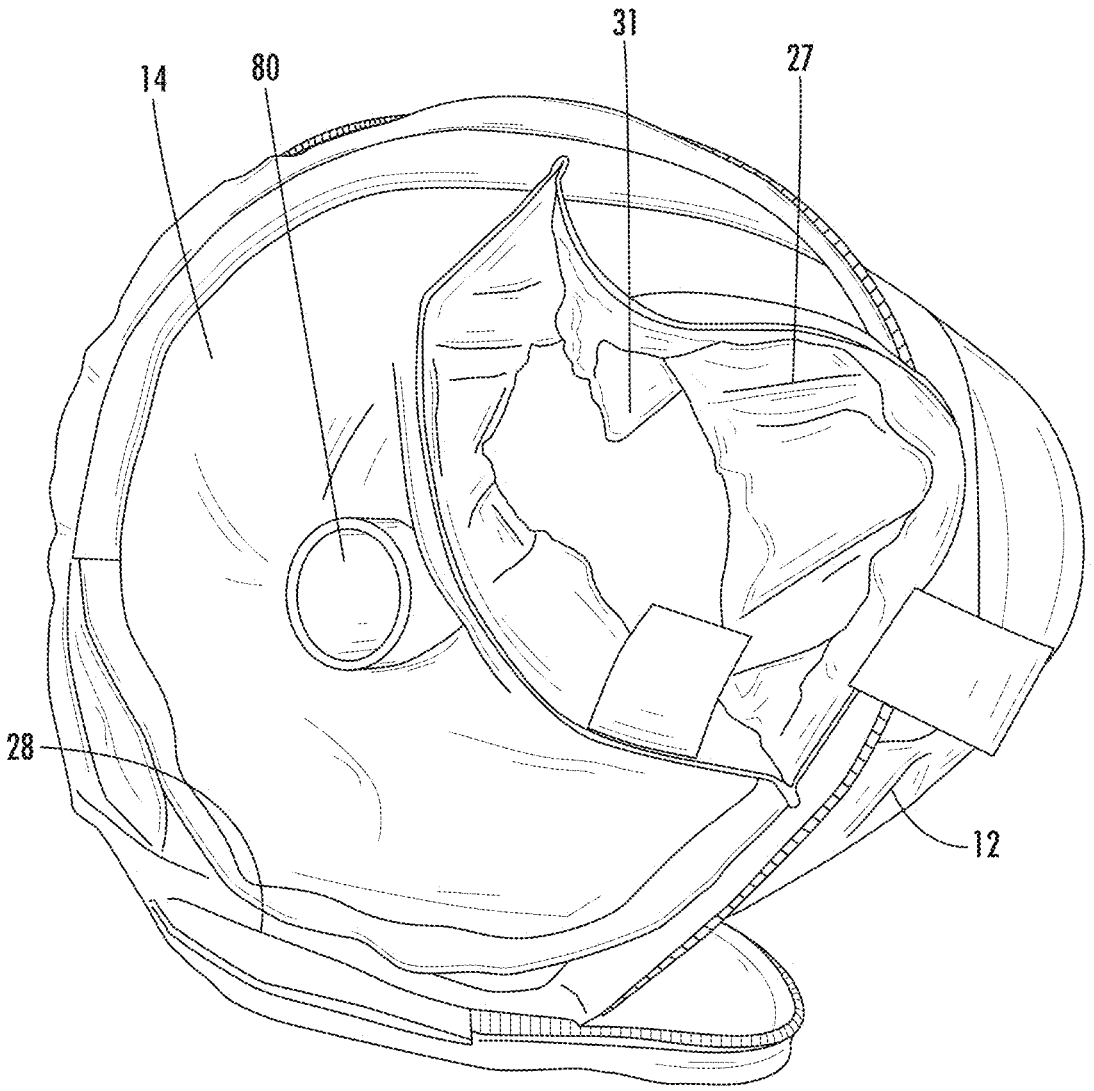
FIG. 17 is a top view of the weighted bag of FIG. 16, with the lid of the weighted bag shown in the open position.
Figure 18:
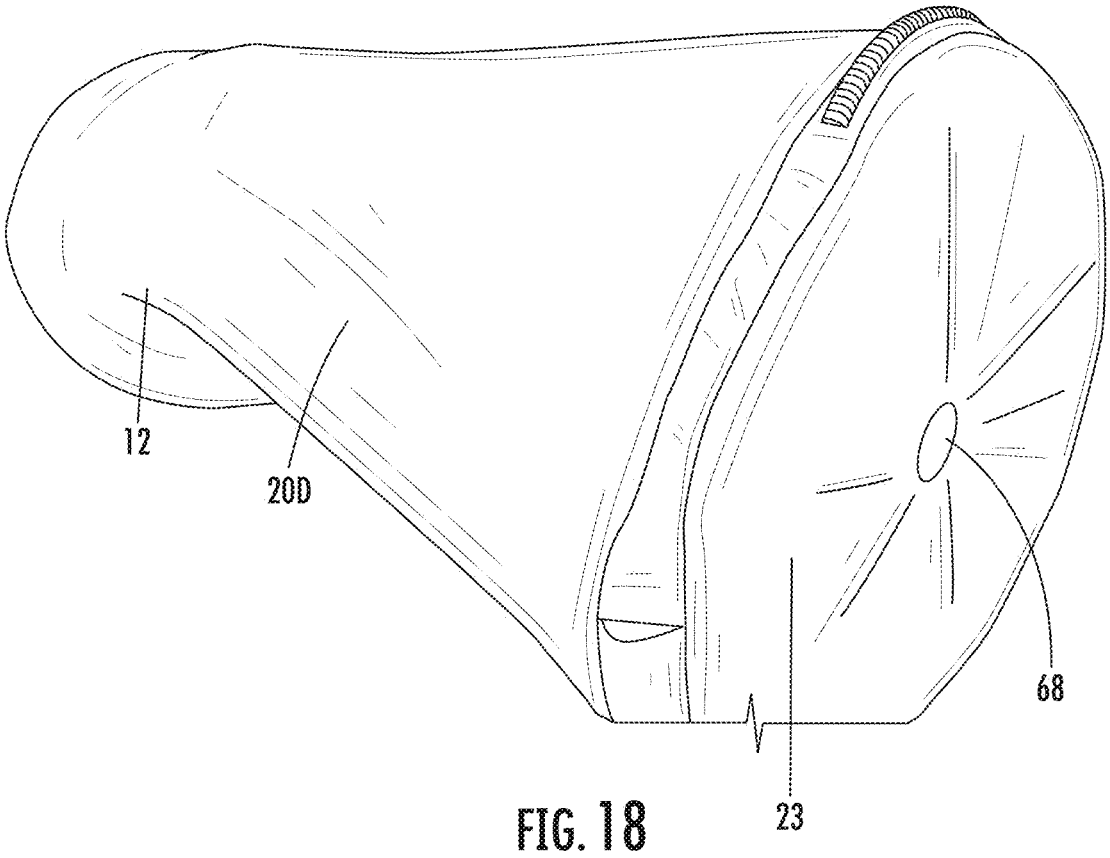
FIG. 18 is a perspective view of an outer shell of the weighted bag of FIG. 16.
Figure 30:
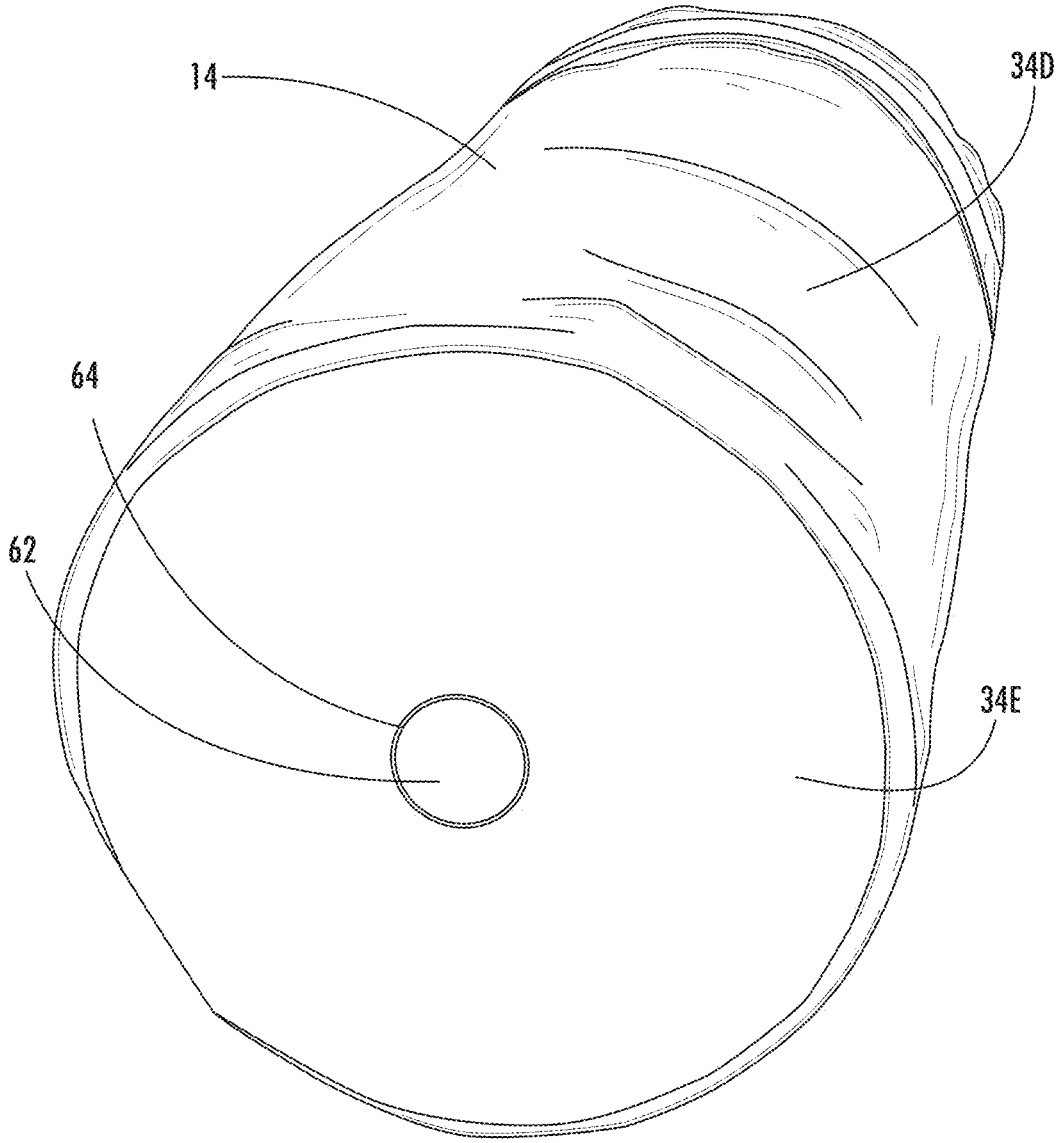
FIG. 30 is a bottom perspective view of an inner bag of the weighted bag of FIG. 22.
Figure 31:
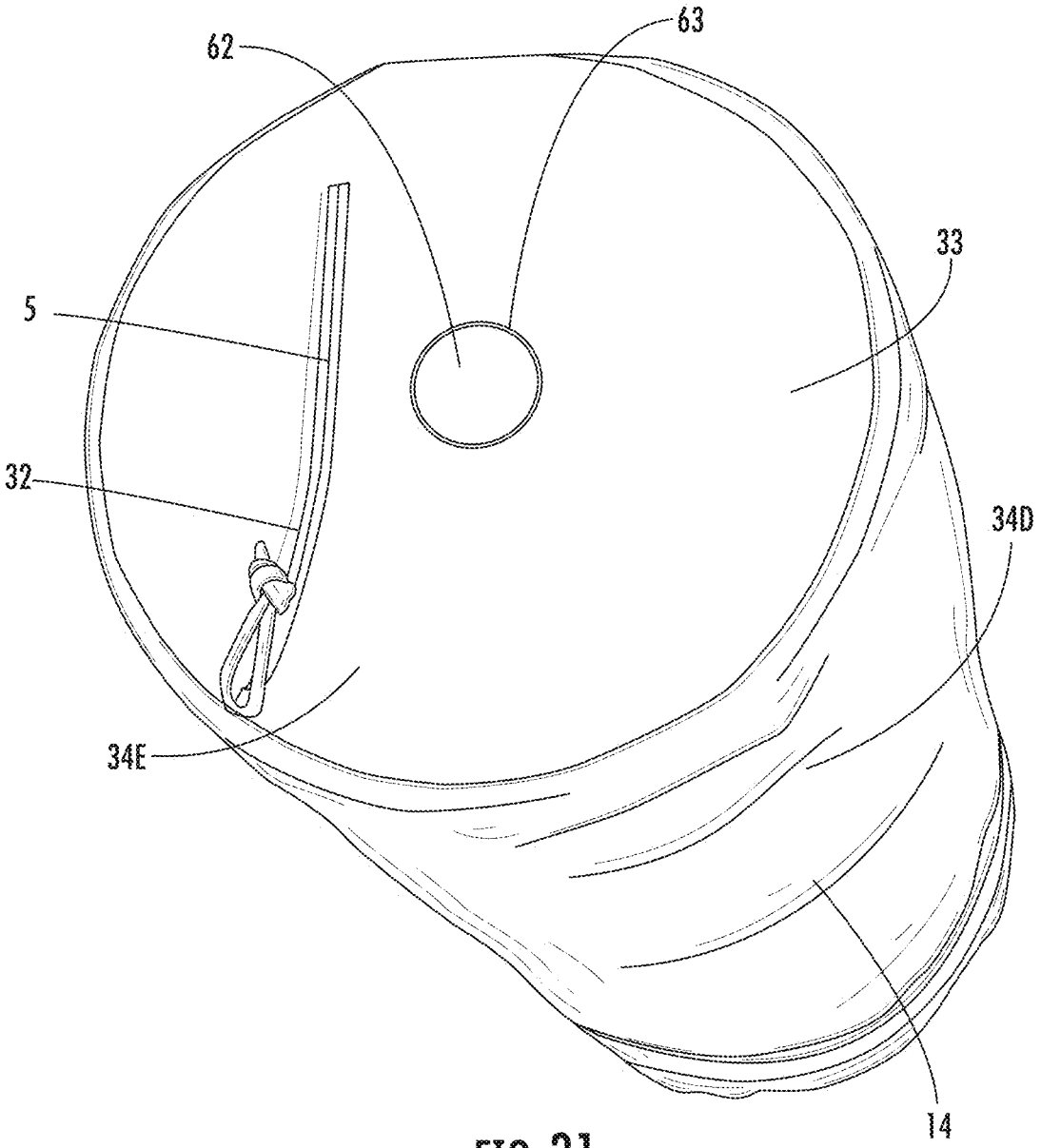
FIG. 31 is a top perspective view of the inner bag of FIG. 30.
Figure 32:
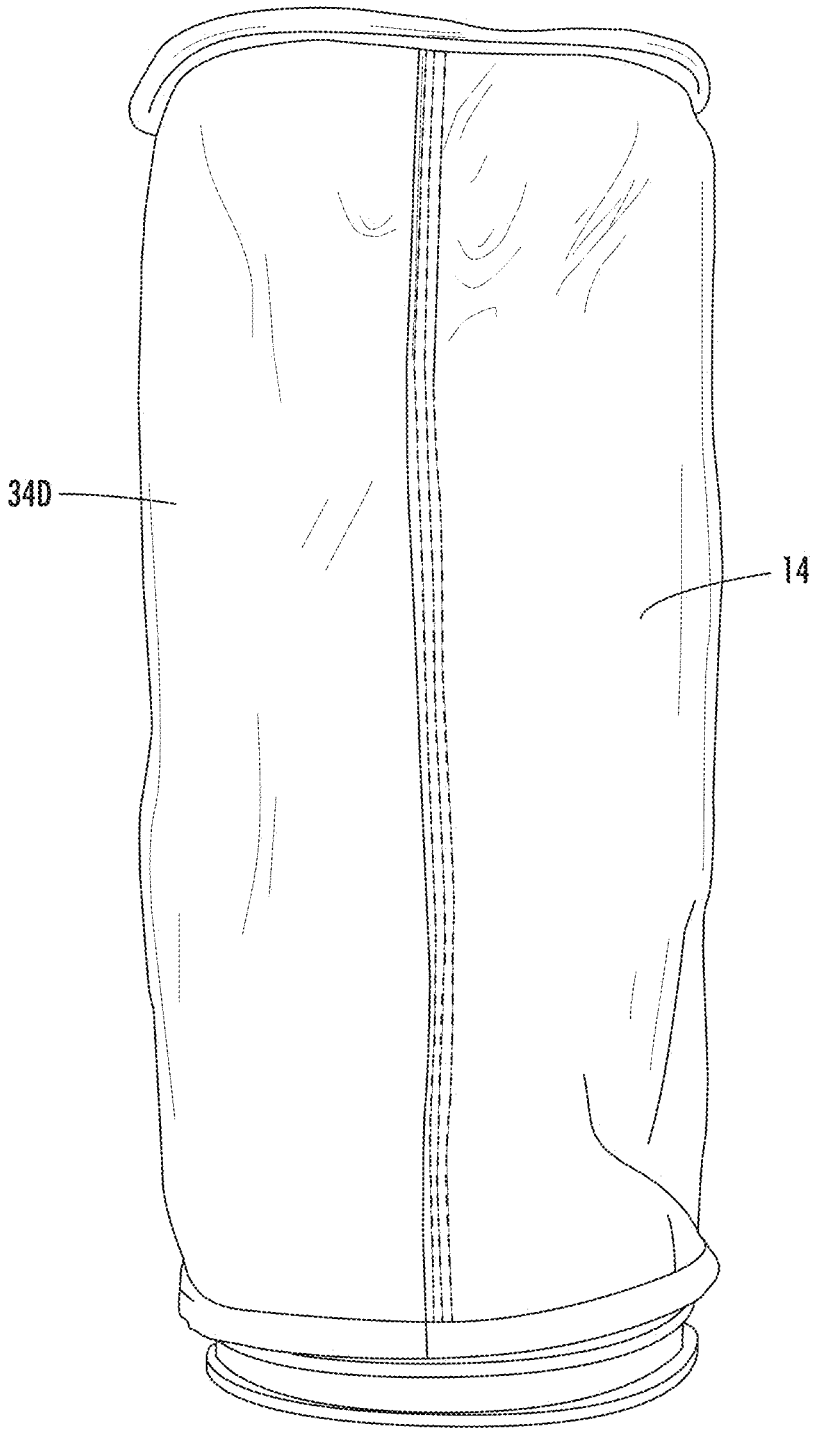
FIG. 32 is a side view of the inner bag of FIG. 30.
Figure 33:
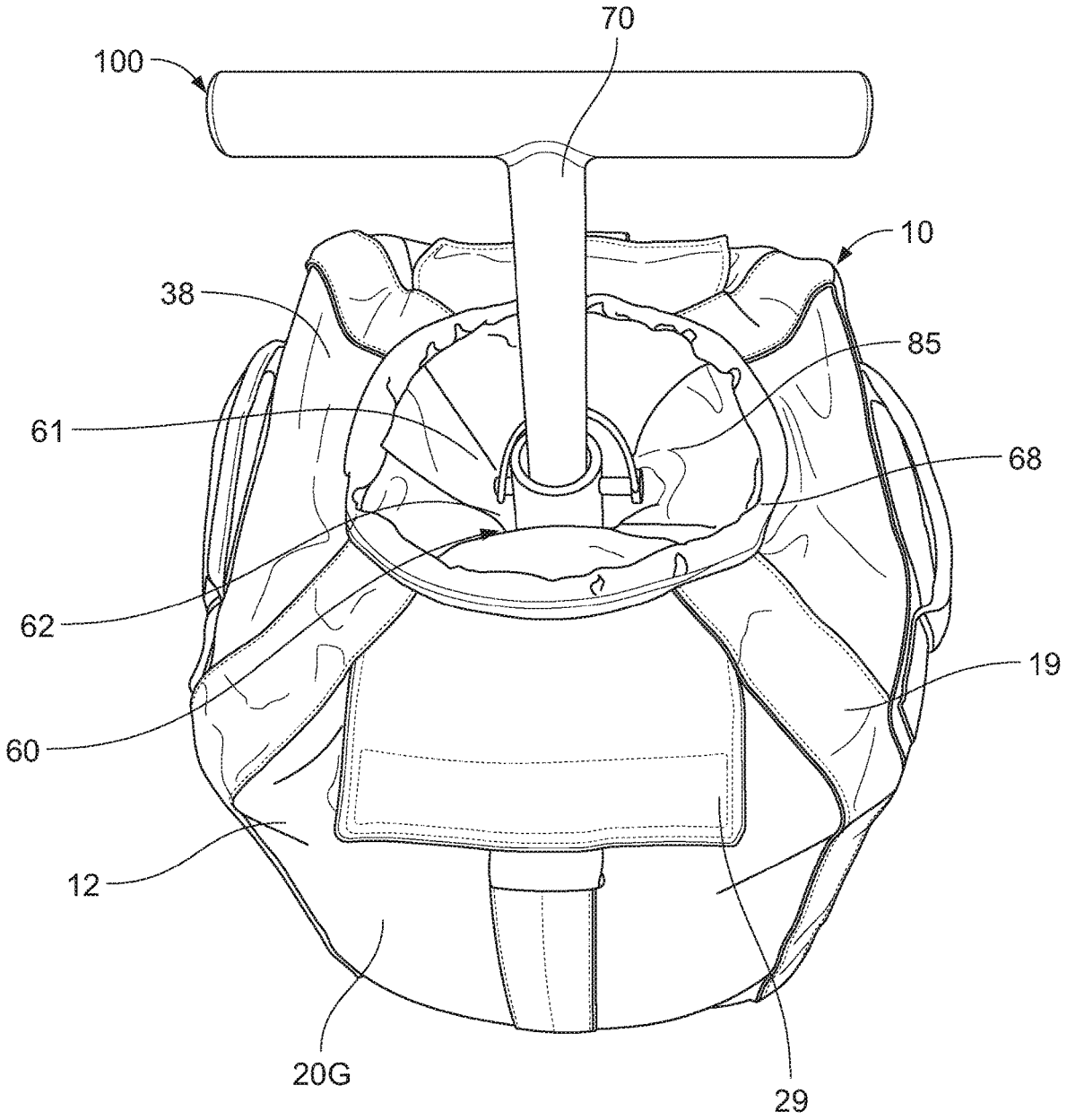
FIG. 33 is a top perspective view of another embodiment of a weightlifting assembly according to aspects disclosed herein.
Figure 34:
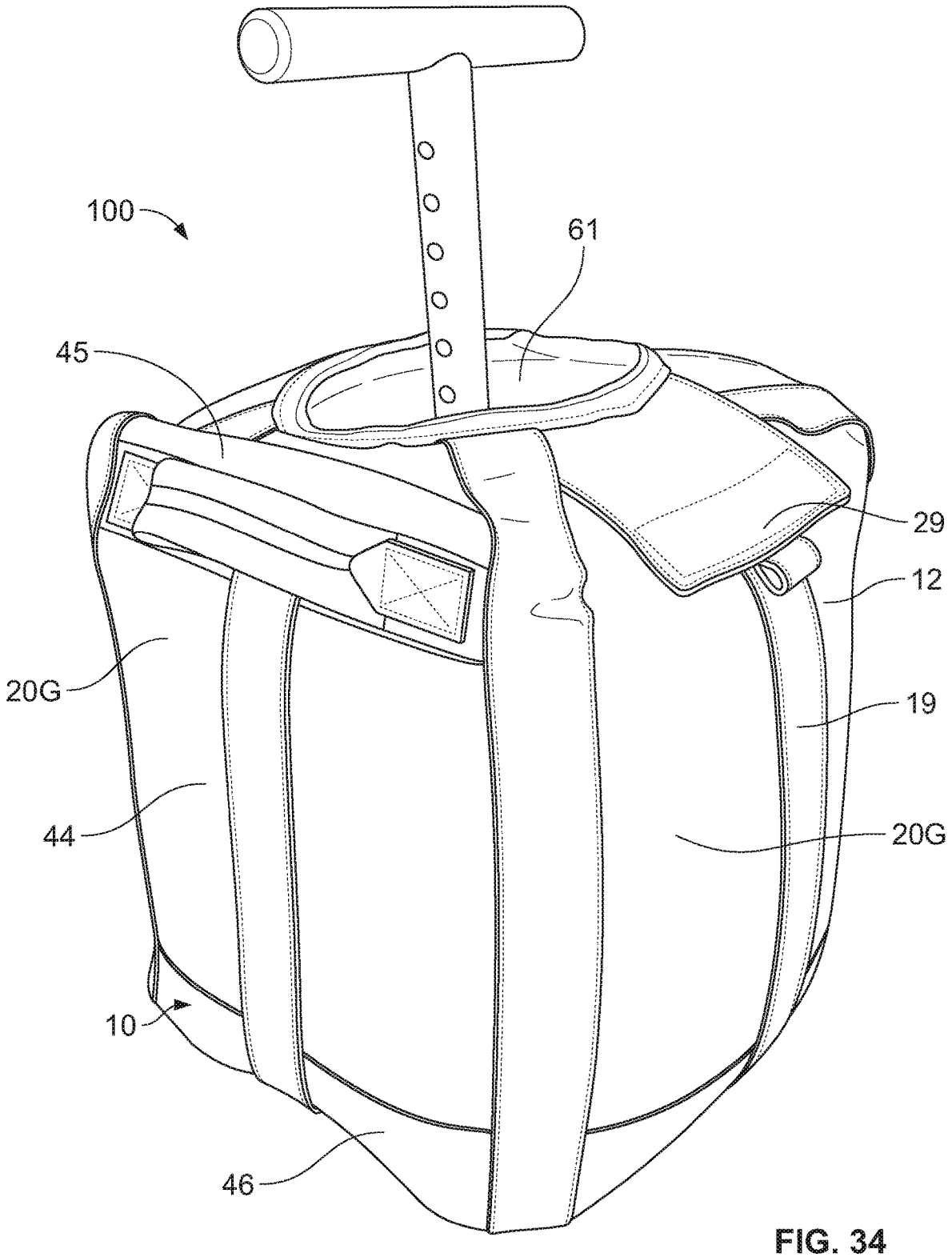
FIG. 34 is a top perspective view of the weightlifting assembly of FIG. 33.
Figure 35:
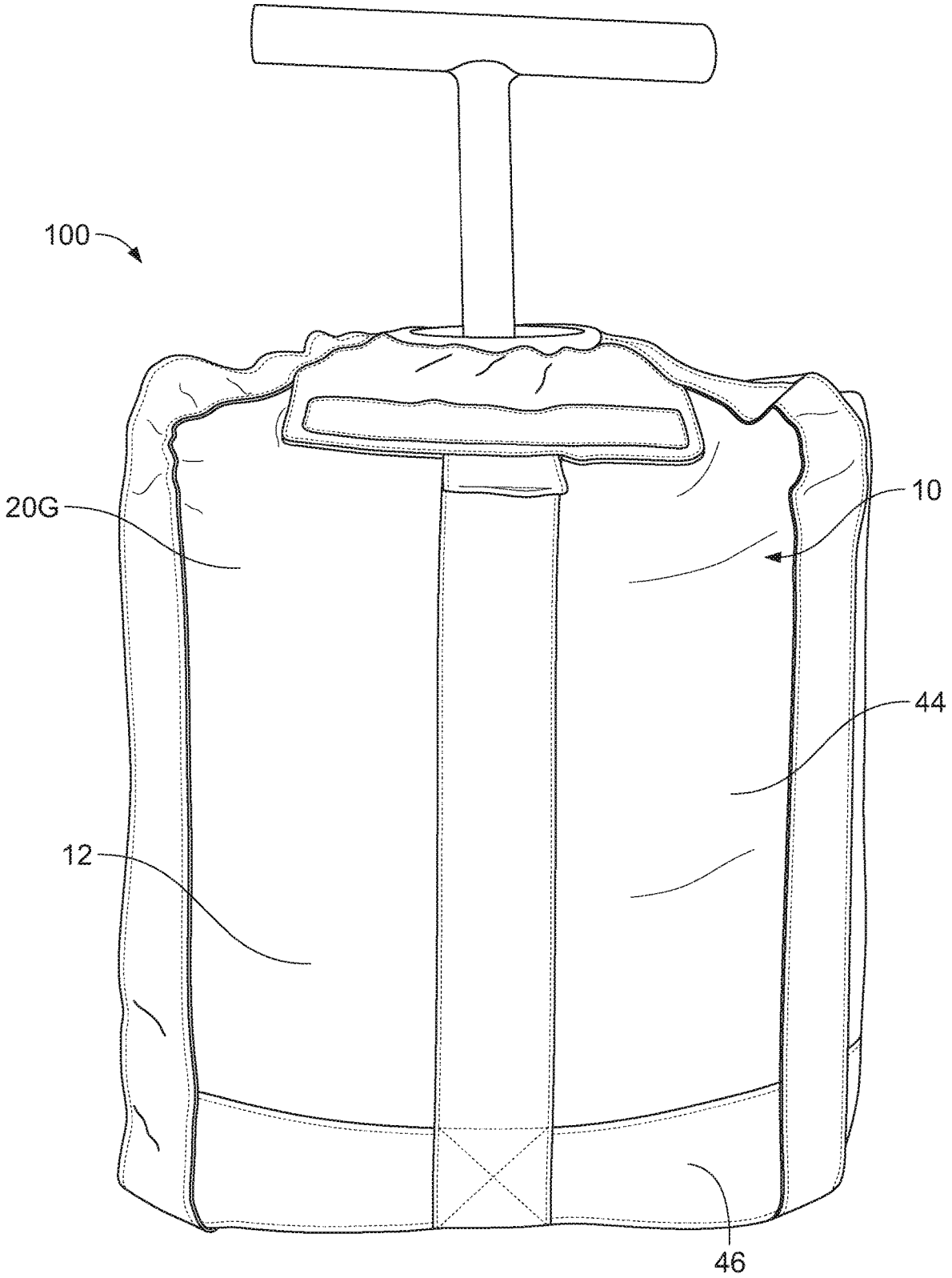
FIG. 35 is a side view of the weightlifting assembly of FIG. 33.

The bag 10 of FIGS. 22-32 is configured as a cylinder and includes an outer shell 12 formed of a plurality of panels 20 defining a cylindrical shape, including a circumferential body panel 20D and two end panels 20E, with an annular base panel 20F located around the peripheral edge of the bottom 39 and forming a lowermost portion of the main body 18. The annular base panel 20F may be made from a more durable material than the body panel 20D, to resist abrasion at the corners of the bag 10, and the flap 50 (described below) may be made of a similar durable material. The bag 10 of FIGS. 22-32 may also include an inner bag 14 also formed of a plurality of panels 34 defining a similar shape. The outer shell 12 in this embodiment is illustrated in FIGS. 22-29, and the inner bag 14 is illustrated in FIGS. 30-32. The outer shell 12 includes an opening 24 with a cover 23 at one of the ends, which is secured to the main body 18 by a closure mechanism 26 as disclosed herein (e.g., a zipper), to access the inner bag 14. Although not shown in FIGS. 22-32, it is understood that the inner bag 14 is received within the outer shell 12 similar to the embodiment of FIGS. 16-20, such as shown in FIGS. 16-17. The inner bag 14 has a single opening 35 at one end that includes a filling mechanism (not shown) in the form of a funnel (not shown), similar to the configuration shown in FIG. 17. A plastic layer and/or a foam layer (not shown) may also be positioned between the inner bag 14 and the outer shell 12 in this configuration. The connection assembly 60 includes an outer tube 62 extending through the cavity (not shown) of the inner bag 14 and an inner tube 67 extending through the outer tube 62 to define a passage 80 through the bag 10, as disclosed elsewhere herein. These structures may be connected to the inner bag 14 in a similar configuration to the embodiment of FIGS. 1-15, including the use of stabilizing baffles (not shown) as disclosed herein. In another embodiment, the bag 10 of FIGS. 22-32 may not include an inner tube 67, and may instead include only an outer tube 62 extending through the inner bag 14.

The bag 10 of FIGS. 22-32 also has a flap 50 that is moveable between a covered position (see, e.g., FIGS. 27-29), where the flap 50 covers the closure member 26, an uncovered position (see, e.g., FIGS. 22-26), where the flap 50 is moved to permit the closure member 26 to be manipulated to open and close the cover 23. The flap 50 may be formed of a similar material as the outer shell 12, such as ballistic nylon fabric. As shown in FIGS. 22-26, the closure member 26 in this embodiment is a zipper that extends around the majority of the periphery of the outer shell 12. The flap 50 in this embodiment is in the form of a collar-like flap or semi-annular flap that extends around the periphery of the top 38 of the outer shell 12 around a majority of the periphery of the top 38. In one embodiment, the flap 50 and the closure member 26 extend around approximately the same proportion of the periphery of the outer shell 12, e.g., at least 75% or at least 80% of the periphery. This configuration creates a gap 58 between the peripheral ends of the flap 50. It is understood that the semi-annular configuration of the flap 50 assists in folding the flap upward and downward, as the gap 58 permits for expansion of the diameter of the material of the flap 50, which may be a low-stretch material. The flap 50 has a fixed or proximal end 51 connected to the outer shell 12 around the top 38 and a free or distal end 52 that can be moved to place the flap 50 in the covered or uncovered position. The flap 50 is connected to the cover 23 of the outer shell 12 in this embodiment. However, in another embodiment, the flap 50 may be connected to a different portion of the outer shell 12. For example, the flap 50 may be connected to the outer shell 12 on the opposite side of the closure member 26 from the cover 23. Furthermore, the outer shell 12 may include a plurality of flaps 50 that combine to cover portions of the closure member 26, rather than a single, continuous flap 50.

The flap 50 is moveable between the covered and uncovered positions by moving the free end 52 upward and downward along the side of the outer shell 12, such as by gripping the flap 50 and rolling or folding the flap 50 upward or downward. In the uncovered position, as shown in FIGS. 22-26, the free end 52 of the flap 50 extends upward and/or outward from the periphery of the top 38, such that the closure member 26 is exposed. In the covered position, as shown in FIGS. 27-30, the free end 52 of the flap 50 extends downward from the periphery of the top 38, such that the flap 50 covers the closure member 26 and extends around a portion of the periphery of the body panel 20D. The inner surface 56 of the flap 50 is exposed in the uncovered position and is placed to confront the outer surface of the cylindrical portion of the outer shell 12 in the covered position, in this embodiment. The outer shell 12 may also include a releasable retaining structure 53 to retain the flap 50 in the covered position, to resist inadvertently exposing the closure member 26. In the embodiment of FIGS. 22-32, the releasable retaining structure 53 is in the form of an annular or semi-annular band of a hook-and-loop connecting material 54 (e.g., Velcro), with a complementary connecting material 55 fixed to the inner surface 56 of the flap 50. The connecting materials 54, 55 in FIGS. 22-32 extend continuously around substantially the entire periphery of the flap 50. However, in another embodiment, either or both of the connecting materials 54, 55 may be arranged in a plurality of pieces connected intermittently around portions of the periphery of the flap 50. Further, the outer shell 12 in FIGS. 22-32 has a shielding member 57 covering a portion of the band of the connecting material 54 that would be exposed within the gap 58 in the flap 50, in order to avoid wear and damage. In other embodiments, a different type of retaining structure 53 may be used, such as buckles, snaps, buttons, ties, etc.

The flap 50 in the embodiment of FIGS. 22-32 may be used in other embodiments described herein, such as the embodiments of FIGS. 1-15 and FIGS. 16-20. It is understood that the structural shape and configuration of the flap 50 may be modified based on the shape and configuration of the outer shell 12. For example, when used in an embodiment with a square or rectangular periphery, as shown in FIGS. 1-15, the flap 50 may have side portions and corner portions that are configured to fit around the sides and corners of the outer shell 12, respectively.

The inner bag 14 of the bag 10 of FIGS. 22-32 is shown in FIGS. 30-32. The inner bag 14 in this embodiment is configured similarly to the inner bag 14 in FIGS. 16-17, with the opening 35 in the top end 33 of the inner bag 14 to be accessible through the opening 24 of the outer shell 12 without removing the inner bag 14 and a filling mechanism (not shown) including a funnel structure (not shown) accessible through the opening 35. As shown in FIGS. 30-32, the inner bag 14 may be formed of a plurality of panels 34 defining a cylindrical shape, including a circumferential body panel 34D and two end panels 34E. The inner bag 14 of FIGS. 16-20 may have a similar construction.

FIGS. 33-47 illustrate another embodiment of weightlifting assembly 100 including a bag 10 connected to an implement in the form of a handle assembly 70 for weightlifting. The bag 10 and the weightlifting assembly 100 in FIGS. 33-47 includes many of the components and features disclosed herein with respect to the embodiment of FIGS. 1-15, and such shared components and features are referred to using similar reference numbers. Such shared components and features may not be described again in detail with respect to the bag 10 and the weightlifting assembly 100 in FIGS. 33-47, for the sake of brevity.

The weighted bag 10 of FIGS. 33-47 includes an outer shell 12 and an inner bag 14 disposed within the outer shell 12, with a connection structure 60 for removable connection to the handle assembly 70. The connection structure 60 includes a tube structure 61 extending through the outer shell 12 and the inner bag 14 and configured for receiving a portion of the handle assembly 70 or another implement therethrough. The weighted bag 10 as shown in FIGS. 33-47 is configured for weightlifting and similar exercises, and can be lifted, carried, thrown, dropped, and otherwise used in such exercises, either by gripping the outer shell 12 or by gripping the handle assembly 70.

The outer shell 12 in FIGS. 33-47 includes one or more panels 20G that are connected by one or more seams 22, two openings 24, and two cover flaps 29 each configured for releasable closure by a shell closure member 26. The panels 20G may be flexible and/or made from a fabric material in one embodiment. The inner surfaces of the panels 20G define an inner cavity 21 configured to hold a filler material (not shown). These components may be connected using various techniques, such as stitching in one embodiment. Other connection techniques, such as adhesives, may additionally or alternately be used. The outer shell 12 has a top 38 and a bottom 39, such that the openings 24 are positioned on the top 38, and the bag 10 is configured to rest on the bottom 39. It is understood that the top 38 and the bottom 39 are relative terms that depend on the orientation of the bag 10.

It is to be understood the inner and outer surfaces of the panels 20G may be defined by one or more surfacing layers that may be of substantially equal or variable materials. The panels 20G may have a two or greater ply configuration coupled together. In the configuration shown, the panels are shown as singular pieces with the understanding that they may represent multiple plies of material. In one embodiment, the panels 20G are formed from a two-ply construction, with the outer and inner plies comprising different grades of nylon fabric (e.g., the outside being of 1000 denier and the inside being of 500 denier, or the outside being of 1000 denier Cordura Nylon and the inside being of 1050 denier Ballistic Nylon). Of course, other configurations are contemplated.

Figure 45:
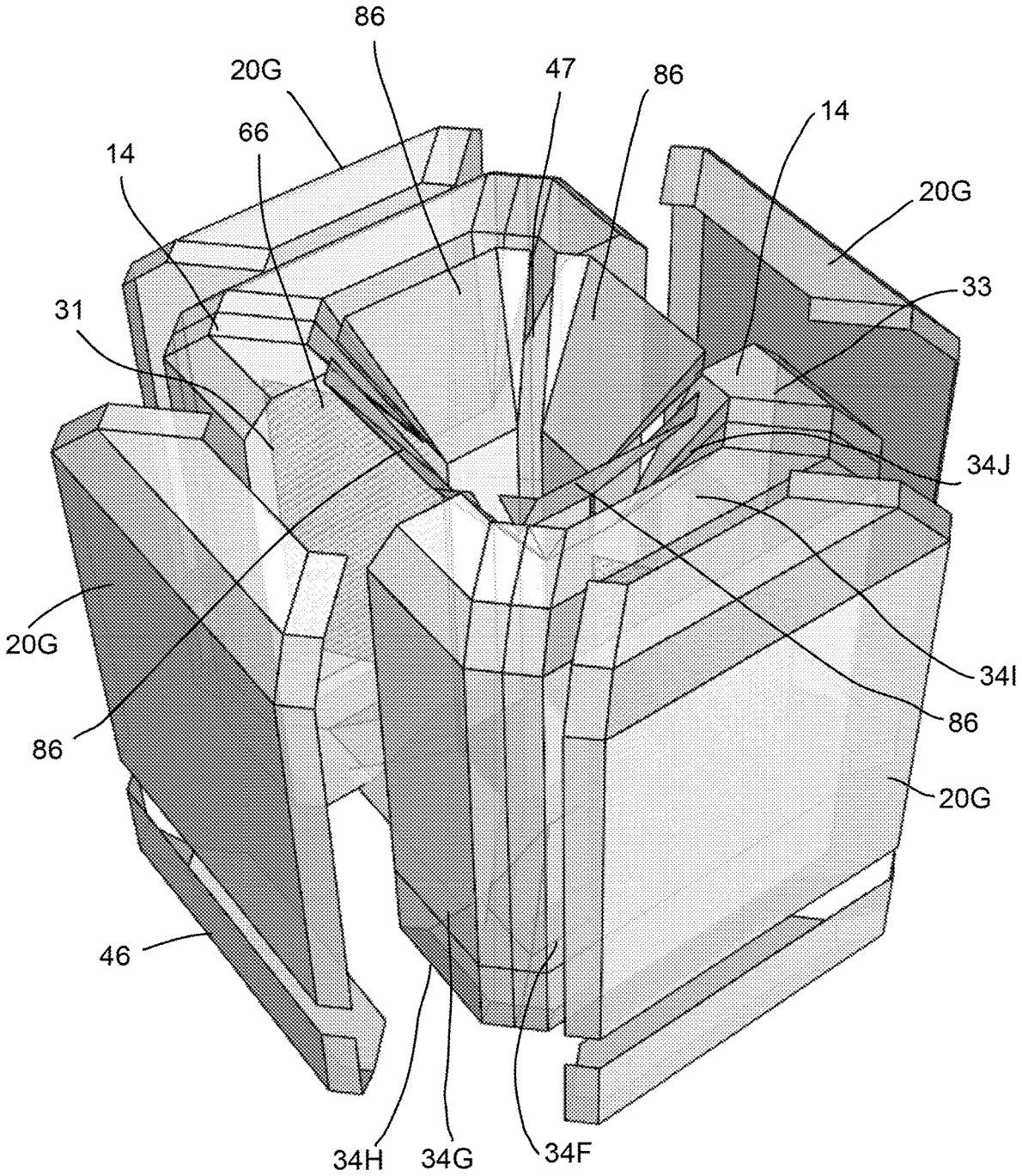
FIG. 45 is a schematic exploded perspective view of the weighted bag of FIG. 38.

With reference to the example embodiment of the outer shell 12 in FIGS. 33-47, the panels 20G are all substantially similar in shape and each have a side portion 44 forming a side wall of the outer shell 12, a top portion 45 forming a portion of the top 39, and a bottom portion 46 forming a portion of the bottom 39 on either end of the side wall portion 44. In the embodiment of FIGS. 33-47, the panels 20G are arranged in opposed pairs, where each pair forms side walls that are substantially parallel with each other, and all four panels 20G are connected along both lateral edges thereof. The outer shell 12 in the embodiment of FIGS. 33-47 is entirely or substantially defined by the panels 20G. In this embodiment, the shell 12 defines a rectangular cubic configuration. In other embodiments, the shell 12 may have a different shape, such as a square cube, a rectangular polyhedron, a circular cylinder, an oval cylinder, a rectangular cylinder, a triangular cylinder, or various other symmetrical or non-symmetrical shapes. It is understood that the outer shell 12 may be formed of a greater of smaller number of panels in such other embodiments. The outer shell 12 also includes reinforcing strips 19 extending vertically over the seams 22 between the panels 20G and down the center of each panel 20G, which are stitched to the panels 20G. In the embodiment of FIGS. 33-47, each of the panels 20G has a bottom portion 46 that is separate and/or includes an additional layer of fabric for protection. For example, the panels 20G may be made from one fabric (e.g., 1000 denier Cordura Nylon), and the bottom portions 46 may either be made from a different fabric (e.g., 1050 denier Ballistic Nylon) or have an additional coating of the different fabric. For example, FIG. 45 illustrates the panels 20G as each having a bottom portion 46 formed of a separate piece from the remainder of the panel 20G.

In the embodiment of FIGS. 33-47, the bag 10 has two openings 24 positioned in the top 38 of the outer shell 12, and two filling mechanisms 25 that are accessible through the openings 24 for filling the bag 10. As shown in FIGS. 33-47, the top portions 45 of two opposing panels 20G each have an opening 24. The openings 24 may be oriented, shaped, and/or located differently in other embodiments, and only a single opening 24 may be used in one embodiment. Each opening 24 may include a closure member (not shown) configured for releasably closing the opening 24 in one embodiment, such as a zipper, a hook and loop fastener, snaps, buttons, flaps, straps, and other fastening and/or closing structures or combinations of such structures. In another embodiment, the cover flaps 29 are sufficient to close the openings 24. The cover flaps 29 are fixed to the top 38 and can be folded upward and away from the respective opening 24 to expose the opening 24, and the outer shell 12 also includes closure members 26 for closing the cover flaps 29 over the openings 24. The closure members 26 in the embodiment of FIGS. 33-47 includes hook and loop fasteners on the underside of the cover flap 29 and the panel 20G to which the cover flap 29 is connected. In other embodiments, the shell closure member 26 may have other configurations, such as zipper, snaps, buttons, flaps, straps, and other fastening and/or closing structures or combinations of such structures may be utilized.

The inner cavity 21 of the outer shell 12 has filler material within it when the device is prepared for use, as disclosed herein. In the embodiment of FIGS. 33-47, the bag 10 has two inner bags 14 positioned within the cavity 21 of the outer shell 12 and connected to the outer shell 12 to contain the filler material. In another embodiment, the outer shell 12 may contain the filler material without the use of an inner bag, or the two inner bags 14 may be combined into a single inner bag 14 as in the embodiment of FIGS. 1-15. Each inner bag 14 has a top end 33 with an opening 35 (shown schematically in FIG. 47), which is connected to the shell 12 such that the top end 33 is exposed within the openings 24 when the openings 24 are open. Each inner bag 14 is also formed of a plurality of panels 34, which may include a full side panel 34F forming a full side wall of the inner bag 14, two half-side panels 34G forming two smaller opposing side walls of the inner bag 14, a bottom panel 34H, a top panel 34I forming the top end 33, and one or more inner panels 34J forming a concave inner side wall 47 of the inner bag 14. The side panel(s) 34F,G are connected to the bottom panel 34H and the top panel 34I around a portion of the peripheries thereof, such as by stitching. The inner panels 34J are connected to the top panel 34I, the bottom panel 34H, and the half-side panels 34G. The panels 34 of each inner bag 14 define a filling cavity 31 configured to hold the filler material.

The panels 34 of each inner bag 14 may be formed of materials similar to the outer shell 12, and the shape of the inner bag 14 may be generally the same as the shape of the outer shell 12. Alternately the inner bag 14 and the outer shell 12 may be designed differently in materials, connections (e.g., seams), and structure. For example, the materials, connections, and structure of the outer shell 12 may be configured for strength, durability, abrasion resistance, and comfort in handling, while the materials, connections, and structure of the inner bag 14 may be configured primarily for strength and resisting leakage. In one embodiment, the outer shell 12 is made from two layers of 1000 denier Cordura Nylon and 1050 denier Ballistic Nylon, and the inner bag 14 is formed of 500 denier Cordura Nylon.

Each inner bag 14 is placed inside the cavity 21 of the outer shell 12 in the embodiment of FIGS. 33-47 and secured to the outer shell 12, e.g., by stitching. In one embodiment, a durable plastic layer and/or a foam layer (not shown) may be placed inside the cavity 21 between the bottom 39 of the outer shell 12 and the inner bag 14, as similarly described herein with respect to the embodiment of FIGS. 1-15. Such layers may be provided in multiple pieces in the embodiment of FIGS. 33-47. In one embodiment, the inner bags 14 are placed in the cavity 21 such that the concave inner side walls 47 are placed around the tube structure 61, described below. Placed in this manner, the inner bags 14 may abut each other on either side of the tube structure 61, particularly when filled, in one embodiment. In another embodiment, the inner bags 14 may be spaced from each other, and in a further embodiment, the outer shell 12 may include one or more internal panels (not shown) within the cavity 21 to separate the inner bags 14.

Figure 46:
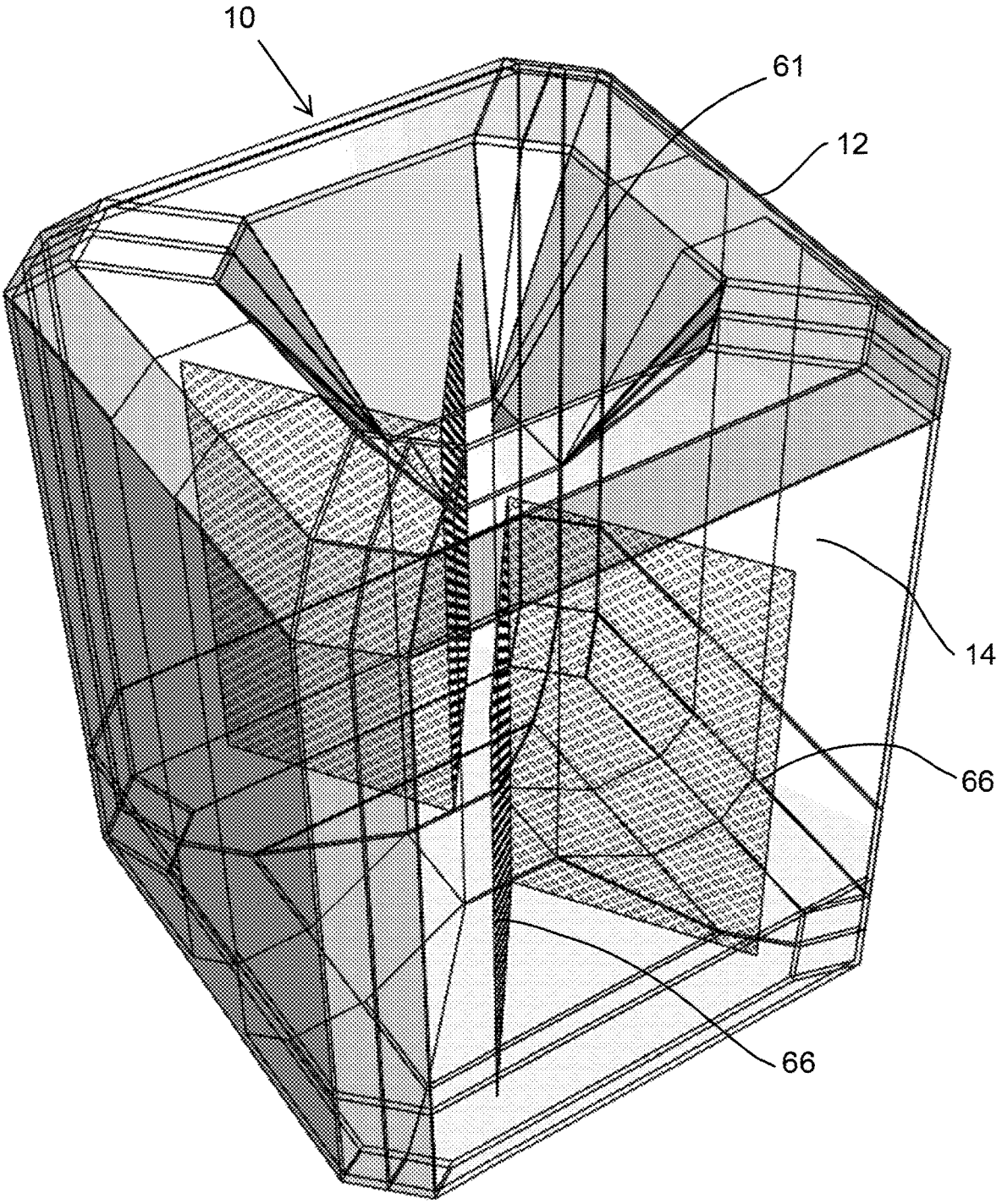
FIG. 46 is a schematic perspective view of the weighted bag as shown in FIG. 45.
Figure 47:
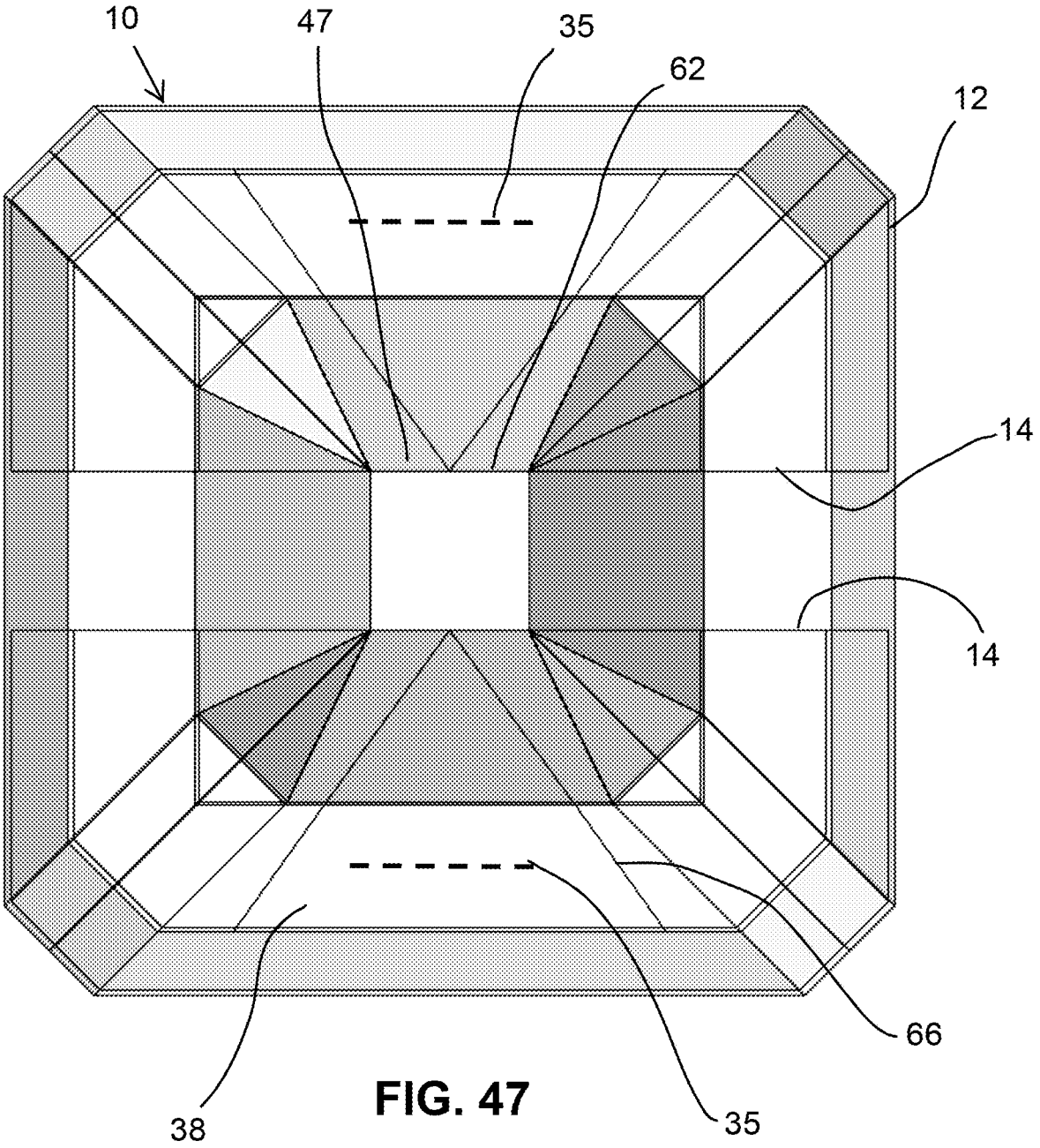
FIG. 47 is a schematic top view of the weighted bag as shown in FIG. 45.

Each inner bag 14 in the embodiment of FIGS. 33-47 includes one or more baffles 66 secured to inner surfaces of the inner bag 14 and extending across the filling cavity 31. For example, as shown in FIGS. 45-47, each inner bag 14 may have two baffles 66 connected to the inner surface of the inner panel(s) 34J at the concave inner side wall 47 and extending outward at oblique angles to the inner surface of the full side panel 34F. The baffles 66 may be secured to the inner bag 14 by stitching or other connection technique. In other embodiments, the configurations of the baffles 66 may be different, such as being connected to the tube structure 61, or by having a different number and/or arrangement of baffles 66. In this configuration, the baffles 66 help retain the shape of the sidewalls of the inner bag 14, regardless of the fill level of the inner bag 14, and may also at least partially inhibit flow of the particulate material around the filling cavity 31 to avoid uneven weighting. The baffles 66 may be made from a mesh material in one embodiment to permit passage of the filler material therethrough. The baffles 66 may extend to, or approximately to, the full height of the inner bag 14 in one embodiment, or may extend only a portion of the height of the inner bag 14 in another embodiment.

The bag 10 in FIGS. 33-47 has two filling mechanisms 25 each including a funnel structure 27 similar to that shown and described with respect to the embodiment of FIGS. 1-15. Each inner bag 14 has a funnel structure 27 fixed around an opening 35 in the top end 33 of the inner bag 14, such that the funnel structure 27 is accessible through one of the openings 24 in the outer shell 12. In one embodiment, each opening 35 may include a closure member (not shown) as described herein, e.g., a zipper, a hook and loop fastener, snaps, buttons, flaps, straps, and other fastening and/or closing structures or combinations of such structures. The funnel structure 27 may also include a closure structure for closing the open end of the funnel 27 and/or a securing structure for securing the funnel 27 in a collapsed position as described herein, e.g., a hook-and-loop structure, snaps, clasps, straps, or any other closure or securing structure disclosed herein, or combinations thereof. Each funnel 27 may also have one or more grasping handles as described herein to assist in pulling the funnel 27 through the opening 24 and/or opening the funnel closure as described herein. Each inner bag 14 can be filled by opening the cover flap 29 by releasing the shell closure member 26, opening the closure member(s) of the opening 24 and/or the opening 35 (if present), extending the filling mechanism 25 through the opening 24, and then opening the funnel 27 and filling the inner bag 14 as described herein. The bag 10 may then be closed in the opposite manner, as described herein.

Figure 36:
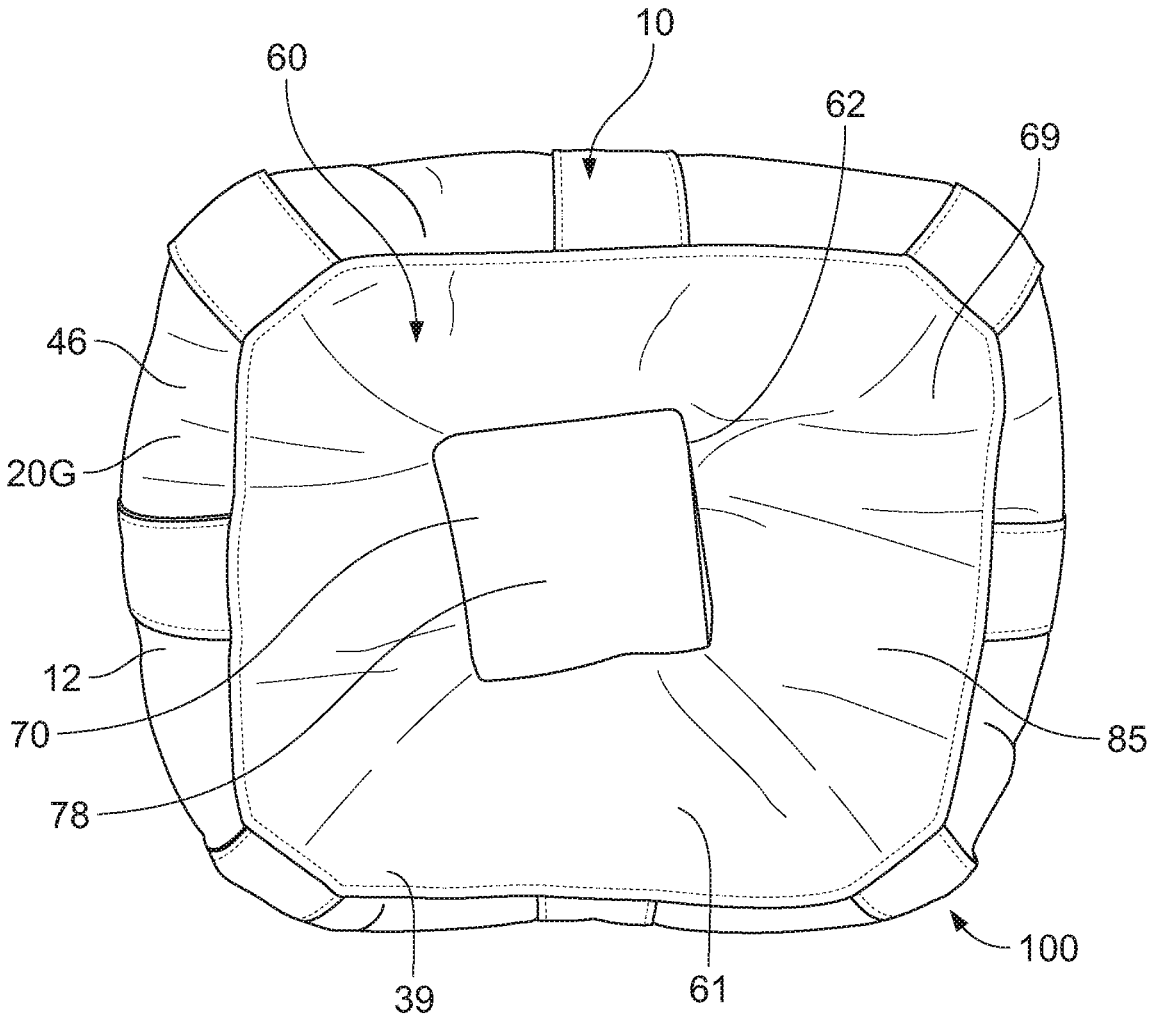
FIG. 36 is a bottom view of the weightlifting assembly of FIG. 33.
Figure 37:
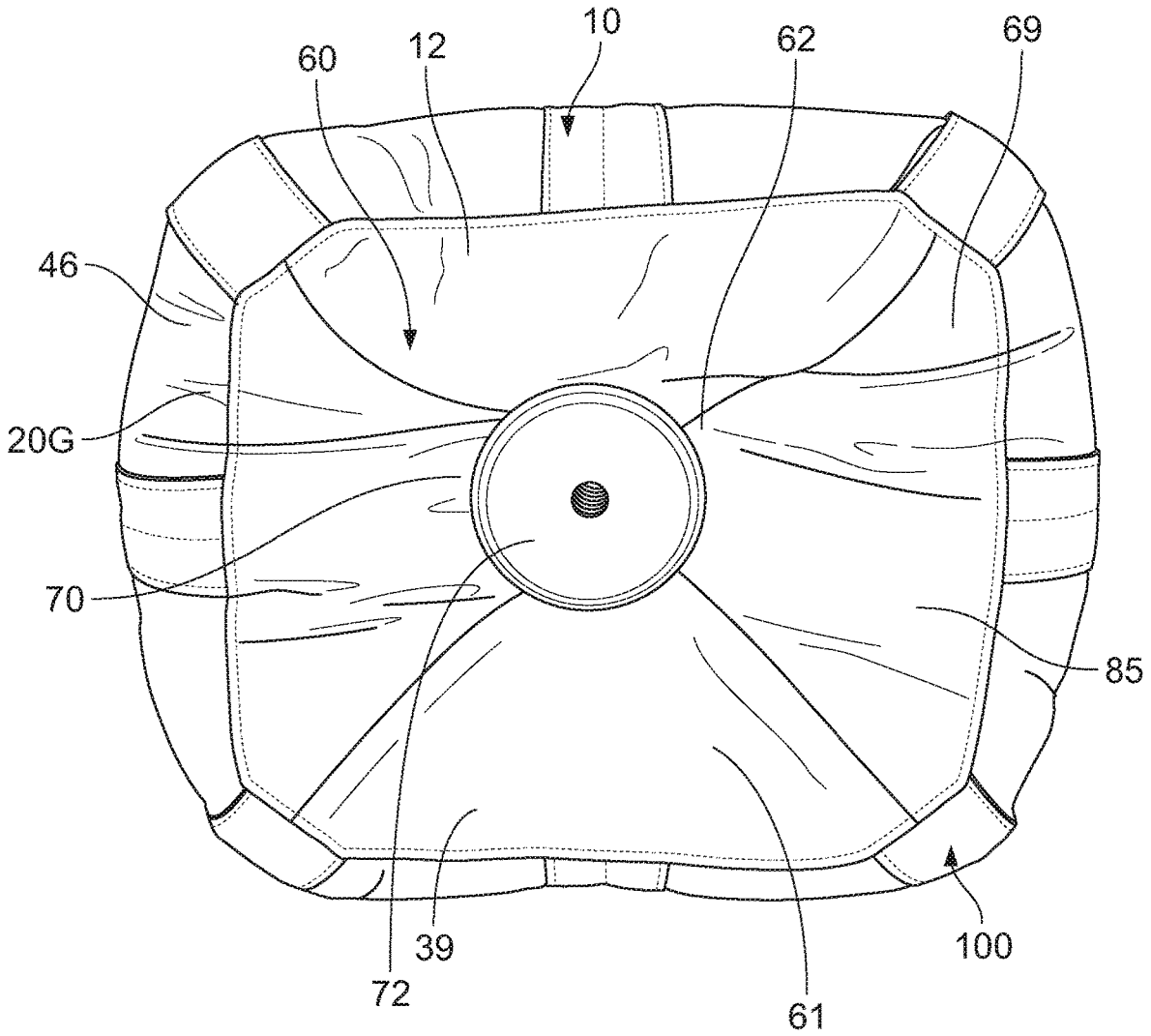
FIG. 37 is a bottom view of the weightlifting assembly of FIG. 33, with a pad removed.
Figure 38:
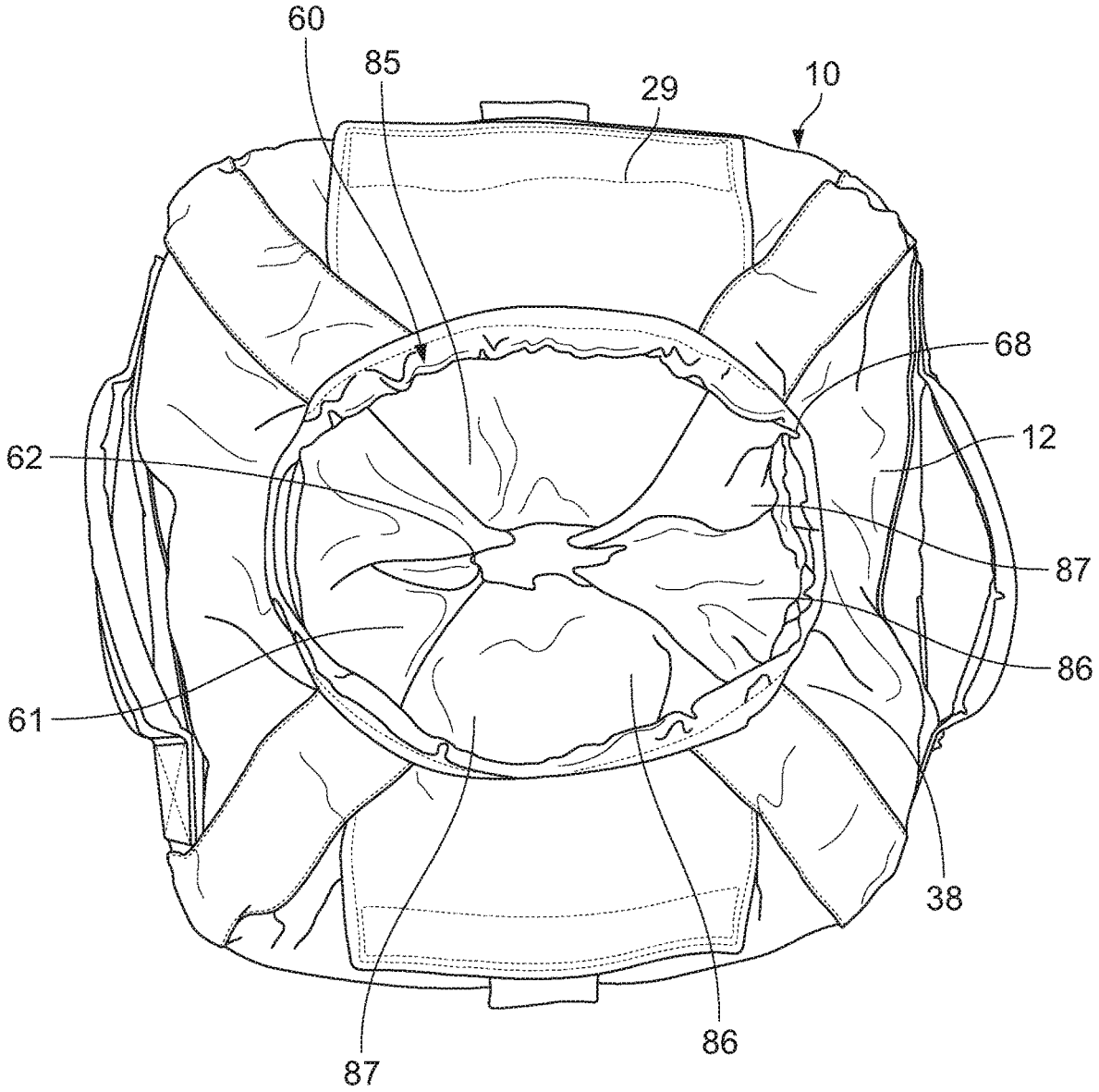
FIG. 38 is a top view of a weighted bag of the weightlifting assembly of FIG. 33.
Figure 39:
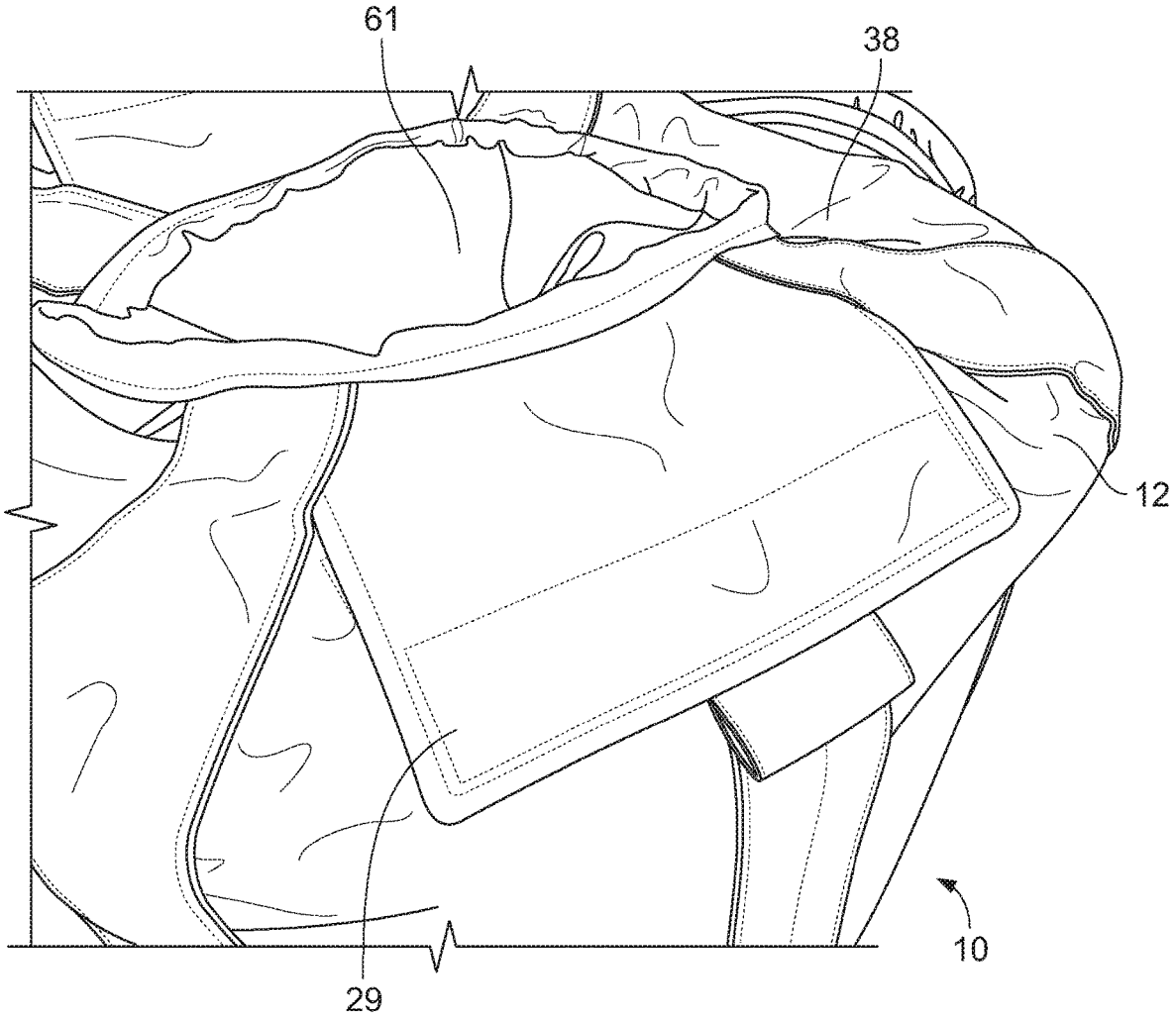
FIG. 39 is a top perspective view of a portion of the weighted bag of FIG. 38.
Figure 40:
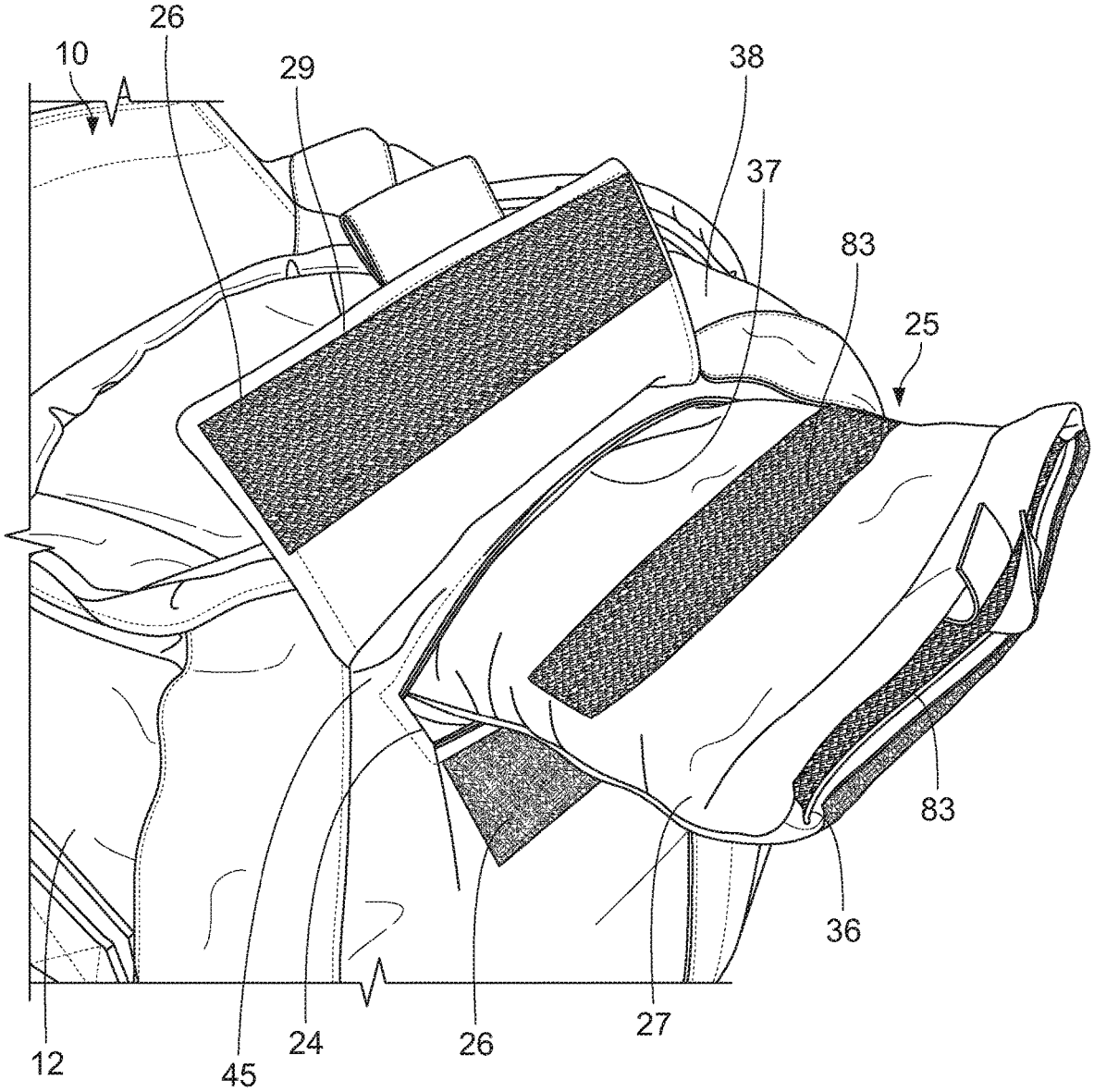
FIG. 40 is a top perspective view of a portion of the weighted bag of FIG. 38, with a cover flap open and a funnel structure extended.
Figure 41:
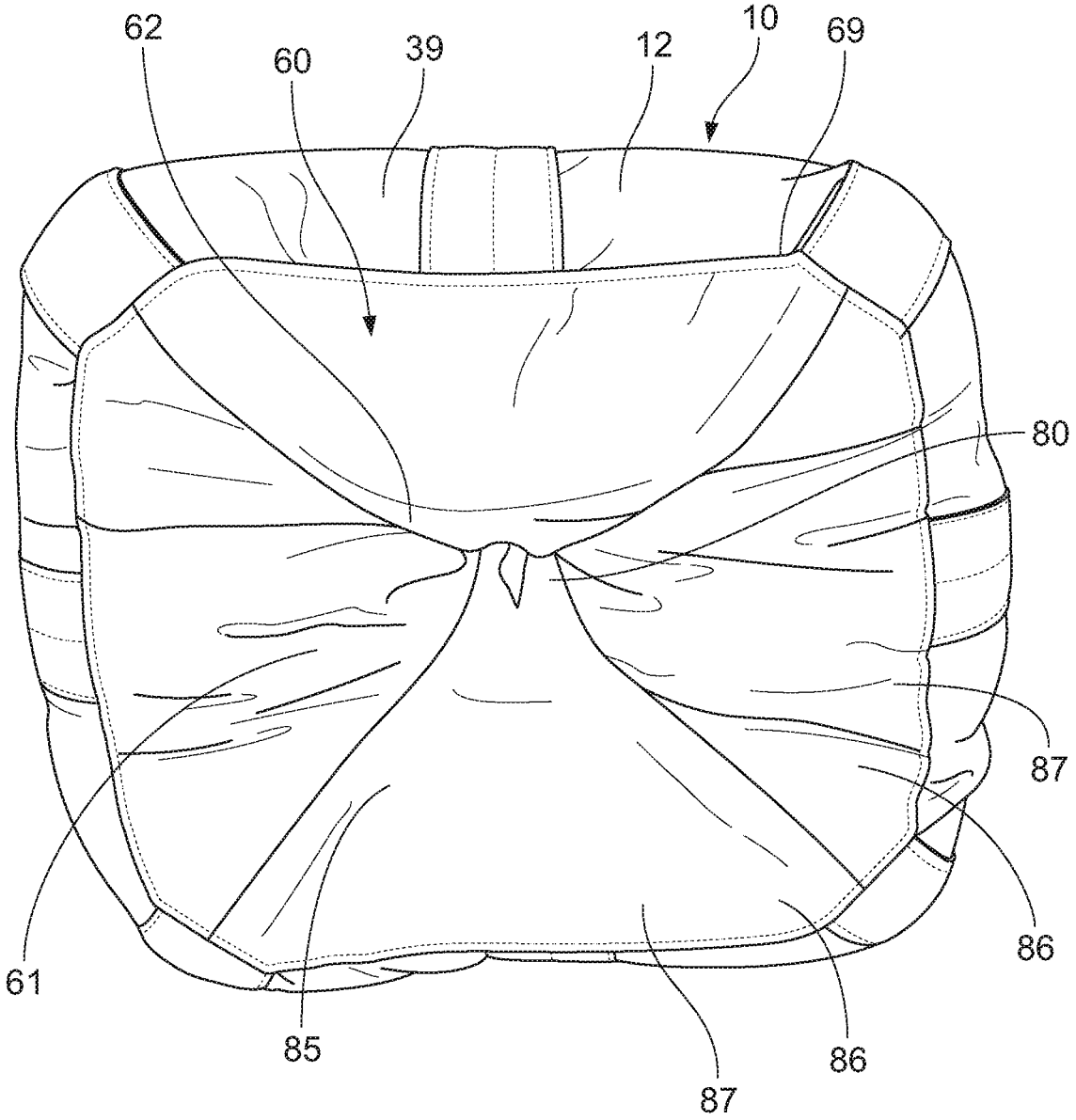
FIG. 41 is a bottom view of the weighted bag of FIG. 38.
Figure 42:
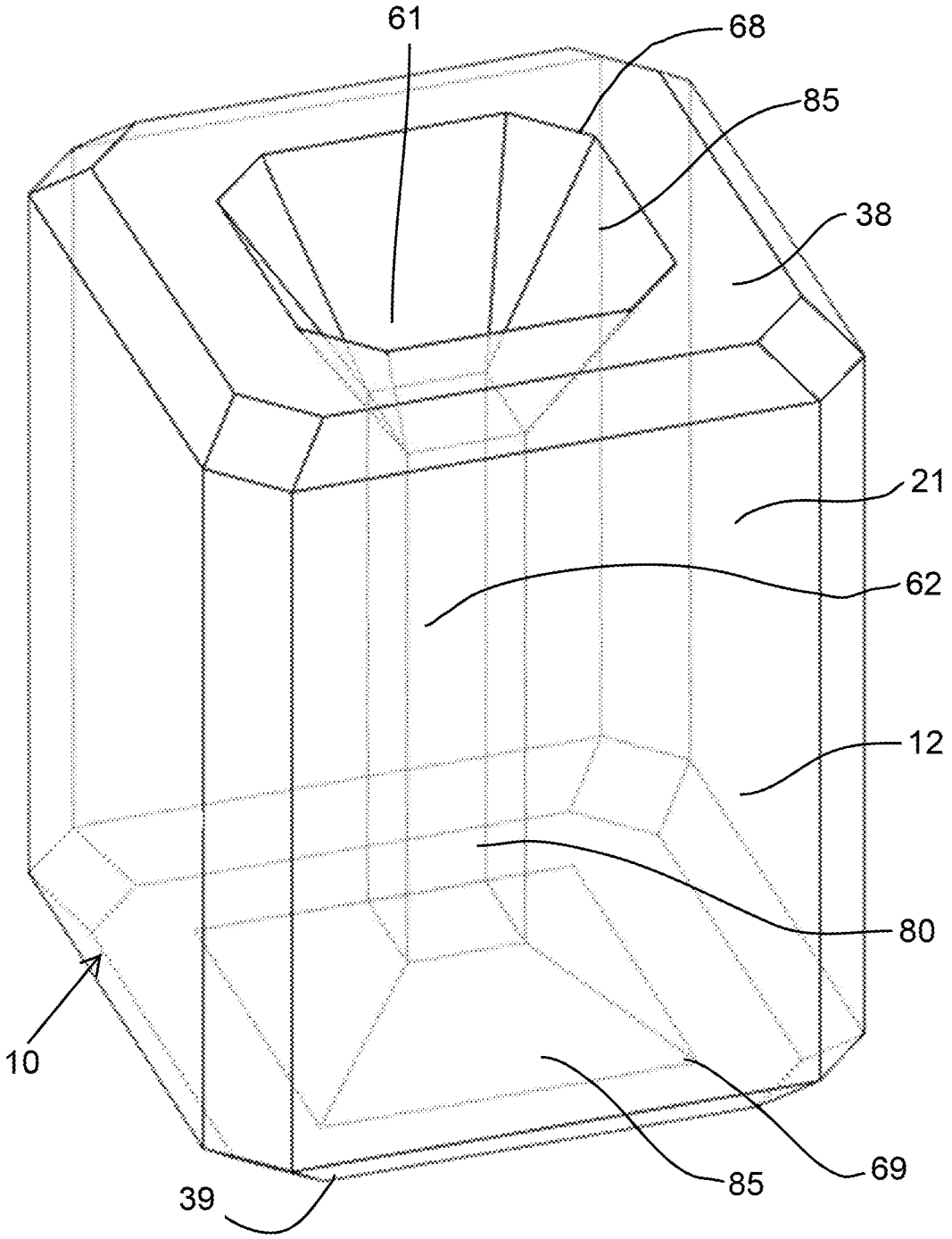
FIG. 42 is a schematic perspective view of an outer shell of the weighted bag of FIG. 38, showing internal detail.
Figure 43:
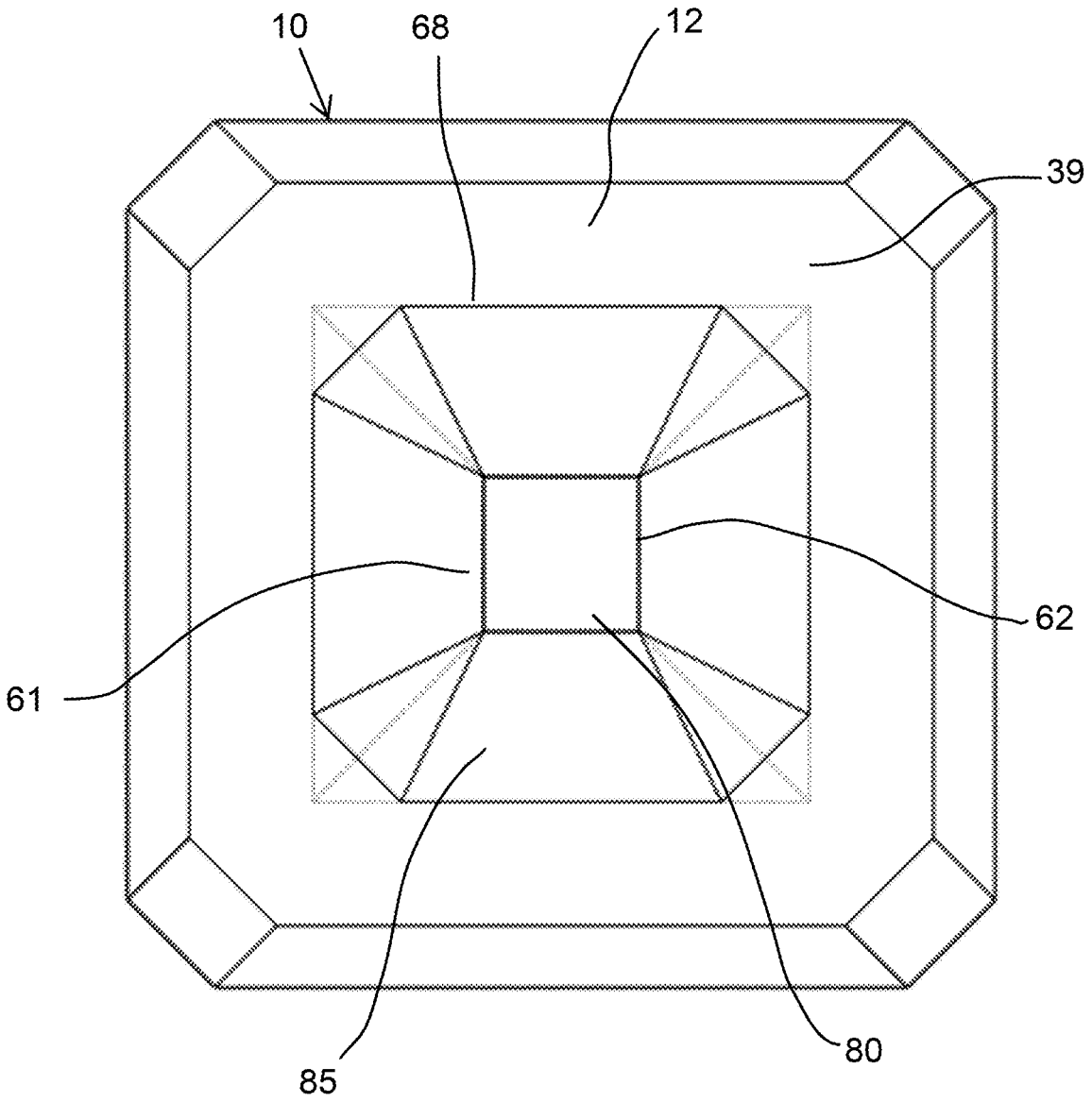
FIG. 43 is a schematic top view of the outer shell of FIG. 42.
Figure 44:
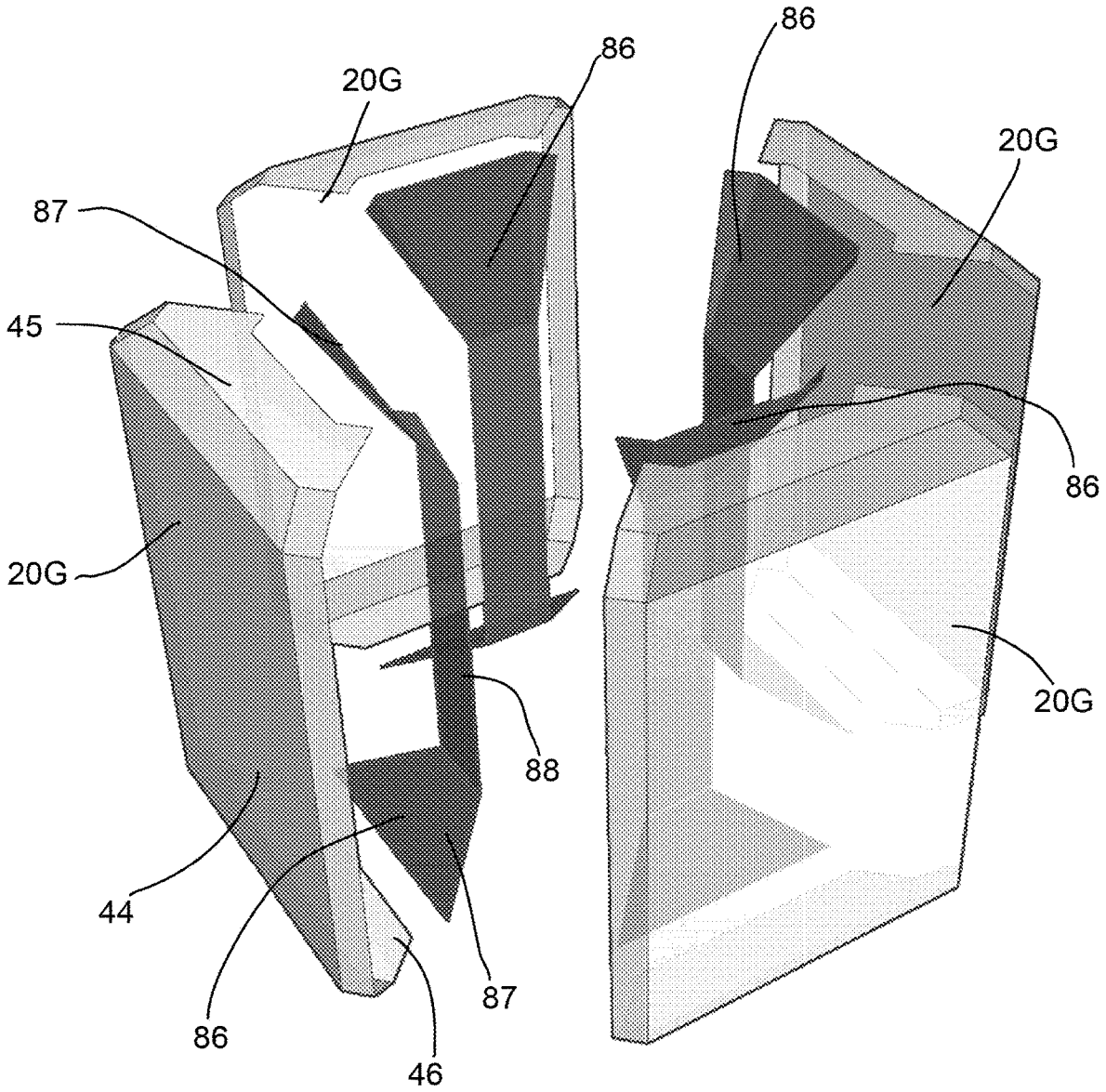
FIG. 44 is a schematic exploded perspective view of the outer shell of FIG. 42.

The bag 10 in FIGS. 33-47 includes a connection structure 60 for connection to an implement for use in a weightlifting exercise. The implement shown in FIGS. 33-37 is a handle assembly 70 as described herein with respect to the embodiment of FIGS. 1-15. In one embodiment, the handle assembly 70 may further include a pad 78 connected to the base 72, as shown in FIG. 36, to provide cushioning and protection for the base 72. The pad 78 may be connected to the base 72 in a variety of manners, such as having a cavity to receive the base 72, using straps or fasteners, or another configuration.

The connection assembly 60 includes a tube structure 61 extending through the inner cavity 21 of the outer shell 12 to receive a portion of the handle assembly 70 or other implement therethrough. The tube structure 61 includes a tube 62 extending through the inner cavity 21, with flared portions 85 connecting the top 38 and the bottom 39 of the outer shell 12 to the tube 62. The flared portions 85 flare outward from the tube 62 and are secured to the outer shell 12 (e.g., at the top portions 45 and the bottom portions 46 of the panels 20G) around openings 68, 69 defined in the top 38 and the bottom 39 of the outer shell 12 respectively. The tube 62 and/or the flared portions 85 may be made from fabric, such as the same material as the outer shell 12 or the inner bag 14, and may be connected via stitching or other connection technique. In one embodiment, the tube 62 and the flared portions 85 are made from 1050 denier Ballistic Nylon. In the embodiment of FIGS. 33-47, the tube and the flared portions 85 are integral with each other, and are formed by a plurality of tube panels 86 that are connected to the top 38 and the bottom 39 of the outer shell 12 and are connected to each other side-by-side, e.g., by stitching. Each tube panel 86 has wide portions 87 at opposite ends thereof and a narrow portion 88 extending between the wide portions 87. The wide portions 87 of the tube panels 86 are connected to the top 38 and the bottom 39 of the outer shell 12. When connected to each other and to the outer shell 12, the wide portions 87 of the tube panels 86 combine to form the flared portions 85, and the narrow portions 88 combine to form the tube 62. The tube structure 61 in other embodiments may include features described herein in connection with other embodiments, including reinforcing rings, an inner tube member, or stabilizing members that connect the tube 62 to inner surfaces of the bag 10, e.g., to the outer shell 12 and/or the inner bag(s) 14.

The inner bags 14 in the embodiment of FIGS. 33-47 are positioned around the tube structure 61 as described above, such that the concave inner side walls 47 of the inner bags 14 each surround at least a portion of the tube 62. As seen in FIGS. 45-47, the inner bags 14 surround opposite portions of the tube 62, and in one embodiment, the combined inner bags 14 surround the entire tube 62. In an embodiment where additional inner bags 14 are used, the combination of all inner bags 14 may surround the tube 62. In an embodiment where only a single inner bag 14 is used, the inner bag may have a center channel (which may be enclosed or open to a side of the inner bag 14) such that the inner bag 14 partially or completely surrounds the tube 62. The inner bag(s) 14 may also be connected (e.g., stitched) to the inner surfaces of the tube 62 in a further embodiment.

Various embodiments of weighted bags have been described herein, which include various components and features. In other embodiments, the weighted bags may be provided with any combination of such components and features. It is also understood that in other embodiments, the various devices, components, and features of the weighted bags described herein may be constructed with similar structural and functional elements having different configurations, including different ornamental appearances.

The weighted bags 10 and weightlifting assemblies 100 disclosed herein provide numerous advantages with respect to prior bags and assemblies. For example, the bags 10 provide increased versatility, with the ability to be used alone or with an implement to form a weightlifting assembly. As another example, the weightlifting assemblies 100 provide the ability to perform weightlifting exercises with less noise and potential damage to surrounding structures than rigid weights, and are less likely to bounce erratically, even with very high loads. Still further benefits and advantages are apparent to those skilled in the art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "back," "side," "rear," "proximal," "distal," and the like, as used herein, are intended for illustrative purposes only and do not limit the embodiments in any way. Nothing in this specification should be construed as requiring a specific three dimensional orientation of structures in order to fall within the scope of this invention, unless explicitly specified by the claims. When used in description of a method or process, the term "providing" (or variations thereof) as used herein means generally making an article available for further actions, and does not imply that the entity "providing" the article manufactured, assembled, or otherwise produced the article. The term "approximately" as used herein implies a variation of up to 10% of the nominal value modified by such term, or up to 10% of a midpoint value of a range modified by such term. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. An assembly comprising:

a bag defining an inner cavity configured to contain a particulate material and having a top and a bottom opposite the top, with a tube structure comprising a tube extending from the top to the bottom, through the inner cavity; and a handle assembly engaged with the bag, the handle assembly comprising an enlarged base having a greater width than the tube, positioned at the bottom of the bag, a sleeve connected to the enlarged base and extending at least partially through the tube, and a pin received within the sleeve and secured to the sleeve, the pin having a handle located outside the sleeve and above the top of the bag.

2. The assembly of claim 1, wherein the pin and the sleeve are releasably securable to each other in a plurality of different positions to change a length of the handle assembly.

3. The assembly of claim 2, wherein the sleeve has an opening extending through a wall of the sleeve, and the pin has a plurality of passages along a length of the pin, and wherein the pin and the sleeve are releasably securable to each other by a fastener releasably received the opening in the sleeve and one of the plurality of passages of the pin.

4. An assembly comprising:

a first bag defining a first inner cavity configured to contain a particulate material and having a first top and a first bottom opposite the first top, with a first tube structure defining a first passage extending from the first top to the first bottom, through the first inner cavity;

a second bag defining a second inner cavity configured to contain a particulate material and having a second top and a second bottom opposite the second top, with a second tube structure defining a second passage extending from the second top to the second bottom, through the second inner cavity; and a rope engaged with the first bag and the second bag, the rope extending through the first passage and the second passage, such that the first bag and the second bag are positioned sequentially along a length of the rope.

5. The assembly of claim 4, wherein the first bag further comprises:

a first outer shell comprising a plurality of first flexible panels connected together to define the first inner cavity, the first outer shell defining the first top and the first bottom, and a first opening providing access to the first inner cavity, wherein the first tube structure extends through the first outer shell from the first top to the first bottom, the first tube structure comprising a first top opening in the first top, a first bottom opening in the first bottom, and a first tube extending through the first inner cavity, from the first top to the first bottom; and a first inner bag positioned within the first inner cavity and having a first filling cavity configured to contain the particulate material, wherein the first inner bag has a first inner top opening and a first inner bottom opening, and the first tube extends through the first inner bag from the first inner top opening to the first inner bottom opening, and wherein the first inner bag is accessible through the first opening in the first outer shell for filling.

6. The assembly of claim 5, wherein the first outer shell further comprises a first cover releasably secured to the first outer shell by a first shell closure to open and close the first opening, such that the first cover is configured to be moved to provide access to the first inner cavity when the first shell closure is disconnected.

7. The assembly of claim 5, further comprising a plurality of first mesh baffles connected to the first inner bag and extending across the first filling cavity of the first inner bag.

8. The assembly of claim 5, wherein the first tube is a first outer tube formed of a fabric material, the first bag further comprising a first inner tube positioned within the first outer tube and extending along at least a portion of a length of the first outer tube, wherein the first inner tube has greater rigidity than the first outer tube.

9. The assembly of claim 4, wherein the rope further comprises at least one knot positioned along the length of the rope to secure at least one of the first bag and the second bag in position.

10. A bag comprising:

an outer shell comprising a plurality of flexible panels connected together to define an inner cavity configured to contain a particulate material, the outer shell having a first end, a second end opposite the first end, and an opening providing access to the inner cavity;

a tube structure extending through the outer shell from the first end to the second end of the outer shell, the tube structure comprising a first opening in the first end of the outer shell, a second opening in the second end of the outer shell, and a tube extending through the inner cavity of the outer shell, from the first opening to the second opening; and an inner bag positioned within the inner cavity of the outer shell and having a filling cavity configured to contain the particulate material, wherein the inner bag has a top opening and a bottom opening, and the tube extends through the inner bag from the top opening to the bottom opening, and wherein the inner bag is accessible through the opening in the outer shell for filling, wherein the outer shell further comprises a cover releasably secured to the outer shell by a shell closure to open and close the opening, such that the cover is configured to be moved to provide access to the inner cavity when the shell closure is disconnected.

11. A bag comprising:

an outer shell comprising a plurality of flexible panels connected together to define an inner cavity configured to contain a particulate material, the outer shell having a first end, a second end opposite the first end, and an opening providing access to the inner cavity; and a tube structure extending through the outer shell from the first end to the second end of the outer shell, the tube structure comprising a first opening in the first end of the outer shell, a second opening in the second end of the outer shell, and a tube extending through the inner cavity of the outer shell, from the first opening to the second opening, wherein the tube structure further comprises a first flared portion at the first opening, connecting the first end of the outer shell to the tube, and a second flared portion at the second opening, connecting the second end of the outer shell to the tube, wherein the tube extends from the first flared portion to the second flared portion.

12. The bag of claim 11, wherein the first flared portion, the second flared portion, and the tube are formed by a plurality of fabric panels connected together side by side, each of the fabric panels comprising a first wide portion forming part of the first flared portion, a second wide portion forming part of the second flared portion, and a narrow portion extending from the first flared portion to the second flared portion and forming part of the tube.

13. A bag comprising:

an outer shell comprising a plurality of flexible panels connected together to define an inner cavity configured to contain a particulate material, the outer shell having a first end, a second end opposite the first end, and an opening providing access to the inner cavity;

a tube structure extending through the outer shell from the first end to the second end of the outer shell, the tube structure comprising a first opening in the first end of the outer shell, a second opening in the second end of the outer shell, and a tube extending through the inner cavity of the outer shell, from the first opening to the second opening;

an inner bag positioned within the inner cavity of the outer shell and having a filling cavity configured to contain the particulate material, wherein the inner bag is accessible through the opening in the outer shell for filling, and wherein the inner bag surrounds at least a portion of the tube structure; and a plurality of mesh baffles connected to the inner bag and extending across the filling cavity of the inner bag.

14. A bag comprising:

an outer shell comprising a plurality of flexible panels connected together to define an inner cavity configured to contain a particulate material, the outer shell having a first end, a second end opposite the first end, and an opening providing access to the inner cavity;

a tube structure extending through the outer shell from the first end to the second end of the outer shell, the tube structure comprising a first opening in the first end of the outer shell, a second opening in the second end of the outer shell, and a tube extending through the inner cavity of the outer shell, from the first opening to the second opening;

an inner bag positioned within the inner cavity of the outer shell and having a filling cavity configured to contain the particulate material, wherein the inner bag is accessible through the opening in the outer shell for filling, and wherein the inner bag surrounds at least a portion of the tube structure; and a second inner bag positioned inside of the outer shell and having a second filling cavity configured to contain the particulate material, wherein the second inner bag is accessible through an additional opening in the outer shell for filling, and wherein the second inner bag surrounds a second portion of the tube structure and is positioned alongside the inner bag within the inner cavity.

15. A bag comprising:

an outer shell comprising a plurality of flexible panels connected together to define an inner cavity configured to contain a particulate material, the outer shell having a first end, a second end opposite the first end, and an opening providing access to the inner cavity; and a tube structure extending through the outer shell from the first end to the second end of the outer shell, the tube structure comprising a first opening in the first end of the outer shell, a second opening in the second end of the outer shell, and a tube extending through the inner cavity of the outer shell, from the first opening to the second opening;

wherein the outer shell has a rectangular cubic shape, and the plurality of flexible panels include four side panels forming four flat, rectangular sides of the rectangular cubic shape.

16. The bag of claim 15, wherein the outer shell further comprises a rectangular cover panel forming a cover at the first end of the outer shell, secured to one of the four side panels at an edge connection and releasably secured to the other side panels by a shell closure, and a bottom panel at the second end of the outer shell, secured to the flat side panels opposite the rectangular cover panel.

17. A bag comprising:

an outer shell comprising a plurality of flexible panels connected together to define an inner cavity configured to contain a particulate material, the outer shell having a first end, a second end opposite the first end, and an opening providing access to the inner cavity; and a tube structure extending through the outer shell from the first end to the second end of the outer shell, the tube structure comprising a first opening in the first end of the outer shell, a second opening in the second end of the outer shell, and a tube extending through the inner cavity of the outer shell, from the first opening to the second opening, wherein the outer shell has a cover positioned at the first end, and a shell closure releasably secures the cover to the outer shell around at least a portion of the cover to permit the cover to be opened and closed, further comprising a foldable flap moveable between a covered position, where the foldable flap covers the shell closure, and an uncovered position, where the foldable flap is positioned to permit a closure member of the shell closure to be manipulated to operate the shell closure to open the cover.

18. The bag of claim 17, wherein the foldable flap is formed as a collar having a fixed end connected to the outer shell around a majority of a periphery of the outer shell and a free end configured to be moveable to fold the collar between the covered position and the uncovered position.

19. A bag comprising:

an outer shell comprising a plurality of flexible panels connected together to define an inner cavity configured to contain a particulate material, the outer shell having a first end, a second end opposite the first end, and an opening providing access to the inner cavity; and a tube structure extending through the outer shell from the first end to the second end of the outer shell, the tube structure comprising a first opening in the first end of the outer shell, a second opening in the second end of the outer shell, and a tube extending through the inner cavity of the outer shell, from the first opening to the second opening, wherein the tube is an outer tube formed of a fabric material, the bag further comprising an inner tube positioned within the outer tube and extending along at least a portion of a length of the outer tube, wherein the inner tube has greater rigidity than the outer tube.

20. A bag comprising:

an outer shell comprising a plurality of flexible panels connected together to define an inner cavity configured to contain a particulate material, the outer shell having a first end, a second end opposite the first end, and an opening providing access to the inner cavity; and a tube structure extending through the outer shell from the first end to the second end of the outer shell, the tube structure comprising a first opening in the first end of the outer shell, a second opening in the second end of the outer shell, and a tube extending through the inner cavity of the outer shell, from the first opening to the second opening, wherein the outer shell has a cylindrical shape, and the plurality of flexible panels include a circumferential body panel forming a circumferential side wall of the cylindrical shape, a circular top panel at the first end of the outer shell, and a circular bottom panel at the second end of the outer shell, and wherein the circular top panel is a cover panel secured to the circumferential body panel at an edge connection and releasably secured around a remainder of the circumferential body panel by a shell closure.

21. A bag comprising:

an outer shell comprising a plurality of flexible panels connected together to define an inner cavity configured to contain a particulate material, the outer shell having a first end, a second end opposite the first end, and an opening providing access to the inner cavity;

a tube structure extending through the outer shell from the first end to the second end of the outer shell, the tube structure comprising a first opening in the first end of the outer shell, a second opening in the second end of the outer shell, and a tube extending through the inner cavity of the outer shell, from the first opening to the second opening; and an inner bag positioned within the inner cavity of the outer shell and having a filling cavity configured to contain the particulate material, wherein the inner bag has a top opening and a bottom opening, and the tube extends through the inner bag from the top opening to the bottom opening, and wherein the inner bag is accessible through the opening in the outer shell for filling, wherein the tube has a top end that is fixed to the top opening of the inner bag and a bottom end that is fixed to the bottom opening of the inner bag, and wherein the inner bag is fixed to the outer shell within the inner cavity.

22. The bag of claim 10, wherein the cover is a flap connected to the outer shell along an edge connection, and wherein the cover is configured to provide access to the inner cavity by pivoting about the edge connection when the shell closure is disconnected.

23. The bag of claim 13, wherein the plurality of mesh baffles are connected to the tube and an inner surface of the inner bag and extend across the filling cavity from the tube to the inner surface of the inner bag.

* * * * *